US010500866B2

(12) United States Patent
Kawate et al.

(10) Patent No.: US 10,500,866 B2
(45) Date of Patent: Dec. 10, 2019

(54) LIQUID CONTAINER

(71) Applicant: SEIKO EPSON CORPORATION, Tokyo (JP)

(72) Inventors: Hiroyuki Kawate, Hokuto (JP); Tadahiro Mizutani, Shiojiri (JP); Yoshiaki Shimizu, Matsumoto (JP); Takumi Nagashima, Matsumoto (JP); Akihiro Toya, Matsumoto (JP); Hiroyoshi Ozeki, Shiojiri (JP); Manabu Yamaguchi, Shiojiri (JP); Tetsuya Takamoto, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 19 days.

(21) Appl. No.: 15/674,948

(22) Filed: Aug. 11, 2017

(65) Prior Publication Data

US 2018/0043695 A1 Feb. 15, 2018

(30) Foreign Application Priority Data

Aug. 12, 2016 (JP) ..... 2016-158443
Oct. 17, 2016 (JP) ..... 2016-203317
Feb. 24, 2017 (JP) ..... 2017-033151

(51) Int. Cl.
*B41J 2/01* (2006.01)
*B41J 2/175* (2006.01)
(Continued)

(52) U.S. Cl.
CPC ..... *B41J 2/17503* (2013.01); *B41J 2/01* (2013.01); *B41J 2/175* (2013.01); *B41J 2/1752* (2013.01);
(Continued)

(58) Field of Classification Search
CPC . B41J 2/17503; B41J 2/01; B41J 29/13; B41J 25/34; B41J 2/175; B41J 2/17509;
(Continued)

(56) References Cited

U.S. PATENT DOCUMENTS 3,952,649 A * 4/1976 Dikoff ..... B41J 17/32 101/100
8,220,909 B2 7/2012 Domae
(Continued)

FOREIGN PATENT DOCUMENTS

JP H01-133749 A 5/1989
JP 2008-207429 A 9/2008
(Continued)

OTHER PUBLICATIONS

International Search Report dated Oct. 10, 2017 in PCT/JP2017/028561 with English-language translation (4 pgs.).

*Primary Examiner* — Anh T Vo
(74) *Attorney, Agent, or Firm* — Foley & Lardner LLP

(57) ABSTRACT

The liquid container is detachable from a case of a liquid ejection apparatus. The liquid container has a bag-shaped member that is flexible and has a storage portion for storing a liquid therein, and a connection member attached to the bag-shaped member. The connection member has a liquid introducing outlet into which a liquid introducing portion of the liquid ejection apparatus is inserted, a container-side electrical connection unit to which an apparatus-side electrical connection unit of the liquid ejection apparatus is connected, and a handle that pivots with respect to the connection member. In a state where the liquid container is arranged in the case, the handle is provided at a position exposed to the outside of the case, and when the liquid container is mounted to/removed from the case, the handle
(Continued)

is brought into a second orientation in which the handle is pivoted from a first orientation.

16 Claims, 50 Drawing Sheets

(51) Int. Cl.
*B41J 29/13* (2006.01)
*B41J 25/34* (2006.01)

(52) U.S. Cl.
CPC ..... *B41J 2/1753* (2013.01); *B41J 2/17509* (2013.01); *B41J 2/17513* (2013.01); *B41J 2/17523* (2013.01); *B41J 2/17553* (2013.01); *B41J 2/17596* (2013.01); *B41J 29/13* (2013.01); *B41J 25/34* (2013.01); *B41J 2002/17516* (2013.01)

(58) Field of Classification Search
CPC .. B41J 2/17513; B41J 2/1752; B41J 2/17523; B41J 2/1753; B41J 2/17553; B41J 2/17596; B41J 2002/17516
See application file for complete search history.

(56) References Cited

U.S. PATENT DOCUMENTS

| | | | | |
|---|---|---|---|---|
| 8,864,291 | B2 | 10/2014 | Urabe | |
| 8,926,074 | B2 | 1/2015 | Morino et al. | |
| 8,931,887 | B2 | 1/2015 | Aoki et al. | |
| 9,067,426 | B2 | 6/2015 | Urabe | |
| 9,139,013 | B2 | 9/2015 | Nagashima et al. | |
| 9,227,415 | B2 | 1/2016 | Nagashima et al. | |
| 9,346,278 | B2 | 5/2016 | Ishizawa et al. | |
| 9,636,918 | B2 * | 5/2017 | Okuno | B41J 2/17526 |
| 2013/0176367 | A1 | 7/2013 | Morino et al. | |
| 2013/0186513 | A1 | 7/2013 | Aoki et al. | |
| 2015/0070445 | A1 | 3/2015 | Kanbe et al. | |
| 2015/0321481 | A1 * | 11/2015 | Ishizawa | B41J 2/17523 347/86 |
| 2016/0016411 | A1 | 1/2016 | Kawate et al. | |
| 2016/0096375 | A1 | 4/2016 | Ozeki | |
| 2016/0176195 | A1 * | 6/2016 | Kawate | B41J 2/17506 347/86 |
| 2017/0100940 | A1 | 4/2017 | Ishizawa et al. | |

FOREIGN PATENT DOCUMENTS

| | | | |
|---|---|---|---|
| JP | 2009-279876 | A | 12/2009 |
| JP | 2012-096422 | A | 5/2012 |
| JP | 2014-024349 | A | 2/2014 |
| JP | 2014-240182 | A | 12/2014 |
| JP | 2015-058542 | A | 3/2015 |
| JP | 2016-007786 | A | 1/2016 |
| JP | 2016-022637 | A | 2/2016 |
| JP | 2016-043595 | A | 4/2016 |
| JP | 2016-132135 | A | 7/2016 |
| WO | WO-2013/105504 | A1 | 7/2013 |
| WO | WO-2015/136933 | A1 | 9/2015 |

* cited by examiner

LIQUID CONTAINER

CROSS REFERENCE TO RELATED APPLICATIONS

This application claims priority to Japanese Application No. 2016-158443 filed on Aug. 12, 2016, No. 2016-203317 filed on Oct. 17, 2016, and No. 2017-33151 filed on Feb. 24, 2017. The entire disclosures of these Japanese applications are expressly incorporated by reference herein.

BACKGROUND

1. Technical Field

The present invention relates to a liquid container.

2. Related Art

As one aspect of a liquid container, so-called ink packs are known (e.g., see JP-A-2009-279876). In such ink packs, ink that is supplied to an inkjet printer (hereinafter, simply referred to as a "printer" as well), which is one aspect of a liquid ejection apparatus, is stored in a container such as a flexible bag-shaped member. Some printers to which an ink pack is mounted are provided with a case such as a tray on which the ink pack is arranged. In such a printer, an ink supply path and an electric communication path between the ink pack and the printer are established by arranging the ink pack in the case, and mounting the ink pack arranged in the case to the printer.

JP-A-2009-279876 is an example of related art.

In the above-described printer, usually, an ink pack in which ink has been consumed is removed from the case, and is replaced with a new ink pack. However, in the ink pack, the flexible bag-shaped member constitutes a main body portion, and thus there is an issue in that the orientation of the ink pack is likely to be unstable, making it difficult to mount/remove the ink pack to/from the case. Such an issue is not limited to ink packs, and is common to liquid containers that are mounted to a liquid ejection apparatus in a state of being arranged in a case.

SUMMARY

The invention has been made in order to at least partially resolve the above-described issue, and can be realized as the following modes.

[1] According to one mode of the invention, a liquid container is provided. This liquid container is mounted to a liquid ejection apparatus. A direction parallel to a gravity direction is assumed to be a Z direction, the same direction in the Z direction as the gravity direction is assumed to a +Z direction, and an opposite direction in the Z direction to the gravity direction is assumed to be a −Z direction; a direction orthogonal to the Z direction is assumed to be a Y direction, one direction in the Y direction is assumed to be a +Y direction, and the other direction in the Y direction is assumed to be a −Y direction; and a direction orthogonal to the Z direction and the Y direction is assumed to be an X direction, one direction in the X direction is assumed to be a +X direction, and the other direction in the X direction is assumed to be a −X direction.

The liquid ejection apparatus has a housing, a case, a liquid introducing portion and an apparatus-side electrical connection unit. The housing is provided with a case storage unit therein. The case is inserted into the case storage unit by being moved in the +Y direction. The liquid introducing portion is positioned at an end portion on the +Y direction side of the case storage unit. The apparatus-side electrical connection unit is positioned at the end portion on the +Y direction side of the case storage unit.

The liquid container is detachable from the case. The liquid container has a bag-shaped member and a connection member. The bag-shaped member is flexible, and is provided with a storage portion for storing a liquid therein. In a mounted state in which the liquid container is mounted to the liquid ejection apparatus, the connection member is mounted to the bag-shaped member so as to be positioned at the end portion on the +Y direction side.

The connection member has a liquid introducing outlet, a container-side electrical connection unit and a handle. In the mounted state, the liquid introducing portion is inserted into the liquid introducing outlet in the −Y direction. In the mounted state, the apparatus-side electrical connection unit is connected to the container-side electrical connection unit in the −Y direction. The handle pivots toward the connection member with respect to an axis along the X direction in the mounted state.

The handle has a grip portion, a coupling portion, and a base end portion. The grip portion is gripped by a user. The coupling portion is coupled to the grip portion. The base end portion pivotably fixes the coupling portion to the connection member. In a state where the liquid container is arranged in the case, the handle is provided at a position exposed to the outside of the case, and when the liquid container is mounted to/removed from the case, is brought into a second orientation in which the handle is pivoted from a first orientation in the mounted state.

According to the liquid container of this mode, by using the handle, the convenience when handling the liquid container is improved when carrying the liquid container and mounting/removing the liquid container to/from the case, for example. In addition, the connection member provided with the handle is provided at an end portion of the liquid container, and thus when the user holds the handle and moves the liquid container, the orientation of the liquid container becomes stable in an orientation in which the liquid container on the bag-shaped member side is hung. Therefore, the handleability of the liquid container improves, and it is made easier to mount/remove the liquid container to/from the case.

[2] In the liquid container of the above-described mode, the grip portion may be arranged at a position protruding from the connection member toward the bag-shaped member in the first orientation, and may be arranged at a position protruding from the connection member in a direction opposite to the bag-shaped member in the second orientation.

According to the liquid container of this mode, both in the first orientation and the second orientation, the grip portion of the handle is positioned at a position where it can be easily gripped by the user. Therefore, it is easy to operate the handle, and it is easier to mount/remove the liquid container to/from the case.

[3] In the liquid container of the above-described mode, the first orientation may be an orientation in which the handle is arranged along a plane orthogonal to the Z direction in the mounted state.

According to the liquid container of this mode, in the mounted state, the handle is inhibited from protruding in the −Z direction. Therefore, it is possible to reduce the capacity of the storage unit in the liquid ejection apparatus, and to reduce the size of the liquid ejection apparatus.

[4] In the liquid container of the above-described modes, in the first orientation, the grip portion may be held at a position separated from the bag-shaped member.

According to the liquid container of this mode, in the mounted state, the bag-shaped member is not pressed by the handle, and thus deterioration of the pressure state of the storage portion inside the bag-shaped member due to a load received from the handle is suppressed.

[5] In the liquid container of the above-described modes, the connection member may have an upper face portion directed in the −Z direction in the mounted state, the handle may have an upper face portion directed in the −Z direction in the mounted state, and in the mounted state, the upper face portion of the handle may be positioned at the same position as the upper face portion of the connection member in the Z direction or at a position on the +Z direction side relative to the upper face portion of the connection member.

According to the liquid container of this mode, the handle is inhibited from obstructing the insertion of the liquid container arranged in the case into the case storage unit. Also, it is possible to simplify the configuration of the liquid container in the mounted state, and to reduce the size of the case storage unit.

[6] In the liquid container of the above-described modes, the connection member may have a restriction portion that comes into contact with the handle in the second orientation, and restricts a pivot range of the handle.

According to the liquid container of this mode, the orientation of the liquid container in the second orientation can be further stabilized.

[7] In the liquid container of the above-described modes, the case may have a bottom face directed in the −Z direction and two guiding portions protruding from the bottom face in the −Z direction, in a state where the case is arranged in the case storage unit, the connection member may have two guide portions into which the two guiding portions are respectively fitted in a state where the liquid container is arranged in the case, and the base end portion may be provided between the two guide portions in the X direction in the mounted state.

According to the liquid container of this mode, the user easily understands the position of the guide portions from the position of the handle. Therefore, an operation of mounting/removing the liquid container to/from the case using the handle is simplified. Positioning of the liquid container when arranging the liquid container in the case is made easier.

[8] In the liquid container of the above-described mode, the connection member may have an upper face portion directed in the −Z direction in the mounted state, and the two guiding portions may have upper end faces positioned at an end in the −Z direction in the mounted state and directed in the −Z direction, and in the mounted state, the upper end faces of the two guiding portions and the upper face portion of the connection member may be positioned at substantially the same position in the Z direction relative to the bottom face of the case.

According to the liquid container of this mode, the user can easily check whether or not the guide portions are appropriately fitted in the guiding portions, based on the upper face portion of the connection member. Therefore, the liquid container is inhibited from being stored in the case storage unit while the liquid container is not arranged in the case in an appropriate orientation.

[9] In the liquid container of the above-described modes, the two guide portions may each be constituted by a through hole passing through the connection member in the Z direction in the mounted state, and in the mounted state, the maximum value of an opening width in the X direction at an end portion on the +Z direction side of each of the two guide portions may be larger than the maximum value of an opening width in the X direction at an end portion on the −Z direction side of each of the two guide portions.

According to the liquid container of this mode, it is made easier to insert each guiding portion into one corresponding guide portion when the liquid container is arranged in the case. Also, when unexpected shock is applied to the liquid container arranged in the case, such as when the user has dropped the liquid container along with the case accidentally, the guide portions of the liquid container can be easily separated from the guiding portions of the case. Therefore, breakage of the liquid container due to the shock applied to the liquid container in a state of being arranged in the case is suppressed.

[10] In the liquid container of the above-described modes, in the mounted state, a distance in the Y direction from an end portion on the +Y direction side of the connection member to an end portion on the −Y direction side of the handle in the first orientation may be within one third of a distance in the Y direction from the end portion on the +Y direction side of the connection member to an end portion on the −Y direction side of the bag-shaped member.

According to the liquid container of this mode, in the mounted state, a range in which the handle and the bag-shaped member overlap in the Y direction can be reduced. Therefore, it is possible to inhibit the bag-shaped member from receiving a load from the handle in the mounted state while improving the operability of the handle. In addition, an increase in size of the handle in the mounted state is suppressed, and thus the storage unit of the liquid ejection apparatus can store the liquid container compactly.

[11] In the liquid container of the above-described modes, the grip portion may extend along the X direction in the mounted state, the coupling portion may include a first coupling portion and a second coupling portion that are respectively coupled with two ends of the grip portion in the X direction in the mounted state, and the base end portion may include a first base end portion that pivotably fixes the first coupling portion to the connection member and a second base end portion that pivotably fixes the second coupling portion to the connection member.

According to the liquid container of this mode, the handle can be configured to be shaped so as to be easily grasped, and to pivot in a stable manner. Therefore, the operability of the handle is improved, and the handleability of the liquid container is improved.

[12] In the liquid container of the above-described mode, a length of the grip portion in the X direction in the mounted state may be longer than a distance between the first base end portion and the second base end portion.

According to the liquid container of this mode, the size of the handle can be reduced by reducing the distance between the base end portions. It is also possible to change the shape of the grip portion to a shape that allows easier grip.

[13] In the liquid container of the above-described modes, in the second orientation, the handle may be held at a position overlapping the container-side electrical connection unit in the Z direction in the mounted state, and separated from the container-side electrical connection unit.

According to this liquid container, when handling the liquid container, the container-side electrical connection unit is protected by the handle in the second orientation.

[14] In the liquid container of the above-described modes, in the mounted state, the handle, the container-side electrical connection unit, and the liquid introducing portion may be arranged at positions not overlapping in the Z direction.

According to this liquid container, in the mounted state, the handle is arranged at a position where it does not interfere with the container-side electrical connection unit and the liquid introducing portion, and thus the handle can be configured to allow compact accommodation. Therefore, it is possible to reduce the size of the liquid container in the Z direction in the mounted state. In addition, the handle is inhibited from obstructing connection between the container-side electrical connection unit and the apparatus-side electrical connection unit as well as connection between the liquid introducing portion and the liquid introducing outlet.

[15] According to another mode of the invention, another liquid container that is mounted to a liquid ejection apparatus is provided. A direction parallel to a gravity direction is assumed to be a Z direction, the same direction in the Z direction as the gravity direction is assumed to be a +Z direction, and an opposite direction in the Z direction to the gravity direction is assumed to be a −Z direction; a direction orthogonal to the Z direction is assumed to be a Y direction, one direction in the Y direction is assumed to be a +Y direction, and the other direction in the Y direction is assumed to be a −Y direction; and a direction orthogonal to the Z direction and the Y direction is assumed to be an X direction, one direction in the X direction is assumed to be a +X direction, and the other direction in the X direction is assumed to be a −X direction. The liquid ejection apparatus has a housing provided with a case storage unit therein, a case that is inserted into the case storage unit by being moved along the +Y direction, and a liquid introducing portion that is positioned at an end portion on the +Y direction side of the case storage unit. The liquid container is detachable from the case, and is provided with: a bag-shaped member that is flexible, and provided with a storage portion for storing a liquid therein; a liquid introducing outlet into which the liquid introducing portion is inserted in the −Y direction in a mounted state in which the liquid container is mounted to the liquid ejection apparatus; and a sheet member that has a pivotable handle. The handle is provided at a position exposed to the outside of the case in a state where the liquid container is arranged in the case.

According to this liquid container, it is possible to provide the handle to the liquid container with ease, and to improve the handleability of the liquid container. Additionally, it is possible to simplify the configuration of the liquid container, reduce the weight of the liquid container, and reduce the manufacturing cost.

Not all of the plurality of constituent elements provided in the above modes of the invention are essential, and some of the plurality of constituent elements may be modified, removed, or replaced with other new constituent elements, or the limitations may be partially deleted as appropriate, in order to solve a part of or the entire problem described above, or in order to achieve some or all of the effects described in this specification. To solve some of or all of the foregoing problems, or to achieve some or all of the effects described in this specification, some or all of the technical features included in one of the above modes of the invention may be combined with some or all of the technical features included in another one of the above modes of the invention to make an independent mode of the invention.

The invention can also be achieved in various modes other than the liquid container. For example, the invention can be achieved in modes such as a liquid ejection apparatus, a liquid ejection system, a method for connecting the liquid container in the liquid ejection apparatus and a connection structure of the liquid container in the liquid ejection apparatus and the like. Note that in this specification, a "system" refers to a configuration aspect in which a plurality of constituent elements cooperate with each other in order to exert one or more functions. The "system" includes not only an aspect in which at least one or all of a plurality of constituent elements are arranged at separated places and cooperate with each other, but also an aspect in which a plurality of constituent elements cooperate with each other in a single apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

In a first embodiment, the configuration of a liquid ejection apparatus 10 will be described with reference to FIGS. 1 to 6. Also, the configuration of a liquid container 100 that is mounted to the liquid ejection apparatus 10 as well as the configuration of a case 61 used for mounting the liquid container 100 will be described with reference to FIGS. 7 to 37. Note that, in this specification, the liquid ejection apparatus 10 in a state where the liquid container 100 is mounted is also referred to as "a liquid ejection system 11".

A1. Configuration of Liquid Ejection Apparatus:

Appearance Configuration of Liquid Ejection Apparatus

Figure 1:
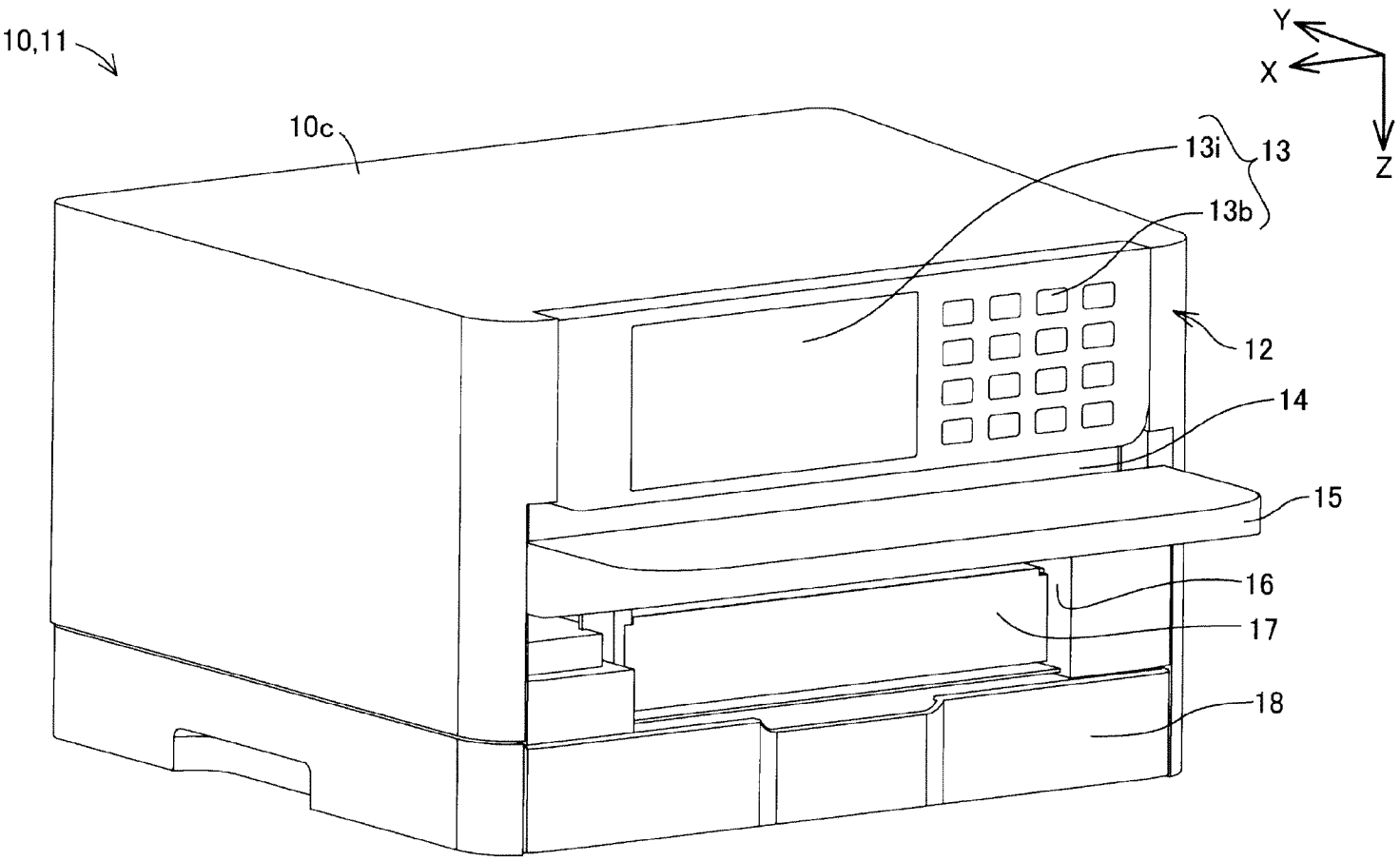
FIG. 1 is a schematic perspective diagram showing the appearance configuration of a liquid ejection apparatus.

FIG. 1 is a schematic perspective diagram showing the appearance configuration of the liquid ejection apparatus 10 constituting the liquid ejection system 11. In FIG. 1, arrows X, Y, and Z indicating three directions orthogonal to each other are illustrated. Note that also in other figures that are referred to in this specification, the arrows X, Y, and Z are illustrated in correspondence with FIG. 1 as appropriate.

The directions indicated by the arrows X, Y, and Z correspond to arrangement orientations of the liquid ejection apparatus 10 in a normal in-use state. The normal in-use state of the liquid ejection apparatus 10 is a state when the liquid ejection apparatus 10 is arranged on a horizontal surface and is used. Hereinafter, the directions indicated by the arrows X, Y, and Z are respectively referred to as an "X direction", a "Y direction", and a "Z direction". One direction in the X direction is referred to as a "+X direction", and the other direction is referred to as a "−the X direction". Similarly, regarding the Y and Z directions as well, one direction is referred to as a "+Y direction" or a "+Z direction", and the other direction is referred to as a "−Y direction" or a "−Z direction".

The Z direction, the Y direction, and the X direction will be described in the stated order. The Z direction indicates a direction parallel to the gravity direction. The +Z direction is the gravity direction, and the −Z direction is an opposite direction to the gravity direction. The Z direction coincides with the up-down direction (height direction) of the liquid ejection apparatus 10. In the following description, when a term "upper/above" or "lower/below" is used regarding the liquid ejection apparatus 10, the up-down direction that is based on the direction of the arrow Z is indicated, and "upper/above" refers to the −Z direction, and "lower/below" refers to the +Z direction, unless particularly stated otherwise. Also, the "horizontal direction" indicates a direction perpendicular to the Z direction.

The Y direction indicates the mounting/removing direction of the liquid container 100 in the liquid ejection apparatus 10, and coincides with a direction parallel to the front-back direction (depth direction) of the liquid ejection apparatus 10. The +Y direction indicates a direction in which the liquid container 100 is mounted to the liquid ejection apparatus 10, and coincides with a direction from the front side of the liquid ejection apparatus 10 toward the back side. The −Y direction indicates a direction in which the liquid container 100 is removed from the liquid ejection apparatus 10, and coincides with a direction from the back side of the liquid ejection apparatus 10 toward the front side. In the following description, when a term "front" or "back" is used regarding the liquid ejection apparatus 10, the front-back direction that is based on the direction of the arrow Y is indicated, and "front" refers to the −Y direction, and "back" refers to the +Y direction, unless specifically stated otherwise.

The X direction indicates a direction parallel to the right-left direction (width direction) of the liquid ejection apparatus 10. The +X direction coincides with a direction from the right side toward the left side when facing the front of the liquid ejection apparatus 10, and conversely, the −X direction coincides with a direction from the left side toward the right side. In the following description, when a term "right" or "left" is used regarding the liquid ejection apparatus 10, the right-left direction that is based on the direction of the arrow X is indicated, and "right" refers to the −X direction, and "left" refers to the +X direction, unless particularly stated otherwise.

In the following description, the X, Y, and Z directions in the description of constituent elements (e.g., the case 61 and the liquid containers 100), which can be separated from the liquid ejection apparatus 10, are all based on orientations in a mounted state in which such a constituent element is appropriately mounted to the liquid ejection apparatus 10 in a normal in-use state.

In this embodiment, the liquid ejection apparatus 10 is an inkjet printer, and the liquid ejection system 11 is an inkjet printing system. The liquid that is consumed in the liquid ejection apparatus 10 of this embodiment by being ejected is ink. The ink may be pigment ink, for example. The liquid ejection apparatus 10 discharges ink droplets, and records ink dots on a medium to be processed in order to form an image. The medium is printing paper, for example. The liquid ejection apparatus 10 of this embodiment is provided with a housing 10*c* that constitutes the exterior of the liquid ejection apparatus 10 and is a hollow box made of resin. The housing 10*c* has a substantially rectangular parallelepiped shape. A front face portion 12 envisioned to be directed on the −Y direction side and to face the user when the user operates the liquid ejection apparatus 10 is provided with an operation unit 13, a medium discharge port 14, a medium receiving portion 15, a medium storage port 16, a medium storage portion 17, and a cover member 18.

The operation unit 13 has a display unit 13*i* for displaying information to the user and a plurality of operation buttons 13*b* for receiving user operations. The medium discharge port 14 is an outlet for a medium fed from inside the liquid ejection apparatus 10. The medium discharge port 14 is formed as a slit-like opening portion wide in the X direction, and opens in the −Y direction. The medium receiving portion 15 extends under the medium discharge port 14 in the −Y direction in an eave-like shape, and receives a medium that has been discharged from the medium discharge port 14.

The medium storage port 16 is an opening for the user to replenish media to the liquid ejection apparatus 10. In this embodiment, the medium storage port 16 is open below the medium receiving portion 15 in the −Y direction, and has a substantially rectangular opening shape wide in the X direction. The medium storage portion 17 is a tray-shaped member for storing a stocked medium that is a medium to be processed in this embodiment. The medium storage portion 17 is stored in the medium storage port 16 in a state where the front face of the medium storage portion 17 is viewed from outside the liquid ejection apparatus 10 via the medium storage port 16. The user can replenish a medium to the liquid ejection apparatus 10 by storing the medium in the medium storage portion 17 pulled out from the liquid ejection apparatus 10 via the medium storage port 16 in the −Y direction, and loading the medium storage portion 17 back in the liquid ejection apparatus 10 from the medium storage port 16.

The cover member 18 is a plate-shaped member made of resin that constitutes a portion of the exterior of the liquid ejection apparatus 10. In this embodiment, the cover member 18 has a substantially rectangular shape whose width is larger in the X direction, and is arranged below the medium storage port 16. The cover member 18 has a claw (not illustrated) at an outer peripheral edge thereof, and is mounted detachably to the housing 10*c*. The cover member 18 covers and protects the plurality of liquid containers 100 stored inside the liquid ejection apparatus 10.

Internal Configuration of Liquid Ejection Apparatus

Figure 2:
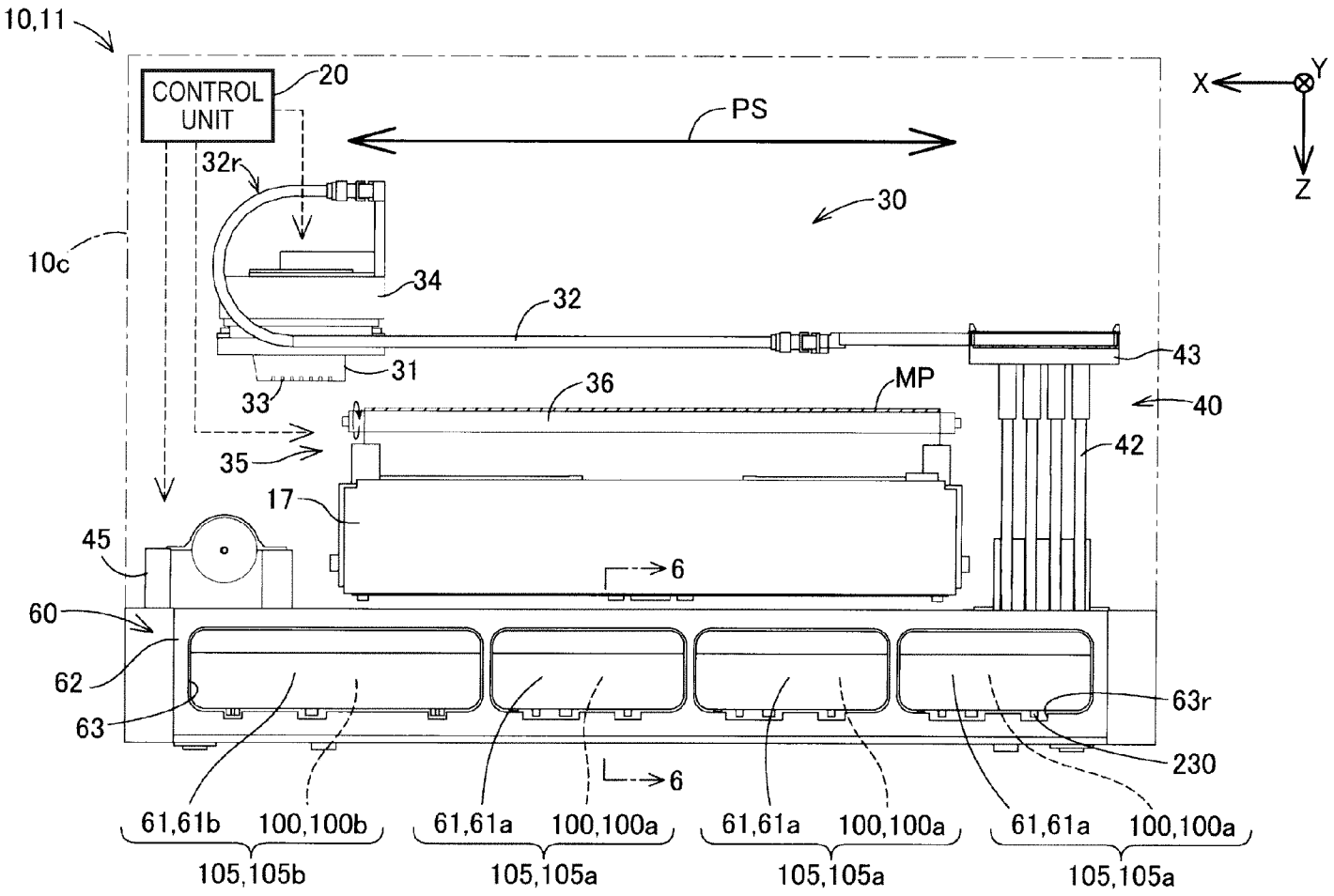
FIG. 2 is a first schematic diagram showing the internal configuration of the liquid ejection apparatus.
Figure 3:
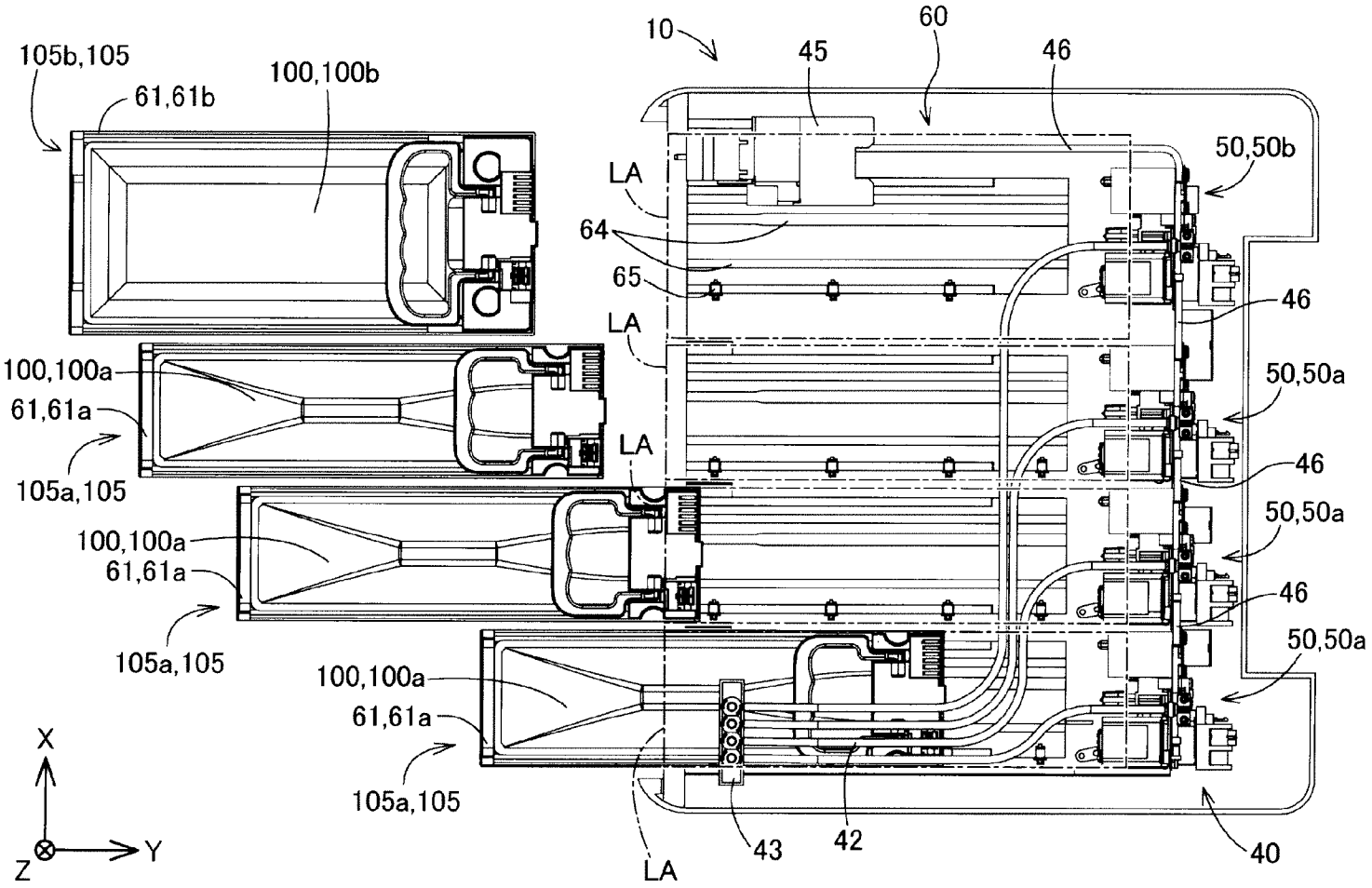
FIG. 3 is a second schematic diagram showing the internal configuration of the liquid ejection apparatus.

An overview of the internal configuration of the liquid ejection apparatus 10 will be described with reference to FIGS. 2 to 6 in order. FIG. 2 is a schematic diagram of the liquid ejection apparatus 10 when viewed in the +Y direction, in which the housing 10*c* and the cover member 18 are omitted. FIG. 2 illustrates a control unit 20, an ejection execution unit 30, a medium conveyance unit 35, a liquid supply unit 40, and a case storage unit 60 of the liquid ejection apparatus 10. FIG. 3 is a schematic diagram of the liquid ejection apparatus 10 when viewed in the +Z direction, in which the housing 10*c* and the cover member 18 are omitted. In FIG. 3, the control unit 20, the ejection execution unit 30 and the medium conveyance unit 35 illustrated in FIG. 2 are omitted. In addition, for convenience, FIG. 3 illustrates a state in which the plurality of liquid containers 100 along with the cases 61 are pulled out in the −Y direction from arrangement regions LA that are mounting positions at which mounting to the liquid ejection apparatus 10 is complete.

The liquid ejection apparatus 10 is provided with the control unit 20, the ejection execution unit 30, the medium conveyance unit 35, the liquid supply unit 40 and the case storage unit 60 (FIG. 2). In the liquid ejection apparatus 10, a liquid is supplied from the liquid container 100 stored in the case storage unit 60 to the ejection execution unit 30 via a supply pipe 42 of the liquid supply unit 40. The ejection execution unit 30 then discharges the liquid onto a medium MP that that has been fed out from the medium storage portion 17 and conveyed by the medium conveyance unit 35, thereby forming a printing image on the medium MP. The control unit 20, the ejection execution unit 30, the medium conveyance unit 35, the liquid supply unit 40, and the case storage unit 60 will be described in order.

Control Unit

The control unit 20 controls driving of constituent elements of the liquid ejection apparatus 10. The control unit 20 is constituted by a microcomputer provided with at least a central processing unit and a main storage apparatus, and achieves various functions by the central processing unit loading various programs storaged in the main storage apparatus and executing the programs. Functions of the control unit 20 will be described sequentially.

Ejection Execution Unit

The ejection execution unit 30 is provided with a head unit 31 and a plurality of tubes 32 (FIG. 2). The head unit 31 receives a supply of liquid from the liquid supply unit 40 via the plurality of tubes 32. A mechanism for supplying a liquid from the liquid supply unit 40 will be described later. The head unit 31 is provided with a liquid chamber (not illustrated) for storing a liquid supplied from the liquid supply unit 40. On the bottom face of the liquid chamber, a nozzle 33 that is open downward is provided. The head unit 31 discharges the liquid in the liquid chamber from the nozzle 33 under control of the control unit 20, for example, by a known method for applying pressure to ink using a piezo element or the like.

In this embodiment, the head unit 31 is loaded on a carriage 34, and is configured to move linearly in a reciprocal manner in the X direction under control of the control unit 20. FIG. 2 illustrates a bidirectional arrow PS indicating the movement directions and the movement range of the head unit 31. In this embodiment, the main scanning direction of the liquid ejection apparatus 10 coincides with the X direction. The ejection execution unit 30 is provided with a guiding shaft for the carriage 34 to move, a motor for generating a driving force and a pulley for transmitting the driving force, as a driving mechanism for moving the head unit 31. Note that illustrations and a detailed description thereof are omitted.

The plurality of tubes 32 connected to the head unit 31 are flexible. The plurality of tubes 32 are arranged in parallel in the Y direction. The plurality of tubes 32 are arranged substantially linearly in the +X direction from a joint portion 43 that is a connection section connected to the supply pipes 42 of the liquid supply unit 40, which will be described later, along the scanning path of the head unit 31, curve upward, are folded in the −X direction, and are connected to the head unit 31. Curved sections 32*r* of the plurality of tubes 32 are displaced according to movement of the head unit 31. This inhibits the plurality of tubes 32 from obstructing main scanning performed by the head unit 31, and an operation of moving the head unit 31 becomes smoother.

Medium Conveyance Unit

The medium conveyance unit 35 conveys the medium MP to be processed under control of the control unit 20 (FIG. 2). The medium conveyance unit 35 is provided with a conveyance roller 36 installed below the head unit 31 in the X direction. The above-described medium storage portion 17 is arranged below the conveyance roller 36. The medium conveyance unit 35 is provided with a feeding mechanism (not illustrated) for feeding the medium MP one sheet at a time from the medium storage portion 17 onto the outer peripheral side face of the conveyance roller 36. The medium conveyance unit 35 pivots the conveyance roller 36 using a driving motor (not illustrated), and moves the medium MP below the head unit 31 in the −Y direction using the pivot driving force. In this embodiment, the sub-scanning direction of the liquid ejection apparatus 10 coincides with the −Y direction. The medium MP that has passed through a region below the head unit 31 is discharged to the outside of the liquid ejection apparatus 10 via the medium discharge port 14.

When executing printing processing in the liquid ejection apparatus 10, the control unit 20 causes the medium conveyance unit 35 to convey the medium MP in the above-described sub-scanning direction. The head unit 31 is then reciprocally moved above the conveyance roller 36 along the conveyance roller 36 in the main scanning direction, and at a timing determined based on printing data, ink droplets are discharged from the head unit 31 onto the printing face of the medium MP. Accordingly, on the medium MP, ink dots are recorded at positions determined based on the printing data, and an image that is based on the printing data is formed.

Liquid Supply Unit

Figure 4:
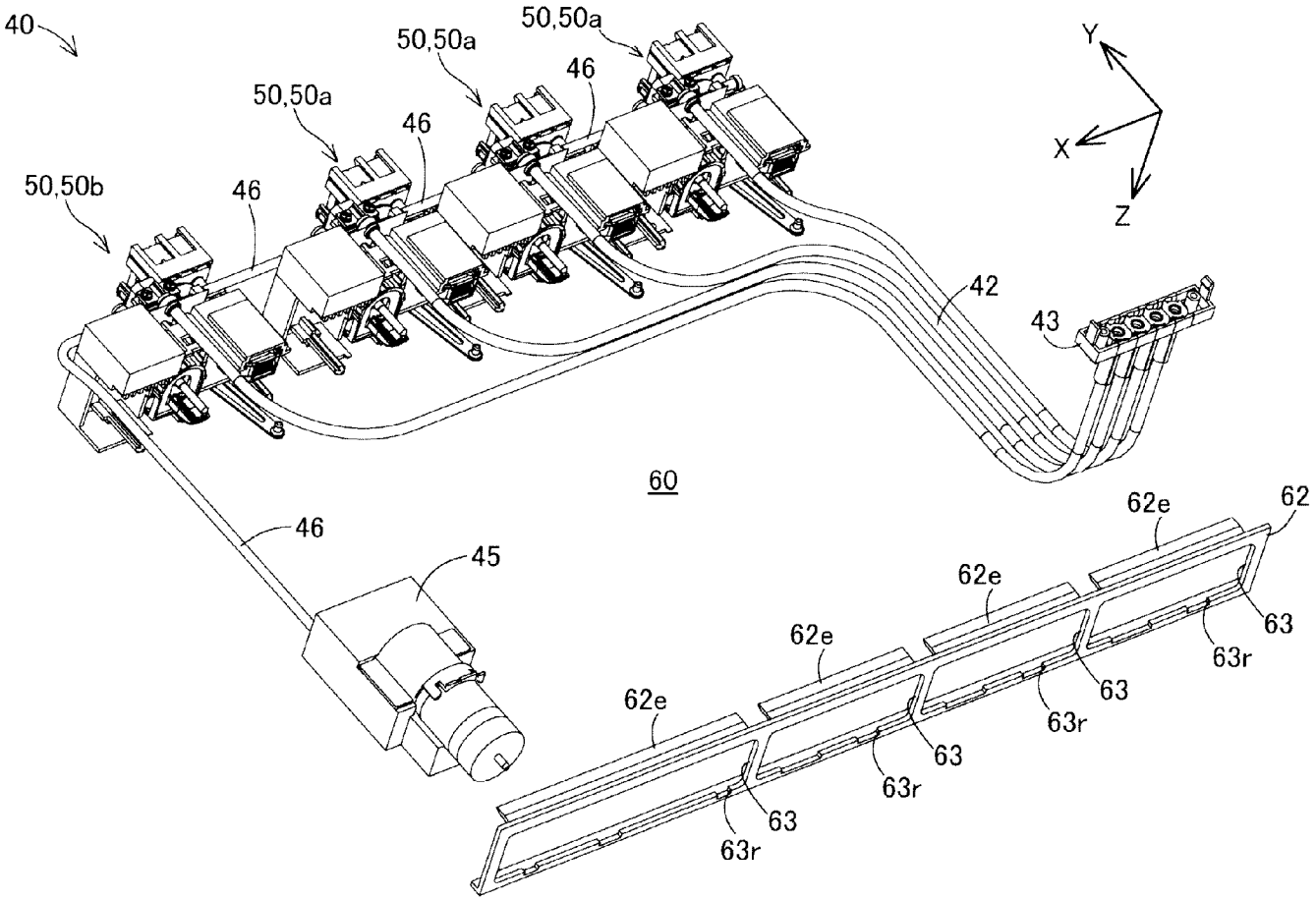
FIG. 4 is a schematic perspective diagram showing a liquid supply unit of the liquid ejection apparatus among others.

The liquid supply unit 40 will be described with reference to FIG. 4 along with FIGS. 2 and 3. FIG. 4 is a schematic perspective diagram showing the liquid supply unit 40 of the liquid ejection apparatus 10 among others. FIG. 4 illustrates an opening member 62 of the liquid ejection apparatus 10 among others in addition to the liquid supply unit 40 in order to show the positional relationship between the liquid supply unit 40 and the opening member 62 in the liquid ejection apparatus 10. The liquid supply unit 40 is provided with a plurality of connection receiving units 50, a fluctuation pressure generation unit 45 and a pressure transmission pipe 46 (FIGS. 3 and 4) in addition to the above-described plurality of supply pipes 42 and the joint portion 43. First, the configuration of the plurality of connection receiving units 50 will be described, and next, the supply pipes 42 and the joint portion 43 will be described. The fluctuation pressure generation unit 45 and the pressure transmission pipe 46 that constitute a mechanism for sucking and sending a liquid will then be described.

Connection Receiving Units

The liquid supply unit 40 is connected to the plurality of liquid containers 100 stored in the case storage unit 60 via the plurality of connection receiving units 50, respectively. As will be described later, the four liquid containers 100 for respective types of color ink are mounted to the liquid ejection apparatus 10 of this embodiment. Therefore, in this embodiment, the liquid supply unit 40 is provided with the four connection receiving units 50 so as to respectively correspond to the four liquid containers 100.

Three out of the four liquid containers 100 of this embodiment are first liquid containers 100*a* whose capacity for a liquid is the same, and the remaining one is a second liquid container 100*b* whose capacity for a liquid is larger than that of the first liquid containers 100*a* (FIGS. 2 and 3). Three out of the plurality of connection receiving units 50 are first connection receiving units 50*a* corresponding to the first liquid containers 100*a*, and the remaining one is a second connection receiving unit 50*b* corresponding to the second liquid container 100*b* (FIG. 4). The first connection receiving units 50*a* and the second connection receiving unit 50*b* are collectively referred to as the "connection receiving units 50", unless they need to be specifically distinguished apart from each other. Similarly, the first liquid container 100*a* and the second liquid container 100*b* are collectively referred to as the "liquid container 100", unless they need to be specifically distinguished apart from each other. Note that in this embodiment, there is hardly any substantial difference in the configuration for connection to the liquid container 100 between the first connection receiving unit 50*a* and the second connection receiving unit 50*b*.

The plurality of connection receiving units 50 are installed at the end portion on the +Y direction side of the case storage unit 60 (FIGS. 3 and 4). The connection receiving units 50 are arranged in a line in the X direction at the lowest level at the furthest position on the back side of the liquid ejection apparatus 10. Each of the connection receiving units 50 is installed so that a corresponding one of the liquid containers 100 can be connected thereto from the −Y direction side. The three first connection receiving units 50*a* are installed in parallel at a substantially equal interval from the right side. The second connection receiving unit 50*b* is installed on the leftmost side.

Figure 5:
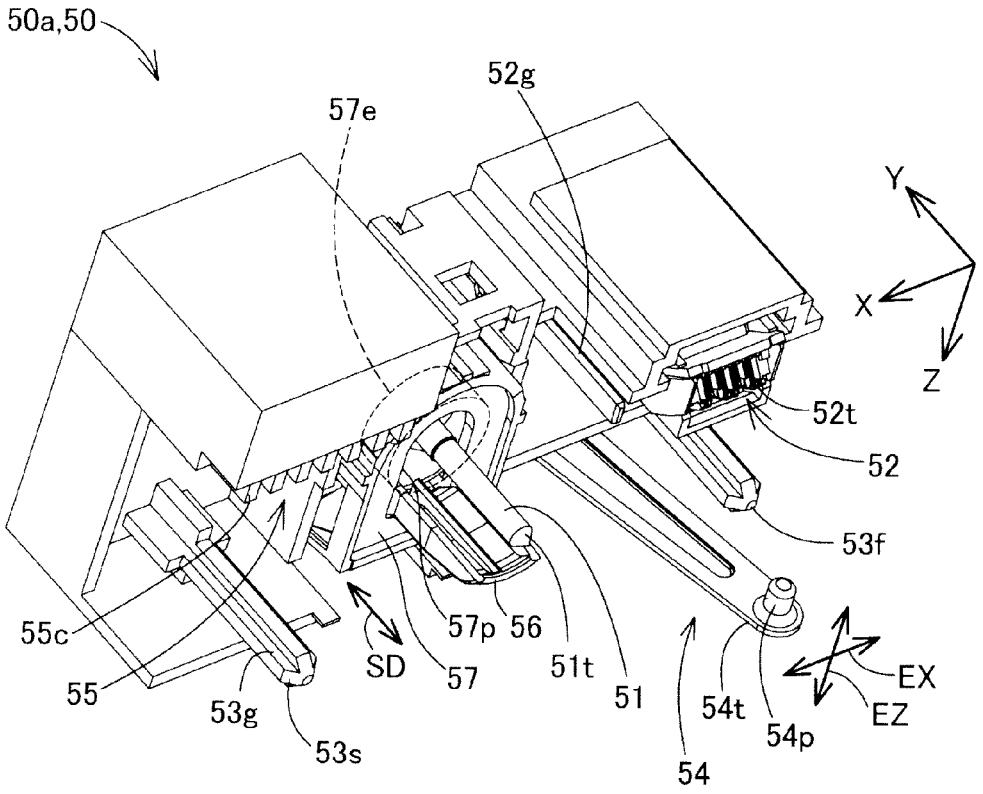
FIG. 5 is a schematic perspective diagram showing a connection receiving unit.

An overview of the configuration of each of the connection receiving units 50 will be described with reference to FIG. 5. FIG. 5 is a schematic perspective diagram showing a portion of the first connection receiving unit 50*a* among the plurality of connection receiving units 50. The following description is common to the first connection receiving unit 50*a* and the second connection receiving unit 50*b* unless specifically stated otherwise. The connection receiving unit 50 is configured as a constituent part obtained by integrating a liquid introducing portion 51, an apparatus-side electrical connection unit 52, a first positioning portion 53*f*, a second positioning portion 53*s*, an apparatus-side fixing structure 54, and a fitting structure 55.

Liquid from the liquid container 100 flows into the liquid introducing portion 51. In this embodiment, the liquid introducing portion 51 is positioned at the end portion on the +Y direction side of the case storage unit 60. The liquid introducing portion 51 is constituted by a tube portion that has a shape extending linearly in the −Y direction, and opens at a tip end portion 51*t* on the −Y direction side. The liquid introducing portion 51 is connected to the liquid container 100 by the tip end portion 51*t* being inserted into the liquid container 100. In this embodiment, the liquid introducing portion 51 protrudes in the −Y direction substantially at the center of the connection receiving unit 50 in the X direction.

The back end portion on the +Y direction side of the liquid introducing portion 51 communicates with a pump chamber (not illustrated) provided inside the connection receiving unit 50. A liquid that has flowed into the liquid introducing portion 51 flows into the pump chamber. Note that a check valve structure (not illustrated) for inhibiting liquid that has flowed into the pump chamber from flowing back to the liquid introducing portion 51 is provided in the connection receiving unit 50.

In the connection receiving unit 50 of this embodiment, a liquid receiving unit 56 is provided below the liquid introducing portion 51. The liquid receiving unit 56 extends along the liquid introducing portion 51 in the −Y direction. The liquid receiving unit 56 slightly curves downward following the shape of the lower side of the liquid introducing portion 51, and functions as a receiving saucer for receiving a liquid that has leaked from the connection section between the liquid introducing portion 51 and the liquid container 100. The liquid receiving unit 56 may be omitted.

A base end member 57 is provided at the back end portions on the +Y direction side of the liquid introducing portion 51 and the liquid receiving unit 56. The base end member 57 is a resin member having a through hole 57*p* into which the liquid introducing portion 51 is inserted. The base end member 57 is attached so as to be able to move in the Y direction. On the back side of the base end member 57, a helical spring, which is a biasing member 57*e*, is arranged so as to surround the liquid introducing portion 51, and provides the base end member 57 with an elastic force in the −Y direction. The biasing member 57*e* is hidden behind the base end member 57 and is not visible, and thus the arrangement position of the biasing member 57*e* is indicated by broken lines in FIG. 5. Due to the force provided by the biasing member 57*e*, the base end member 57 elastically moves in the Y direction as indicated by arrows SD. When the liquid container 100 is mounted to the liquid ejection apparatus 10, the force in the −Y direction is applied to the liquid container 100 and the case 61 by the base end member 57.

The apparatus-side electrical connection unit 52 is a connector that is electrically connected to the liquid container 100. The apparatus-side electrical connection unit 52 is positioned at the end on the +Y direction side of the case storage unit 60 (FIG. 3). The apparatus-side electrical connection unit 52 has a plurality of terminal portions 52*t* arranged in the X direction. The terminal portions 52*t* protrude from the surface of the apparatus-side electrical connection unit 52, and come into contact with and are electrically connected to container-side electrical connection unit (which will be described later) of the liquid container 100. The terminal portions 52*t* are desirably biased in the protruding direction by an elastic member such as a leaf spring. In this embodiment, the apparatus-side electrical connection unit 52 is arranged at an inclination angle corresponding to the arrangement angle of the container-side electrical connection unit of the liquid container 100. The apparatus-side electrical connection unit 52 is arranged so as to be directed obliquely upward such that the normal vector of the surface of the apparatus-side electrical connection unit 52 includes vector components in the −Y direction and vector components in the −Z direction.

The apparatus-side electrical connection unit 52 is connected to the control unit 20 (FIG. 2) via wiring (not illustrated). The wiring is constituted by a flexible flat cable, for example. Due to the apparatus-side electrical connection unit 52 and the container-side electrical connection unit being electrically connected, the control unit 20 exchanges electrical signals with the liquid container 100. Accordingly, the control unit 20 acquires information regarding the liquid stored in the liquid container 100. The information regarding the liquid is parameters indicating the color of the ink, the type of the ink, the amount of the liquid stored in the liquid container 100, and the like. In addition, the control unit 20 electrically detects the connection state of the liquid container 100.

Guiding projections 52*g* are provided on the two sides in the X direction of the apparatus-side electrical connection unit 52. For convenience, FIG. 5 only illustrates the guiding projection 52*g* in the +X direction side, and illustration of the guiding projection 52*g* on the −X direction side is omitted. For convenience, in FIG. 5, the guiding projections 52*g* protrude in the −Y direction, and function as positioning portions when a container-side electrical connection unit (which will be described later) of the liquid container 100 is connected to the apparatus-side electrical connection unit 52.

The first positioning portion 53*f* and the second positioning portion 53*s* protrude at positions separated from each other. In this embodiment, the first positioning portion 53*f* and the second positioning portion 53*s* are each configured as a shaft-like section extending in the −Y direction, and are arranged in parallel with the liquid introducing portion 51. The first positioning portion 53*f* is positioned on the −X direction side of the liquid introducing portion 51, and the second positioning portion 53*s* is positioned on the +X direction side of the liquid introducing portion 51. The first positioning portion 53*f* is positioned on the −X direction side relative to the apparatus-side electrical connection unit 52. In this embodiment, the positions of the tip end portions in the Y direction of the first positioning portion 53*f* and the second positioning portion 53*s* are substantially aligned. In addition, the first positioning portion 53*f* and the second positioning portion 53*s* are provided at substantially the same height position, and are provided at lower positions than the liquid introducing portion 51 and the apparatus-side electrical connection unit 52.

When the liquid container 100 is mounted, both the first positioning portion 53*f* and the second positioning portion 53*s* are inserted into corresponding receiving portions (which will be described later) provided in the liquid container 100. The first positioning portion 53*f* and the second positioning portion 53*s* have a function of defining the arrangement position in the X direction of the liquid container 100 and the arrangement angle in the horizontal direction when the liquid container 100 is mounted.

The first positioning portion 53*f* and the second positioning portion 53*s* desirably protrude further in the −Y direction than the tip end portion 51*t* of the liquid introducing portion 51. Accordingly, after defining the mounting orientation of the liquid container 100 using a pair of the positioning portions 53*f* and 53*s*, the liquid introducing portion 51 can be connected to a liquid introducing outlet (which will be described later) of the liquid container 100. It is desirable that the outer peripheral faces of the positioning portions 53*f* and 53*s* are respectively provided with groove portions 53*g* extending in the Y direction in parallel as illustrated. Accordingly, insertion into the receiving portion of the liquid container 100 is becomes smoother.

The apparatus-side fixing structure 54 restricts movement of the case 61 in the Y direction in cooperation with a case-side fixing structure (which will be described later) provided in the case 61 in which the liquid container 100 is arranged. In this embodiment, the apparatus-side fixing structure 54 is configured as an arm-like member portion so as to be able to enter the space under the liquid container 100 that is mounted, and extends in the −Y direction side. The apparatus-side fixing structure 54 is positioned on the −X direction side relative to the liquid introducing portion 51, and is positioned below the apparatus-side electrical connection unit 52.

A tip end portion 54*t* on the −Y direction side of the apparatus-side fixing structure 54 protrudes further in the −Y direction than the tip end portion 51*t* of the liquid introducing portion 51. Also, the tip end portion 54*t* protrudes further in the −Y direction than the tip end portions of the positioning portions 53*f* and 53*s*. The tip end portion 54*t* is provided with a protrusion 54*p*. The protrusion 54*p* protrudes at the center of the tip end portion 54*t* in the −Z direction. In a case-stored state in which the case 61 is mounted to the case storage unit 60, the protrusion 54*p* is engaged with an engagement portion provided on the case-side fixing structure. In the following description, the protrusion 54*p* may also be referred to as an "engaging portion 54*p*". By the protrusion 54*p* being engaged with the engagement portion provided on the case-side fixing structure, movement of the case 61 in the −Y direction is restricted.

The apparatus-side fixing structure 54 is attached in a state where pivot in the horizontal direction using the back end portion thereof on the +Y direction side as a fulcrum as indicated by a bidirectional arrow EX is allowed. The apparatus-side fixing structure 54 is biased in the +X direction by an elastic member (not illustrated) arranged in the connection receiving unit 50, and elastically pivots in −the X direction upon receiving an external force in the −X direction. Also, the apparatus-side fixing structure 54 is attached in a state where pivot in the height direction using the back end portion on the +Y direction side as a fulcrum as indicated by the bidirectional arrow EZ is allowed. The apparatus-side fixing structure 54 is biased in the −Z direction by an elastic member (not illustrated) arranged in the connection receiving unit 50, and elastically pivots in the +Z direction when receiving an external force in the +Z direction. The engaging mechanism of the apparatus-side fixing structure 54 and the case-side fixing structure of the case 61 will be described later.

The fitting structure 55 is provided on the +X direction side relative to the liquid introducing portion 51. The fitting structure 55 is positioned above the second positioning portion 53*s*, and has a projection-and-recess structure in which a plurality of substantially rectangular shaped protrusions 55*c* that protrude at the same height in the +Z direction and extend in the −Y direction in parallel are arranged. The arrangement pattern of the protrusions 55*c* in the projection-and-recess structure of the fitting structure 55 is different for each of the connection receiving units 50. The liquid container 100 to which each of the connection receiving units 50 corresponds to is provided with a fitting structure receiving unit (which will be described later) that has a fittable projection-and-recess structure corresponding to the arrangement pattern of the projection-and-recess structure of the connection receiving unit 50. This inhibits an incorrect and non-corresponding liquid container 100 from being connected to the connection receiving unit 50.

Supply Pipes and Joint Portion

The plurality of supply pipes 42 are each constituted by a flexible tube member made of resin (FIG. 4). The supply pipes 42 are respectively connected to the above-described pump chambers (not illustrated) provided inside the connection receiving units 50. The supply pipes 42 extend from the connection receiving units 50 above a region in which the liquid containers 100 are stored, are gathered at an end portion on the −X direction side, and are then drawn around in parallel in the −Y direction (FIGS. 3 and 4). The supply pipes 42 are then drawn around at the end portion on the front side of the liquid ejection apparatus 10 in the −Z direction, and are connected to the joint portion 43 installed at a higher position than the medium conveyance unit 35 (FIGS. 2 and 4). As described above, each of the supply pipes 42 is connected to a corresponding one of the plurality of tubes 32 of the ejection execution unit 30 via the joint portion 43.

Mechanism for Sucking and Sending Liquid in Liquid Supply Unit

The fluctuation pressure generation unit 45 is a generation source for generating pressure fluctuation for sucking and sending a liquid, and is constituted by a pump (FIGS. 2 and 3), for example. The fluctuation pressure generation unit 45 is installed above the case storage unit 60 at a position close to the front face portion 12 of the liquid ejection apparatus 10 (FIG. 2). The fluctuation pressure generation unit 45 is positioned on the mounting position of the first liquid container 100*a*. The pressure transmission pipe 46 is connected to the fluctuation pressure generation unit 45, and transmits pressure fluctuation generated by the fluctuation pressure generation unit 45 (FIGS. 3 and 4). The pressure transmission pipe 46 is connected to a pressure chamber (not illustrated) provided inside each of the connection receiving units 50.

The pressure chamber of the connection receiving unit 50 is adjacent to the above-described pump chamber into which a liquid flows from the liquid container 100, with a flexible film therebetween. Therefore, when the fluctuation pressure generation unit 45 lowers the pressure in the pressure chamber, the flexible film flexes on the pressure chamber side, the capacity of the pump chamber increases, and the liquid in the liquid container 100 is sucked into the pump chamber via the liquid introducing portion 51. On the other hand, when the fluctuation pressure generation unit 45 raises the pressure in the pressure chamber, the flexible film flexes on the pump chamber side, the capacity of the pump chamber decreases, and the liquid that has flowed into the pump chamber is pressed toward the supply pipe 42. In this manner, in the liquid supply unit 40, the fluctuation pressure generation unit 45 repeats increase and decrease of the pressure in the pressure chamber, thereby realizing the supply of liquid to the ejection execution unit 30.

Case Storage Unit

In the liquid ejection apparatus 10 of this embodiment, the case storage unit 60 is provided at the lowest level (FIGS. 2 and 3). A plurality of cases 61 are stored in the case storage unit 60. In the above-described case-stored state, the plurality of cases 61 are arranged in the X direction in a line in the case storage unit 60. The plurality of liquid containers 100 are respectively arranged in the plurality of cases 61. The liquid containers 100 are arranged in the cases 61 in one-to-one correspondence. Accordingly, in a state of being arranged in the cases 61, the plurality of liquid containers 100 are stored in the case storage unit 60 so as to be arranged in a line in the X direction. In FIG. 2, the liquid containers 100 are hidden by the cases 61 and are not visible, and thus the arrangement positions of the liquid containers 100 are indicated by reference numbers with broken lines. In addition, in FIG. 3, the arrangement regions LA that are the arrangement positions when mounting the cases 61 and the liquid containers 100 to the case storage unit 60 are indicated by dashed-dotted lines.

In the case storage unit 60, the second liquid container 100*b* is stored at the end on the +X direction side, and the three first liquid containers 100*a* are stored on the −X direction side (FIG. 2). On the +Y direction side of the arrangement region LA of each of the liquid containers 100, a corresponding one of the connection receiving units 50 is installed (FIG. 3). As described above, in this embodiment, ink of different colors is stored in the liquid containers 100. Combination of color ink stored in the liquid containers 100 is not particularly limited. For example, a configuration may be adopted in which the three first liquid containers 100*a* respectively store cyan, magenta and yellow, and the second liquid container 100*b* stores black whose consumption amount is expected be largest. Note that at least one or all of the liquid containers 100 may store the same ink.

The plurality of cases 61 are used for mounting the liquid containers 100. In this embodiment, each case 61 is configured as a tray-like container. The cases 61 can be mounted to/removed from the liquid ejection apparatus 10 by being moved in the Y direction in the case storage unit 60. Even in an empty state in which the liquid container 100 is not arranged, each case 61 can be set in the case storage unit 60. Note that mounting/removing of the cases 61 and the liquid container 100 to/from the liquid ejection apparatus 10 will be described in detail later.

The liquid container 100 is arranged detachably on the −Z direction side of a case 61 pulled out from the case storage unit 60. In a state of being arranged in the case 61, the liquid container 100 is mounted to the liquid ejection apparatus 10. In other words, in a state of being arranged in the case 61, the liquid container 100 is mounted to the case storage unit 60 of the liquid ejection apparatus 10. In addition, in a state of being arranged in the case 61, the liquid container 100 is removed from the case storage unit 60. Note that the cases 61 include a first case 61*a* in which the first liquid container 100*a* is arranged and a second case 61*b* in which the second liquid container 100*b* is arranged. The first case 61*a* and the second case 61*b* are collectively referred to as the "case 61", unless they need to be specifically distinguished apart from each other. The configuration of the case 61 will be described later in detail.

In this specification, the first liquid container 100*a* appropriately arranged in the first case 61*a* is also referred to as a "first mounting body 105*a*". Similarly, the second liquid container 100*b* appropriately arranged in the second case 61*b* is referred to as a "second mounting body 105*b*". The first mounting body 105*a* and the second mounting body 105*b* are collectively called a "mounting body 105", unless they need to be specifically distinguished apart from each other.

The opening member 62 is arranged at the entrance of the case storage unit 60 (FIGS. 2 and 4). The opening member 62 is a plate-shaped member having a substantially rectangular shape, and is provided with four through ports 63 passing therethrough in the thickness direction. In a state where the thickness direction of the opening member 62 coincides with the Y direction, and the longitudinal direction coincides with the X direction, the opening member 62 is installed at the end portion on the −Y direction side of the case storage unit 60 in a fixed manner. Each of the through ports 63 is an insertion port into which the case 61 is inserted. The through port 63 has an opening shape corresponding to the outer peripheral outline of the corresponding case 61 when viewed in the Y direction. The opening member 62 guides insertion and pulling out of the case 61 into/from the liquid ejection apparatus 10. In addition, the user is inhibited from inserting the first case 61*a* and the second case 61*b* into the wrong place. A plurality of recessed portions 63*r* sunken in the +Z direction are provided at the lower end of each of the through ports 63. The recessed portions 63*r* are provided in correspondence with rail ribs 230 (which will be described later) provided at the lower face of the case 61 corresponding to the through port 63, allow insertion of the rail ribs 230 into the case storage unit 60, and guide movement of the rail ribs 230. Note that the opening member 62 may be omitted.

Figure 6:
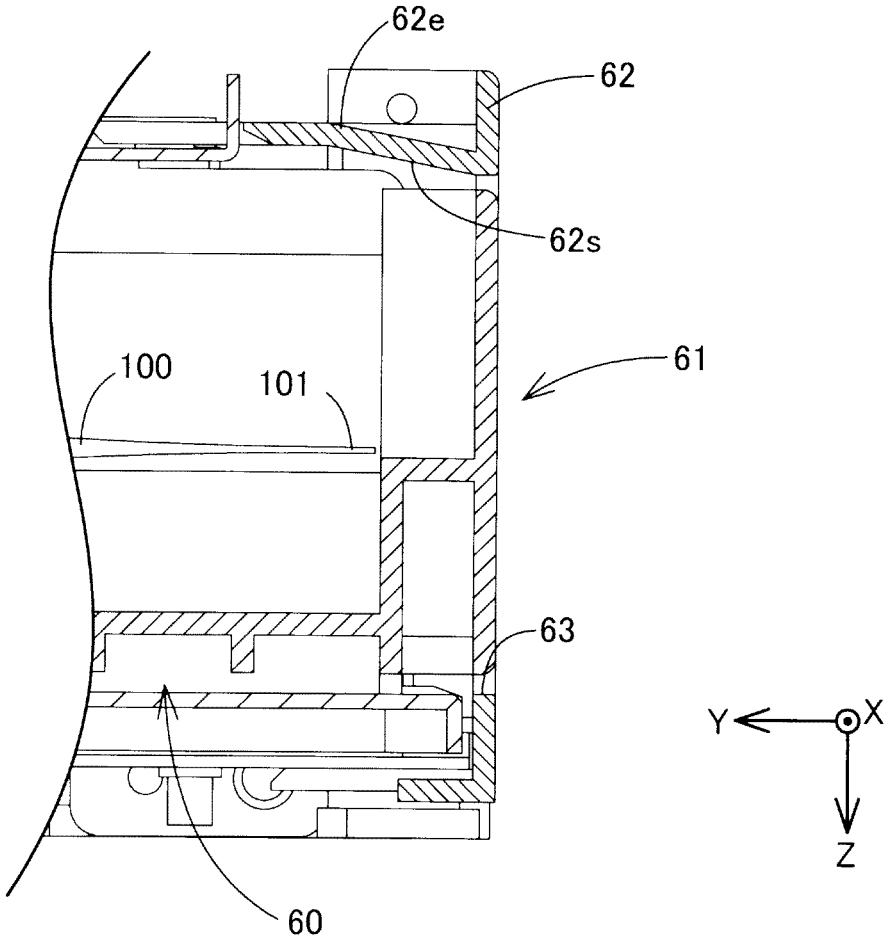
FIG. 6 is a schematic cross-sectional diagram of a case storage unit at an inlet thereof.

FIG. 6 is a schematic cross-sectional diagram of the case storage unit 60 in a 6-6 cross-section shown in FIG. 2 at the inlet thereof. The opening member 62 has, at the upper end of the through port 63, a ceiling wall portion 62*e* that protrudes in the +Y direction in an eave-like shape (FIGS. 4 and 6). The ceiling wall portion 62*e* has an inclined wall face 62*s* that is directed in the +Z direction, and that is inclined upward from the −Y direction side toward the +Y direction side. Even when the liquid in the liquid container 100 is consumed, and an end portion 101 on the −Y direction side of a bag-shaped member (which will be described later) in the liquid container 100 shifts upward in the case 61, the end portion 101 is guided by the inclined wall face 62*s* when the case 61 is pulled out. Therefore, pulling out of the case 61 from the case storage unit 60 becomes smoother.

A plurality of rail grooves 64 are formed on the floor face of the case storage unit 60 (FIG. 3). The rail grooves 64 are linearly formed over the entire region in the Y direction of the case storage unit 60, for the arrangement region LA of the liquid container 100. Rail ribs (which will be described later) provided on the lower face of the case 61 are fitted in the rail grooves 64. Movement in the Y direction of the case 61 in the liquid ejection apparatus 10 is guided by the rail grooves 64, and the cases 61 adjacent in the X direction are inhibited from coming in contact with each other. In addition, connection of the liquid container 100 to the connection receiving unit 50 is simplified. Note that the configuration of the rail groove 64 and the rail rib corresponding thereto may be different for each of the cases 61 in order to prevent a mounting error. In addition, at least one or all of the rail grooves 64 may be omitted.

A plurality of rollers 65 are installed on the floor face of the case storage unit 60 (FIG. 3). The rollers 65 are arranged in the Y direction in a dispersed manner as appropriate for the arrangement regions LA of the liquid containers 100. In the case storage unit 60, pivot of the rollers 65 reduces movement resistance when moving the case 61 in the Y direction, and makes the operation of moving the case 61 performed by the user smoother. The rollers 65 may be omitted.

Configuration of Liquid Container and Case

The configuration of the first liquid container 100*a* and the first case 61*a* that constitute the first mounting body 105*a* will be described with reference to FIGS. 7 to 16 as appropriate. After that, the configuration of the second liquid container 100*b* and the second case 61*b* that constitute the second mounting body 105*b* will be described with reference to FIGS. 17 to 24.

First Mounting Body, First Liquid Container, and First Case

Figure 7:
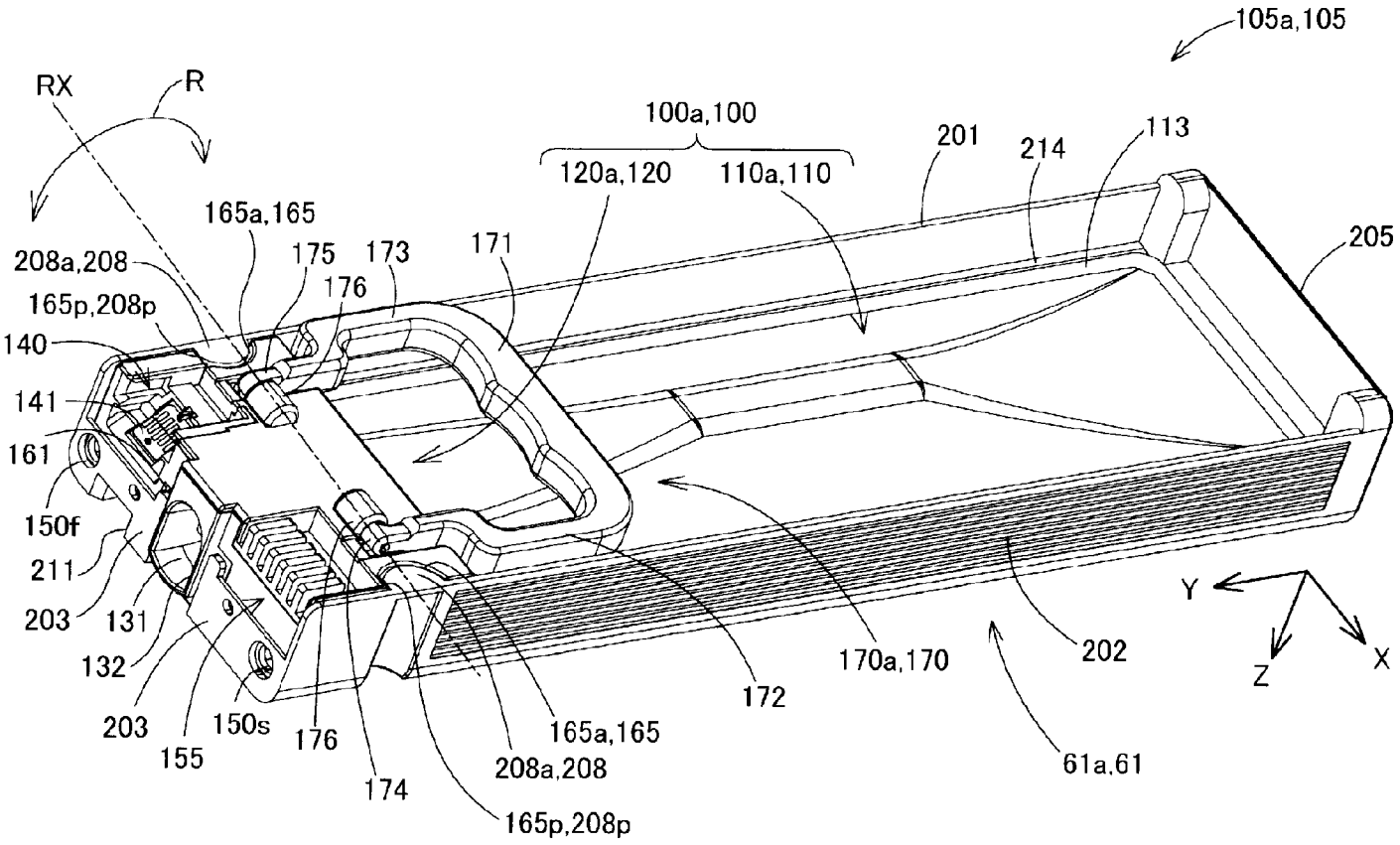
FIG. 7 is a schematic perspective diagram of a first mounting body when viewed from above.
Figure 8:
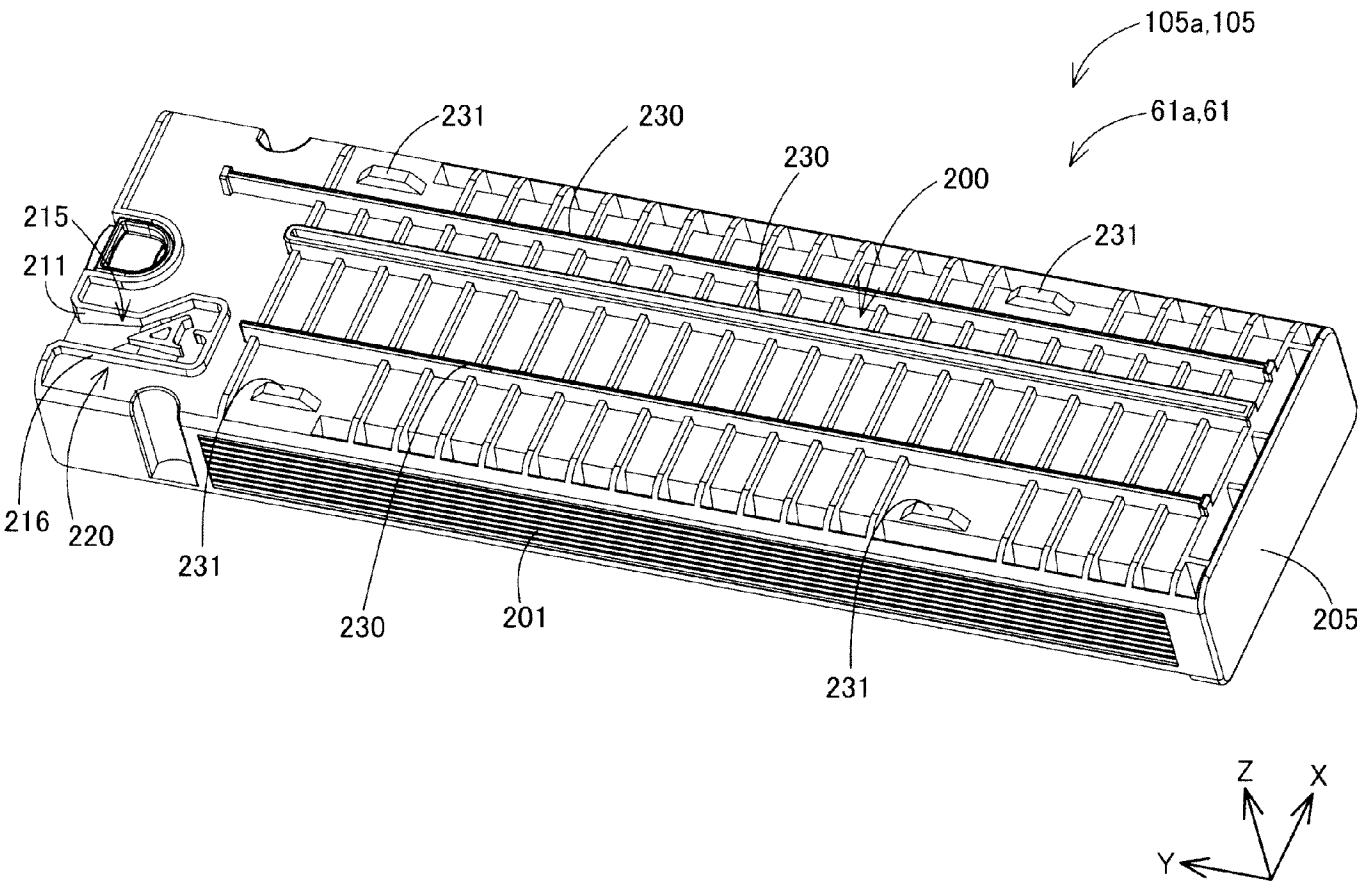
FIG. 8 is a schematic perspective diagram of the first mounting body when viewed from below.
Figure 9:
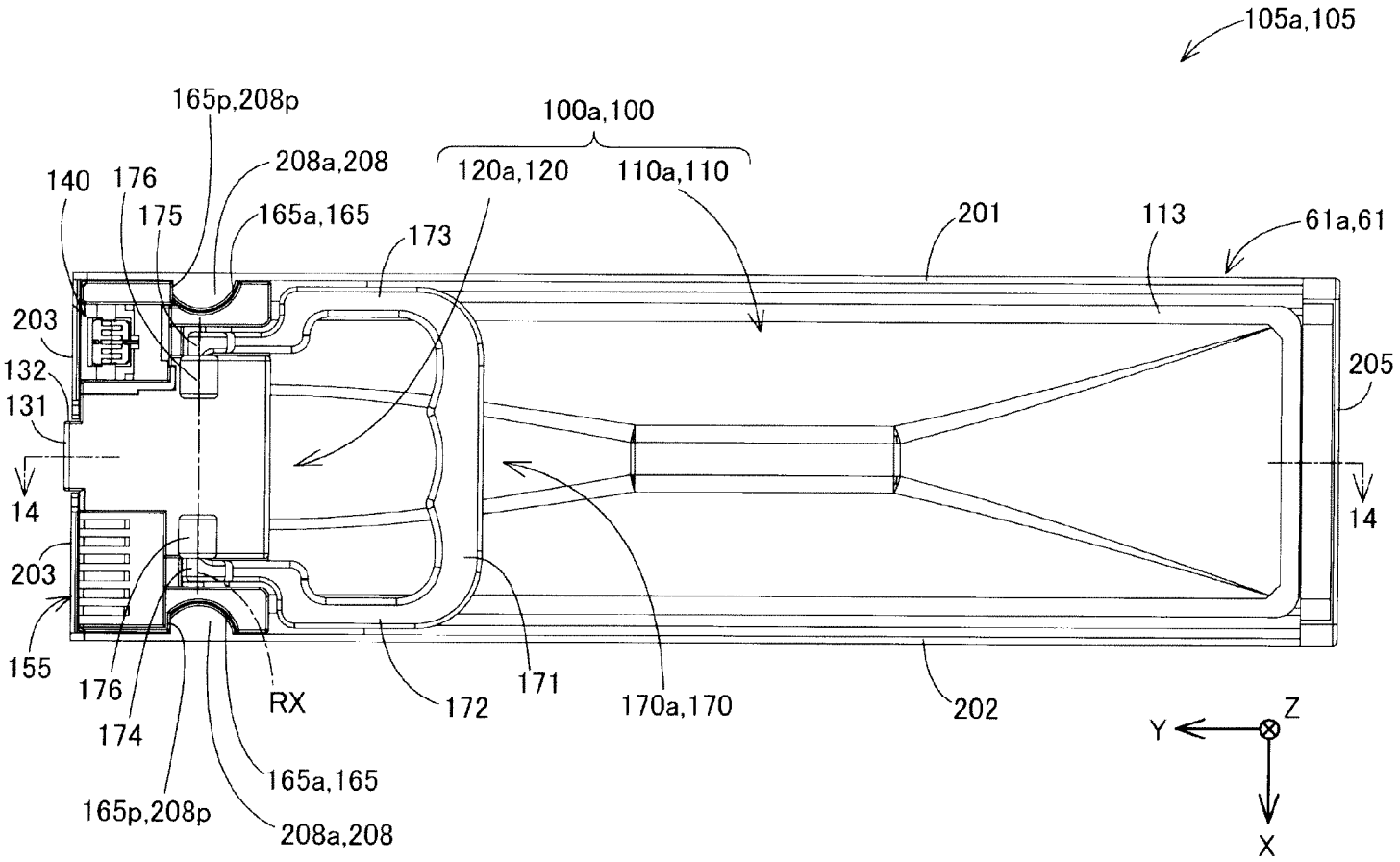
FIG. 9 is a schematic diagram showing the upper face side of the first mounting body.
Figure 10:
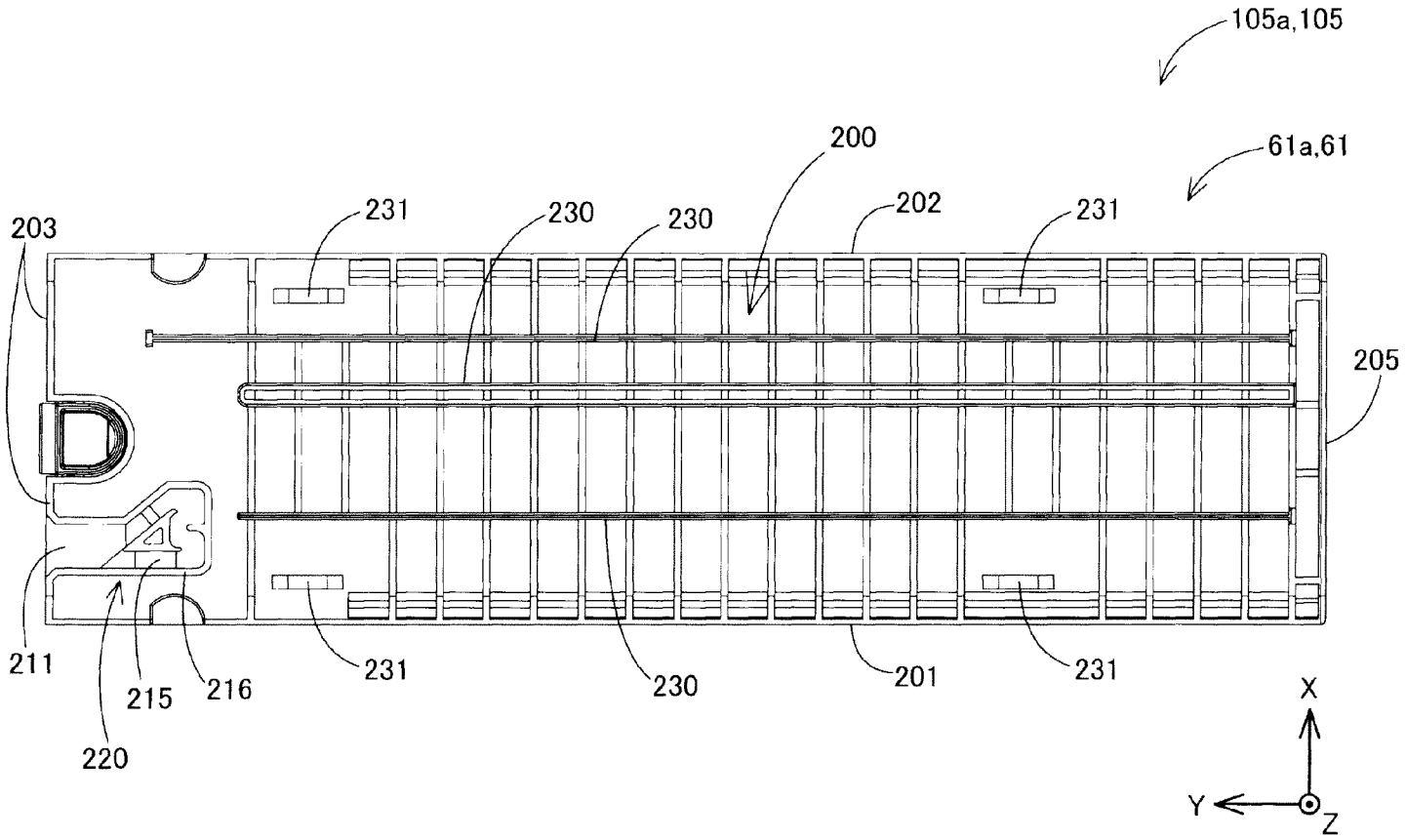
FIG. 10 is a schematic diagram showing the lower face side of the first mounting body.
Figure 11:
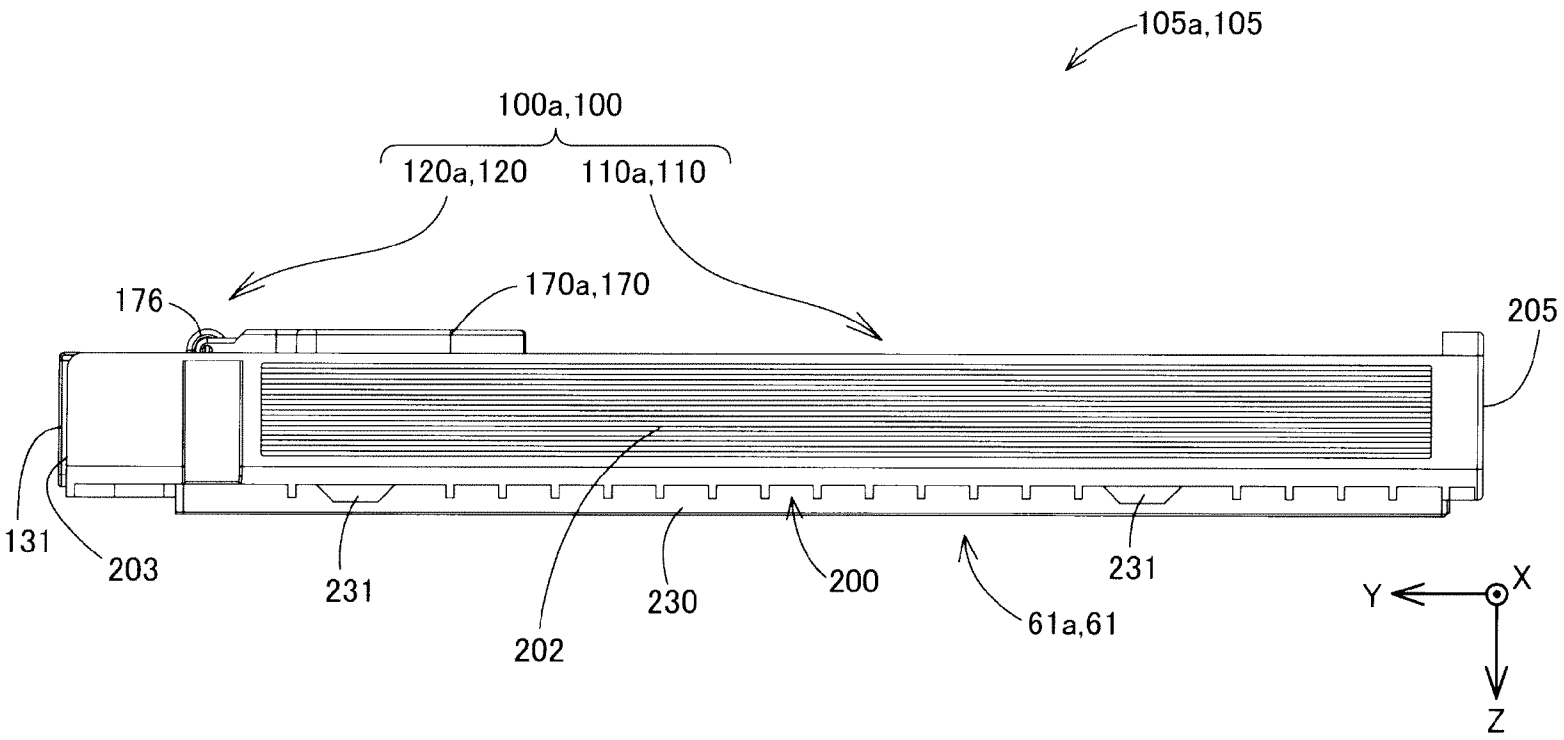
FIG. 11 is a schematic diagram showing the left face side of the first mounting body.
Figure 12:
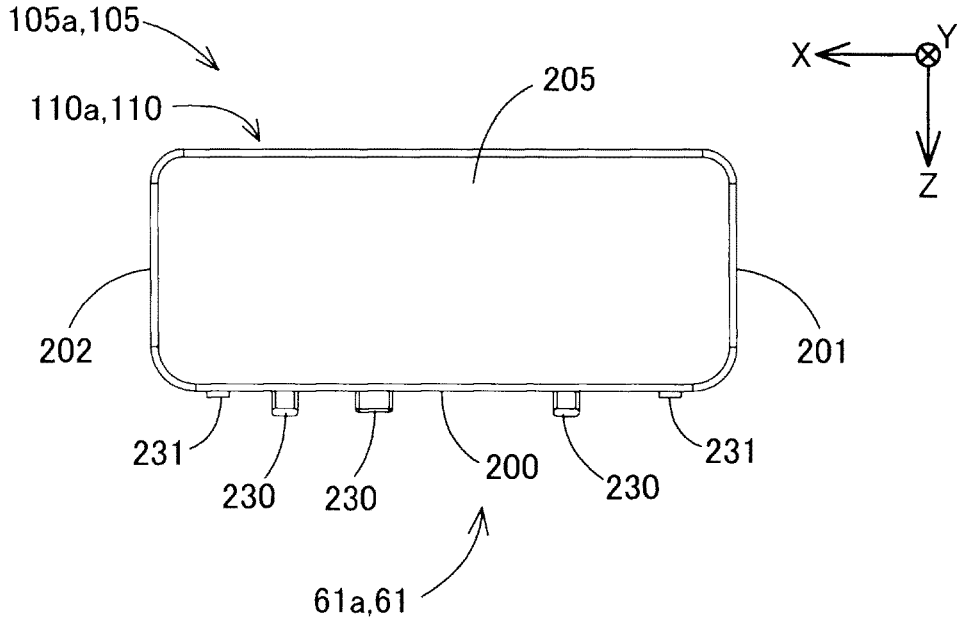
FIG. 12 is a schematic diagram showing the front face side of the first mounting body.
Figure 13:
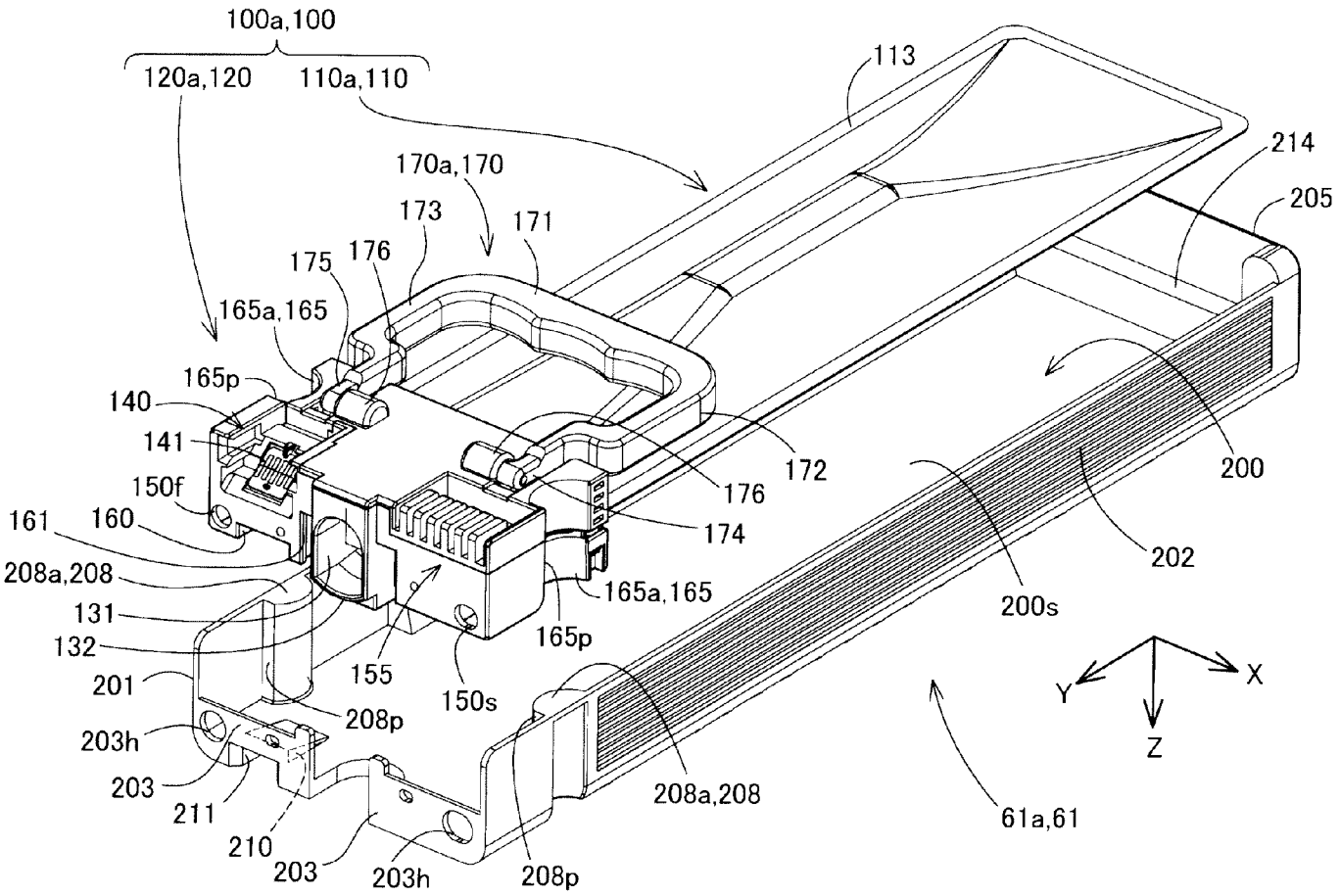
FIG. 13 is a schematic exploded perspective diagram separately showing a first case and a first liquid container.
Figure 14:
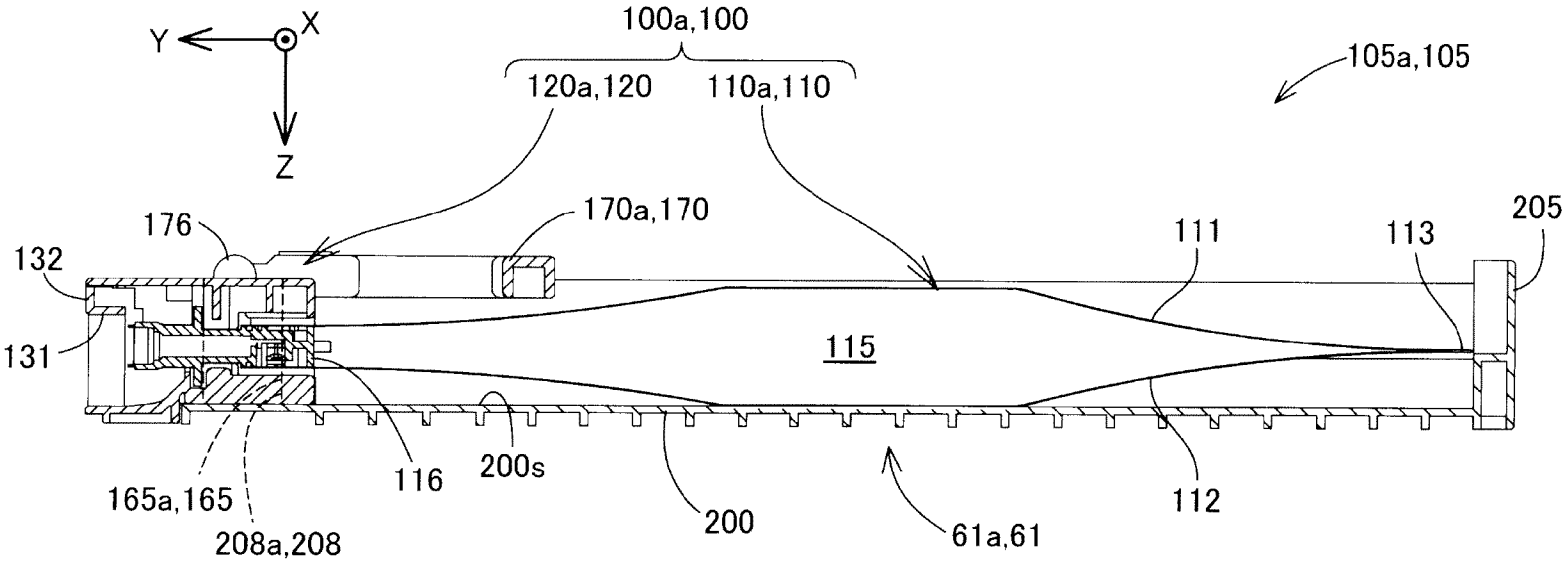
FIG. 14 is a schematic cross-sectional diagram of the first mounting body.
Figure 15:
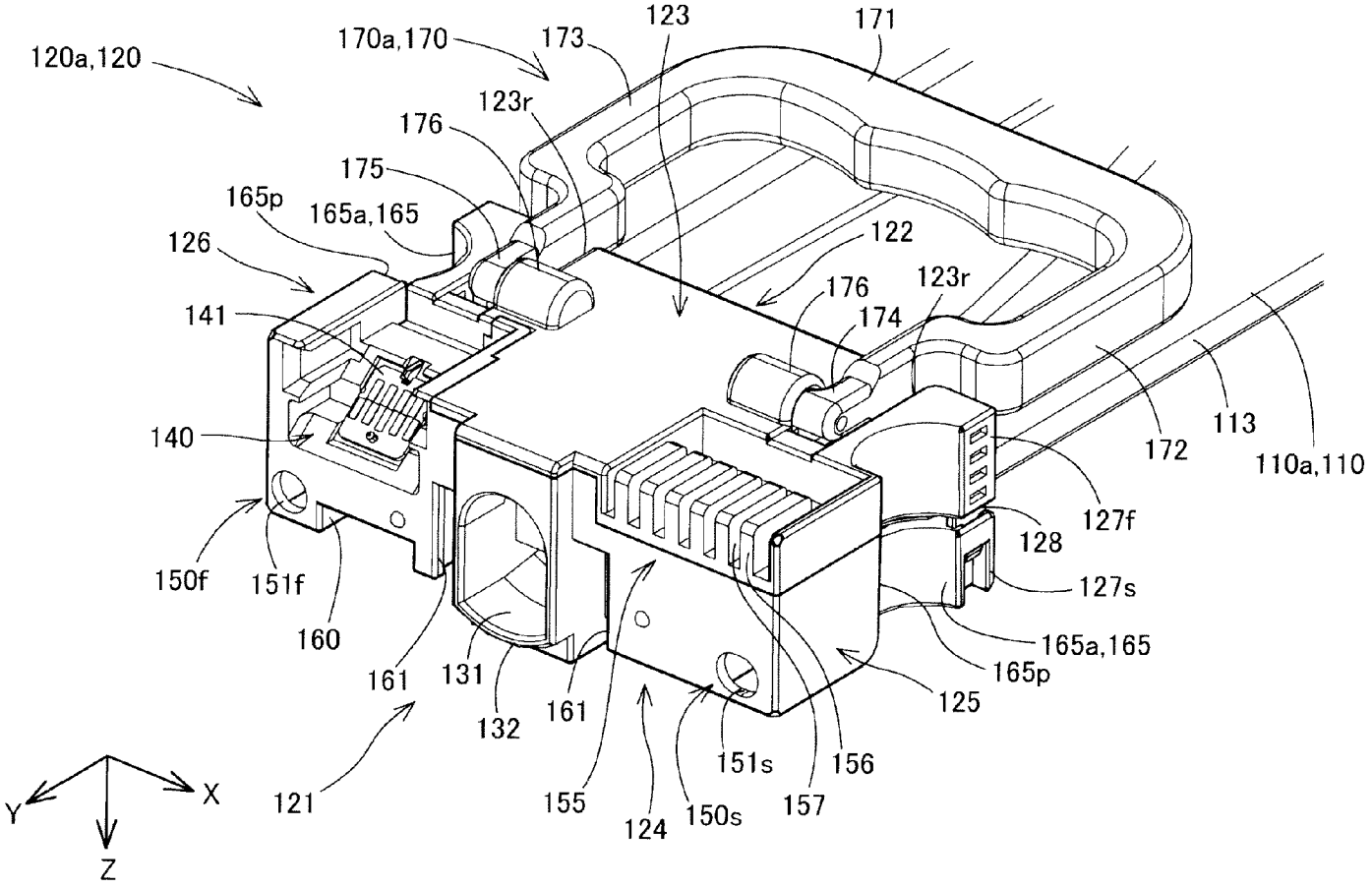
FIG. 15 is a schematic perspective diagram showing the vicinity of a connection member among others.
Figure 16:
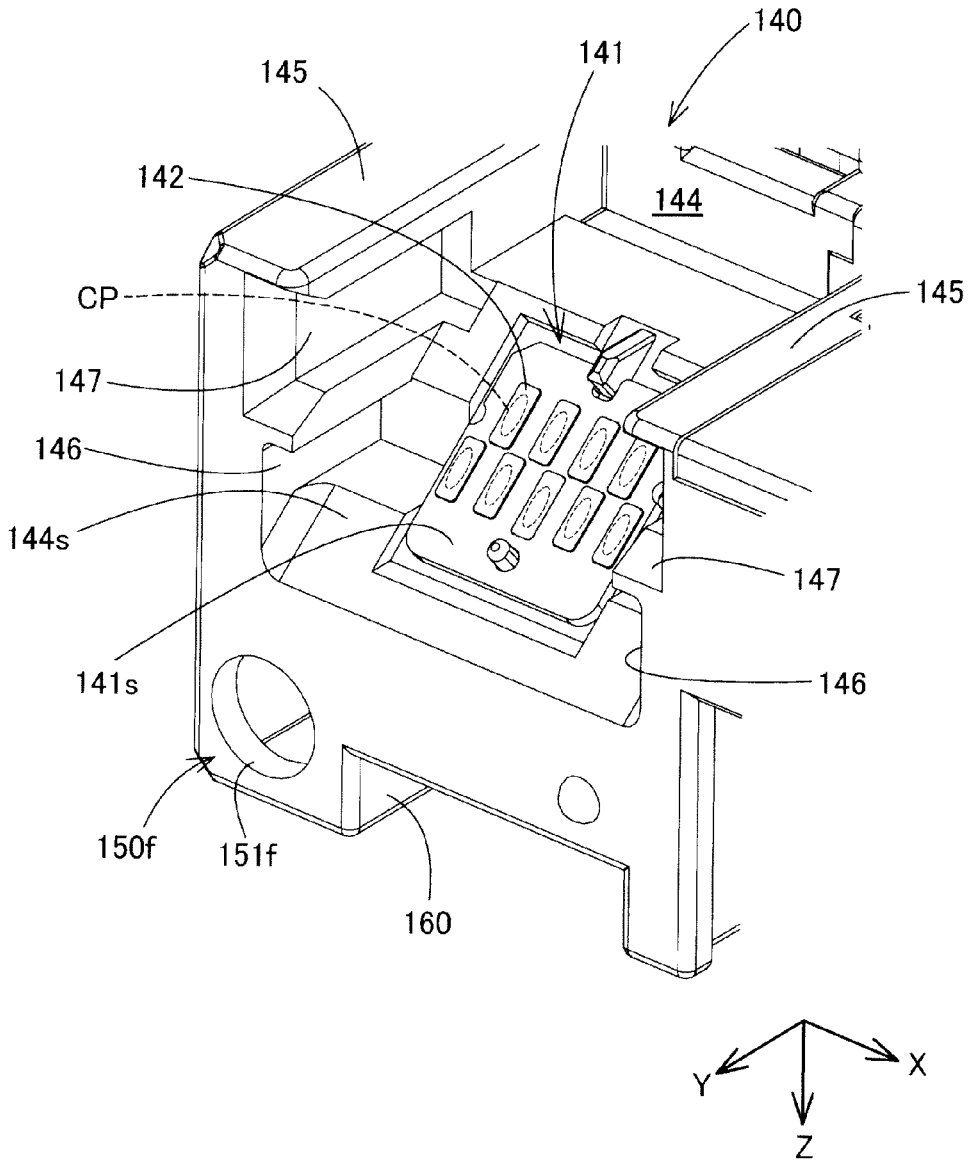
FIG. 16 is a schematic perspective diagram showing the vicinity of a container-side electrical connection unit among others.

FIGS. 7 to 16 are referred to. FIG. 7 is a schematic perspective diagram of the first mounting body 105*a* when viewed from above. FIG. 8 is a schematic perspective diagram of the first mounting body 105*a* when viewed from below. FIG. 9 is a schematic diagram of the first mounting body 105*a* when faced and viewed in the +Z direction, and shows the upper face side of the first mounting body 105*a*. FIG. 10 is a schematic diagram of the first mounting body 105*a* when faced and viewed in the −Z direction, and shows the lower face side of the first mounting body 105*a*. FIG. 11 is a schematic diagram of the first mounting body 105*a* when faced and viewed in the −X direction, and shows the left face side of the first mounting body 105*a*. The right face side of the first mounting body 105*a* is substantially similar to the left face side of the first mounting body 105*a*. FIG. 12 is a schematic diagram of the first mounting body 105*a* when viewed in the +Y direction, and shows the front face side of the first mounting body 105*a* (in other words, the back end side in the mounting direction of the first mounting body 105*a* to the liquid ejection apparatus 10). FIG. 13 is a schematic exploded perspective diagram showing a state in which the first liquid container 100*a* is removed from the first case 61*a*, the state being viewed from above. FIG. 14 is a schematic cross-sectional diagram of the first mounting body 105*a* in a 14-14 cross section shown in FIG. 9. FIG. 15 is a schematic perspective diagram of the vicinity of a connection member 120*a* when viewed from above. FIG. 16 is a schematic perspective diagram showing the vicinity of a container-side electrical connection unit 140 extracted from FIG. 15. In the following, first, an overview of the configuration of the first liquid container 100*a* will be described, and an overview of the configuration of the first case 61*a* will be described.

First Liquid Container

The first liquid container 100*a* is an ink pack, and is provided with a bag-shaped member 110*a* and a connection member 120*a* (FIG. 7). The external outline of the first liquid container 100*a* is substantially rectangular in which the Y direction is assumed to be a longitudinal direction when viewed in the Z direction (FIG. 9). The connection member 120*a* constitutes an end portion section on the +Y direction side of the first liquid container 100*a*, and the bag-shaped member 110*a* is positioned on the −Y direction side relative to the connection member 120*a*.

The width in the Z direction of the first liquid container 100*a* is smaller than the width in the X direction and the width in the Y direction (FIGS. 13 and 14). This "width" refers to a distance in a direction between sections positioned outermost of the first liquid container 100*a* in the corresponding direction. Accordingly, the first liquid container 100*a* has a thin flat plate-like shape. Therefore, according to the first liquid container 100*a*, high stability can be achieved regarding the arrangement orientation on the first case 61*a* (FIGS. 7 and 14).

Bag-Shaped Member

The bag-shaped member 110*a* is a container in which a storage portion 115 that stores a liquid is formed (FIGS. 7, 13 and 14). The bag-shaped member 110*a* is flexible. The flexibility of the bag-shaped member 110*a* may be set to a degree to which the bag-shaped member 110*a* flexes under its own weight, or a degree to which the bag-shaped member 110*a* maintains its shape against its own weight, and flexes when a load that is larger than its own weight is applied. When viewed in the Z direction, the bag-shaped member 110*a* has a substantially rectangular shape in which the Y direction is assumed to be a longitudinal direction (FIG. 9). The bag-shaped member 110*a* is formed by overlapping two sheet members 111 and 112, and welding an outer peripheral end portion 113 of the two sheet members 111 and 112. Note that, when viewed in the Z direction, the storage portion 115 inside the bag-shaped member 110*a* has a substantially rectangular shape in which the Y direction is assumed to be a longitudinal direction, similar to that of the bag-shaped member 110*a* (not illustrated).

The first sheet member 111 is arranged on the −Z direction side, and constitutes the upper face of the bag-shaped member 110*a* (FIG. 14). The second sheet member 112 is arranged on the +Z direction side, and constitutes the lower face of the bag-shaped member 110*a*. The sheet members 111 and 112 have a rectangular shape of the same size (FIGS. 9 and 13). The sheet members 111 and 112 do not need to have a perfectly flat shape. The sheet members 111 and 112 are desirably formed in a flexed shape so as to gradually swell toward the center in the bag-shaped member 110*a* (FIG. 14).

The sheet members 111 and 112 are formed of a material that has flexibility, gas barrier properties, and liquid impermeability. For example, the sheet members 111 and 112 may be each constituted by a film member of polyethylene terephthalate (PET), nylon, polyethylene, or the like. The sheet members 111 and 112 may be each constituted by laminating a plurality of films formed of the above material. In this case, for example, a configuration may be adopted in which the outer layer is formed of a PET or nylon film that has excellent shock resistance, and the inner layer is formed of a polyethylene film that has excellent ink resistance. Furthermore, a layer on which aluminum or the like is vapor-deposited may be added to the layered structure.

A supply port member 116 is attached to the end portion on the +Y direction side of the bag-shaped member 110 (FIG. 14). The supply port member 116 will be described later. A frame member for holding the shape of the storage portion 115, a tubular member for guiding the liquid in the storage portion 115 to outside of the bag-shaped member 110*a*, and the like are stored in the bag-shaped member 110*a*. In FIG. 14, the internal structure of the bag-shaped member 110*a* is not illustrated.

Connection Member

The connection member 120*a* is attached to the end portion on the +Y direction side of the bag-shaped member 110*a* (FIGS. 7, 9, 13 and 14). The connection member 120*a* is fixed to the end portion on the front end side in the mounting direction of the first mounting body 105*a*. The connection member 120*a* has a function of connecting to the corresponding first connection receiving unit 50*a* and a function of fixing the first liquid container 100*a* to the first case 61*a*.

First, an overview of the appearance of the connection member 120*a* will be described. The connection member 120*a* generally has a substantially rectangular parallelepiped shape in which the X direction is assumed to be a longitudinal direction (FIGS. 13 and 15). The width in the X direction of the connection member 120*a* is slightly larger than the width in the X direction of the bag-shaped member 110*a* (FIG. 9). The difference may be approximately several mm to a dozen mm, for example. The main body portion of the connection member 120*a* is manufactured by molding a resin member of polypropylene or the like.

The connection member 120*a* has a first face portion 121, a second face portion 122, a third face portion 123, a fourth face portion 124, a fifth face portion 125, and a sixth face portion 126 (FIG. 15). In this specification, the "face portion" does not need to be configured in a planar shape, and may be configured as a curved face shape, and may have a recessed portion, a projection portion, a step, a groove, a bent portion, an inclined face, and the like. In addition, two face portions "intersecting" refers to a state where the two face portions actually intersect each other, a state where an extending face of one of the face portions intersects the other face portion, or a state where the extending faces of the two face portions intersect each other. Between adjacent face portions, a curved face for smoothly connecting the face portions and a face obliquely intersecting the face portions may exist.

The first face portion 121 is directed in the +Y direction, and constitutes the front end face in the mounting direction of the first liquid container 100*a*. As will be described later, on the first face portion 121 side of the connection member 120*a*, constituent elements for connecting the first connection receiving unit 50*a* are gathered. The second face portion 122 is at a position opposing the first face portion 121, and is directed in the −Y direction. The second face portion 122 constitutes the back end face in the mounting direction of the first liquid container 100*a*. The above-described bag-shaped member 110*a* is fixed to the second face portion 122. The third face portion 123 intersects the first face portion 121 and the second face portion 122, and is directed in the −Z direction. The third face portion 123 constitutes the upper face portion of the connection member 120*a*. A handle 170*a* for improving the handleability of the first liquid container 100*a* is attached to the third face portion 123. The handle 170*a* will be described later.

The fourth face portion 124 is at a position opposing the third face portion 123, and intersects the first face portion 121 and the second face portion 122. The fourth face portion 124 is a face portion on the +Z direction side, is directed in the +Z direction, and constitutes the bottom face portion of the connection member 120*a*. The fifth face portion 125 intersects the first face portion 121, the second face portion 122, the third face portion 123, and the fourth face portion 124. The fifth face portion 125 is directed in the +X direction, and constitutes the left-side face portion of the connection member 120*a*. The sixth face portion 126 is at a position opposing the fifth face portion 125, and intersects the first face portion 121, the second face portion 122, the third face portion 123, and the fourth face portion 124. The sixth face portion 126 is directed in the −X direction, and constitutes the right-side face portion of the connection member 120*a*.

The connection member 120*a* has a first member 127*f* and a second member 127*s* overlapping in the Z direction (FIG. 15). A slit 128 is formed in the connection member 120*a*. The end portion on the +Y direction side of the bag-shaped member 110*a* is inserted into the slit 128 formed in the second face portion 122. The bag-shaped member 110*a* is fixed to the connection member 120*a* in a state where the end portion in the +Y direction side of the bag-shaped member 110*a* is sandwiched between the first member 127*f* and the second member 127*s* in the Z direction. A fixing structure of the bag-shaped member 110*a* in the connection member 120*a* will be described in detail later.

The connection member 120*a* is provided with a liquid introducing outlet 131, the container-side electrical connection unit 140, a first receiving portion 150*f*, a second receiving portion 150*s*, and a fitting structure receiving portion 155, as constituent elements for connecting to the first connection receiving unit 50*a* (FIGS. 7, 13 and 15). In the connection member 120*a*, these constituent elements are gathered on the first face portion 121 side. After describing these constituent elements in order, other constituent elements provided on the connection member 120*a* will be described below.

Liquid Introducing Outlet

The liquid introducing outlet 131 is an opening portion that is open in the +Y direction (FIG. 15). Accordingly, the central axis of the liquid introducing outlet 131 is parallel to the Y direction. The liquid introducing portion 51 (FIG. 5) of the first connection receiving unit 50*a* is inserted into the liquid introducing outlet 131 in the +Y direction. The liquid introducing outlet 131 is provided at the substantially central position in the X direction of the first face portion 121. The liquid introducing outlet 131 is formed at a height position that is substantially similar to a height position at which the bag-shaped member 110*a* is fixed.

The liquid introducing outlet 131 communicates with the storage portion 115 that is a liquid storage region inside the bag-shaped member 110*a*. The liquid introducing outlet 131 communicates with the storage portion 115 via the supply port member 116 (FIG. 14) attached to the end portion on the +Y direction side of the bag-shaped member 110*a* and a tubular member 300 (illustrated in FIG. 32 that will be referred to later) connected to the supply port member 116. Detailed description of the configuration of a liquid flow path in the first liquid container 100*a* is omitted. Note that a valve structure or a sealing structure that maintains a closed state before the liquid introducing portion 51 is inserted into the liquid introducing outlet 131, and that opens when the liquid introducing portion 51 is inserted is provided inside the connection member 120*a* in order to prevent leakage of the liquid (not illustrated).

In this embodiment, in the first face portion 121, the entirety of a peripheral edge portion 132 of the liquid introducing outlet 131 is recessed in the −Y direction, and the liquid introducing outlet 131 opens at a position on the −Y direction side, the position being further on the −Y direction side than the position of the peripheral edge portion 132. Accordingly, the liquid introducing outlet 131 is surrounded by a wall portion formed by the peripheral edge portion 132, and the protection performance of the liquid introducing outlet 131 is improved, and for example, the user is inhibited from accidentally touching the liquid introducing outlet 131. In addition, for example, when the first liquid container 100*a* is dropped accidentally, deterioration such as damage and deformation due to collision of the liquid introducing outlet 131 is suppressed. A peripheral edge rib that is provided so as to surround the liquid introducing outlet 131 and protruding in the +Y direction may be formed on the peripheral edge portion 132.

When the liquid introducing portion 51 of the first connection receiving unit 50*a* is connected to the liquid introducing outlet 131, the peripheral edge portion 132 comes into contact with and is pressed by the base end member 57 (FIG. 5) provided in the periphery of the liquid introducing portion 51, and receives an elastic force in the −Y direction. Note that in a mounted state in which the first liquid container 100*a* is mounted to the liquid ejection apparatus 10, the first case 61*a* in which the first liquid container 100*a* is arranged is engaged with the first connection receiving unit 50*a* (to be described later). Therefore, even if the peripheral edge portion 132 is biased in the −Y direction by the base end member 57, the first liquid container 100*a* and the first case 61*a* are inhibited from moving from the arrangement region LA in the −Y direction.

Container-Side Electrical Connection Portion

The container-side electrical connection unit 140 is provided with a substrate portion 141 for connection to the apparatus-side electrical connection unit 52 (FIGS. 7, 15 and 16). The container-side electrical connection unit 140 comes into electrical contact with the apparatus-side electrical connection unit 52 of the first connection receiving unit 50*a* (FIG. 5). A plurality of terminals 142 are arranged on a surface 141*s* of the substrate portion 141 (FIG. 16). The plurality of terminals 142 are arranged at positions corresponding to the terminal portions 52*t* of the apparatus-side electrical connection unit 52. On the opposite face to the surface of 141*s* of the substrate portion 141, a storage apparatus for storing information regarding liquid, a circuit for detecting connection of the apparatus-side electrical connection unit 52 and the like may be provided (illustration and detailed description are omitted).

In this embodiment, each of the terminals 142 has a substantially flat contact face with which the terminal portion 52*t* of the apparatus-side electrical connection unit 52 comes into contact. In FIG. 16, in the terminals 142, the positions of contact sections CP with which the terminal portions 52*t* of the apparatus-side electrical connection unit 52 come into contact are indicated by broken lines. The contact sections CP of the terminals 142 are arranged in an upper row and a lower row on the surface of 141*s* of the substrate portion 141 in an arrangement direction parallel to the X direction. Note that the arrangement pattern of the terminals 142 and the contact sections CP is not limited to the arrangement pattern illustrated in FIG. 16.

In this embodiment, the container-side electrical connection unit 140 is provided at a position close to the end portion on the −X direction side of the connection member 120*a*, and the container-side electrical connection unit 140 is positioned on the −X direction side relative to the liquid introducing outlet 131 (FIGS. 9 and 15). On the connection member 120*a*, a substrate arrangement portion 144 for arranging the substrate portion 141 of the container-side electrical connection unit 140 is formed as a recessed portion sunken in the −Y direction and the +Z direction (FIG. 16). On the substrate arrangement portion 144, an inclined face 144*s* directed in an obliquely upward direction between the +Y direction and the −Z direction is formed, and the container-side electrical connection unit 140 is arranged in an inclined manner on the inclined face 144*s* at an arrangement angle substantially in parallel with the inclined face 144*s*. Accordingly, the normal vector of the surface of 141*s* of the substrate portion 141 and the contact faces of the terminal portions 52*t* includes vector components in the +Y direction and vector components in the −Z direction.

In this manner, the substrate portion 141 is arranged such that the surface of 141*s* is directed in the −Z direction. Therefore, when the apparatus-side electrical connection unit 52 is electrically connected, the container-side electrical connection unit 140 will come into electric contact with the apparatus-side electrical connection unit 52 while receiving at least a force in the +Z direction directed downward from the apparatus-side electrical connection unit 52. This downward force allows a good contact state between the container-side electrical connection unit 140 and the apparatus-side electrical connection unit 52, and the electric connectability of the container-side electrical connection unit 140 is improved.

In addition, in this embodiment, as described above, the substrate portion 141 is arranged in an inclined manner, and the surface of 141*s* is also directed in the +Y direction side. Therefore, when moving the first liquid container 100*a* along with the first case 61*a* in the +Y direction, and connecting the container-side electrical connection unit 140 to the apparatus-side electrical connection unit 52, it is possible to form an electrical connection state between the container-side electrical connection unit 140 and the apparatus-side electrical connection unit 52 using the force generated when moving the first case 61*a* in the +Y direction. Therefore, the electric connectability between the container-side electrical connection unit 140 and the apparatus-side electrical connection unit 52 is improved.

In addition, when connecting the container-side electrical connection unit 140 to the apparatus-side electrical connection unit 52, the terminal portions 52*t* of the apparatus-side electrical connection unit 52 will move while rubbing against the contact faces of the terminals 142 of the container-side electrical connection unit 140. Accordingly, foreign substances and the like adhered to the contact faces of the terminals 142 of the container-side electrical connection unit 140 are removed by the terminal portions 52*t* of the apparatus-side electrical connection unit 52, and thus the electric connectability of the container-side electrical connection unit 140 is further improved.

Moreover, when removing the first liquid container 100*a* along with the first case 61*a* from the case storage unit 60, a force in the −Y direction received from the apparatus-side electrical connection unit 52 assists the movement of the first liquid container 100*a* in the −Y direction. Therefore, removal of the first liquid container 100*a* is simplified.

The substrate portion 141 is provided at a recessed position of the substrate arrangement portion 144 (FIG. 16). On both sides in the X direction, the substrate portion 141 is sandwiched between two wall portions 145 that protrude in the −Z direction and the +Y direction relative to the surface of 141*s* of the substrate portion 141. These wall portions 145 function as protection portions for the substrate portion 141. Therefore, for example, when the user accidentally touches the substrate portion 141, the first liquid container 100*a* is accidentally dropped, or the like, damage to the substrate portion 141 is suppressed.

Side wall faces 146 sandwiching the substrate portion 141 in the substrate arrangement portion 144 in the X direction on both sides are respectively provided with groove like guiding recessed portions 147 that extend in the Y direction (FIG. 16). The guiding recessed portions 147 are open in the +Y direction. When the apparatus-side electrical connection unit 52 is connected to the container-side electrical connection unit 140, the guiding projections 52*g* provided on both sides in the X direction of the apparatus-side electrical connection unit 52 are inserted into the corresponding guiding recessed portions 147 in the −Y direction. Accordingly, positioning of the substrate portion 141 relative to the apparatus-side electrical connection unit 52 is performed.

First Receiving Portion and Second Receiving Portion

The first receiving portion 150*f* and the second receiving portion 150*s* are provided in the first face portion 121 of the connection member 120*a* (FIG. 15). When the first liquid container 100*a* is mounted to the liquid ejection apparatus 10, the first receiving portion 150*f* receives the first positioning portion 53*f* (FIG. 5) of the first connection receiving unit 50*a*, and the second receiving portion 150*s* receives the second positioning portion 53*s* (FIG. 5). Accordingly, the mounting position of the first liquid container 100*a* is appropriately defined.

In this embodiment, the first receiving portion 150*f* and the second receiving portion 150*s* are formed as holes extending in the −Y direction, and respectively have a first opening portion 151*f* and a second opening portion 151*s*

(FIG. 15). Positioning portions 53*f* and 53*s* are respectively inserted into the opening portions 151*f* and 151*s* of the first receiving portion 150*f* and the second receiving portion 150*s* from the +Y direction side. Note that, in this embodiment, the first opening portion 151*f* of the first receiving portion 150*f* and the second opening portion 151*s* of the second receiving portion 150*s* have different opening shapes, but detailed description thereof will be given later.

The first receiving portion 150*f* is positioned on the −X direction side relative to the liquid introducing outlet 131 (FIG. 15). In the first liquid container 100*a*, the first receiving portion 150*f* is provided at the lower corner on the −X direction side of the first face portion 121. On the other hand, the second receiving portion 150*s* is positioned on the +X direction side relative to the liquid introducing outlet 131. In the first liquid container 100*a*, the second receiving portion 150*s* is provided at the lower corner on the +X direction side of the first face portion 121.

In this embodiment, the liquid introducing outlet 131 is sandwiched between a pair of the receiving portions 150*f* and 150*s* in the X direction. This improves the positioning accuracy of the liquid introducing outlet 131 relative to the liquid introducing portion 51 (FIG. 5) in the X direction when mounting the first liquid container 100*a* to the liquid ejection apparatus 10. Therefore, the connectability between the liquid introducing portion 51 and the liquid introducing outlet 131 is improved. In this embodiment, the two receiving portions 150*f* and 150*s* are provided at positions respectively overlapping at least portions of guide portions 165*a* (which will be described later) provided on the same sides in the X direction when the first liquid container 100*a* is viewed in the Y direction. In this manner, in this embodiment, the distance in the X direction between the pair of receiving portions 150*f* and 150*s* is set large, and thus the positioning accuracy is further improved.

Fitting Structure Receiving Unit

The fitting structure receiving portion 155 is provided on the +X direction side relative to the liquid introducing outlet 131 (FIG. 15). The fitting structure receiving portion 155 is provided at a position close to the end portion on the +X direction side, at the end portion on the +Y direction side of the third face portion 123. The fitting structure receiving portion 155 is provided on the opposite side to the container-side electrical connection unit 140 with the liquid introducing outlet 131 therebetween in the X direction. The fitting structure receiving portion 155 has a projection-and-recess structure in which a plurality of protrusions 156 having a substantially rectangular shape that protrude in the −Z direction at the same height, and extend in the −Y direction in parallel are arranged. The arrangement pattern in the X direction of the protrusions 156 in the fitting structure receiving portion 155 and valley portions 157 that are recessed portions formed between the protrusions 156 is the reverse of the arrangement pattern in the projection-and-recess structure of the fitting structure 55 (FIG. 5) that is a connection target.

When moving the first liquid container 100*a* in the +Y direction, and connecting the first liquid container 100*a* to the corresponding first connection receiving unit 50*a*, the projection-and-recess structure of the fitting structure 55 and the projection-and-recess structure of the fitting structure receiving portion 155 are allowed to engage with each other. On the other hand, if the combination of the first liquid container 100*a* and the first connection receiving unit 50*a* is not appropriate, the projection-and-recess structure of the fitting structure 55 does not match the projection-and-recess structure of the fitting structure receiving portion 155, and fitting cannot be performed. Therefore, an incorrect and non-corresponding first liquid container 100*a* is inhibited from being connected to the first connection receiving unit 50*a*.

Other Constituent Elements of Connection Member

Recessed Portion

The fourth face portion 124 of the connection member 120*a* is provided with a recessed portion 160 recessed in the −Z direction (FIGS. 15 and 16). In this embodiment, the recessed portion 160 has a substantially rectangular shape, extends to the first face portion 121 in the +Y direction, and opens in the +Y direction. When the first liquid container 100*a* is arranged in the first case 61*a*, a projection portion (which will be described later) formed on the bottom face of the first case 61*a* is stored in the recessed portion 160. When viewed in the Z direction, the recessed portion 160 is formed at a position overlapping at least a portion of the container-side electrical connection unit 140. The reason for this will be described later.

Fitting Recessed Portion

A pair of fitting recessed portions 161 are formed on the fourth face portion 124 of the connection member 120*a* (FIG. 15). The two fitting recessed portions 161 are arranged so as to sandwich the liquid introducing outlet 131 in the X direction. The two fitting recessed portions 161 are formed at positions adjacent to the peripheral edge portion 132 of the liquid introducing outlet 131 in the X direction. In this embodiment, the fitting recessed portions 161 are formed as recessed portions cut out in the −Z direction. Similarly to the above-described recessed portion 160, the fitting recessed portions 161 are open in the +Y direction in the first face portion 121. When the first liquid container 100*a* is arranged into the first case 61*a*, portions of back face wall portions 203 of the first case 61*a* are inserted into and fitted in the fitting recessed portions 161 (FIGS. 7 and 13). Accordingly, positioning of the liquid introducing outlet 131 relative to the first case 61*a* in the X direction is performed.

Guide Portions

The connection member 120*a* is provided with the two guide portions 165*a* (FIGS. 7, 9, 13 and 15). When the first liquid container 100*a* is arranged in the first case 61*a*, the guide portions 165*a* are guided by corresponding guiding portions 208*a* (which will be described later) of the first case 61*a*, and positioning of the first liquid container 100*a* relative to the first case 61*a* is performed (FIG. 13). In a state where the first liquid container 100*a* is arranged in the first case 61*a*, the guiding portions 208*a* are fitted into the guide portions 165*a*, and the connection member 120*a* is fixed to the first case 61*a* (FIGS. 7 and 9).

In the first liquid container 100*a*, the two guide portions 165*a* are respectively provided on the fifth face portion 125 side and the sixth face portion 126 side of the connection member 120*a* (FIG. 9). The two guide portions 165*a* of the first liquid container 100*a* are formed as recessed portions recessed in the X direction on the fifth face portion 125 and the sixth face portion 126 respectively (FIG. 15). In this embodiment, the guide portions 165*a* are groove portions having a substantially semi-circular shape on a horizontal cross-sectional face (FIG. 9), and are formed respectively on the face portions 125 and 126 of the connection member 120*a* in the direction of the arrow Z (FIG. 15). The end portions on the +Y direction side of the guide portions 165*a* have a chamfered shape. Specifically, on each of the guide portions 165*a*, a flat face portion 165*p* having a flat face directed in the −Y direction is formed.

In this embodiment, the two guide portions 165*a* are formed so as to be aligned in the X direction (FIG. 9). The two guide portions 165*a* are formed so as to be symmetrical relative to the center in the X direction of the first connection member 120*a*. The guide portions 165*a* are positioned on the −Y direction side relative to the liquid introducing outlet 131, the container-side electrical connection unit 140 and the fitting structure receiving portion 155. The two guide portions 165*a* are respectively provided on the two sides of the liquid introducing outlet 131 in the X direction, and the liquid introducing outlet 131 is positioned between the two guide portions 165*a* in the X direction. In addition, in the X direction, the container-side electrical connection unit 140 is positioned between the liquid introducing outlet 131 and the guide portion 165*a* on the −X direction side. The fitting structure receiving portion 155 is positioned between the liquid introducing outlet 131 and the guide portion 165*a* on +X direction side. The configuration and functions of the guide portions 165*a* will be described later in detail.

Handle

The handle 170*a* is a section that can be gripped when the user moves the first liquid container 100*a*, and the like (FIGS. 7, 9, 13 and 15). In this embodiment, the handle 170*a* is manufactured by molding a resin member of polypropylene or the like. The handle 170*a* is provided with a grip portion 171, two coupling portions 172 and 173 and the two base end portions 174 and 175. The grip portion 171 is a section for the user to hook his or her hand. The grip portion 171 extends in the direction of the arrow X. In this embodiment, the width in the X direction of the grip portion 171 is slightly smaller than the width in the X direction of the connection member 120*a*, and is slightly larger than the width in the X direction of the bag-shaped member 110*a* (FIG. 9).

The two coupling portions 172 and 173 extend from the two ends of the grip portion 171 in a direction intersecting the X direction. The first coupling portion 172 couples the end portion on the +X direction side of the grip portion 171 and the first base end portion 174. The second coupling portion 173 couples the end portion on the −X direction side of the grip portion 171 and the second base end portion 175. The base end portions 174 and 175 are shaft-like sections having a substantially columnar shape, and protrude along the X direction so as to oppose each other. The grip portion 171 and the two coupling portions 172 and 173 are desirably hollow as appropriate in order to reduce the weights.

The first base end portion 174 protrudes in the +X direction at an end portion of the first coupling portion 172, and the second base end portion 175 protrudes in the −X direction at an end portion of the second coupling portion 173. The two base end portions 174 and 175 are connected to fixing portions 176 provided in the third face portion 123 of the connection member 120*a*. The handle 170*a* is pivotably fixed to the first connection member 120*a* by the fixing portions 176. In this embodiment, the fixing portions 176 are constituted by shaft holes extending in the X direction, and the base end portions 174 and 175 are inserted into the shaft holes in the X direction.

In this embodiment, the two base end portions 174 and 175 are positioned in the X direction between the two guide portions 165*a*. In this embodiment, the two base end portions 174 and 175 are positioned so as to overlap the two guide portions 165*a* in the X direction. Note that the distance in the X direction between the two base end portions 174 and 175 is shorter than the width in the X direction of the grip portion 171 (which will be described later).

The handle 170*a* is provided at a position where it is exposed in a state where the first liquid container 100*a* is arranged in the first case 61*a*. The handle 170*a* is provided at a position where it is visible and operable by the user.

Figure 17:
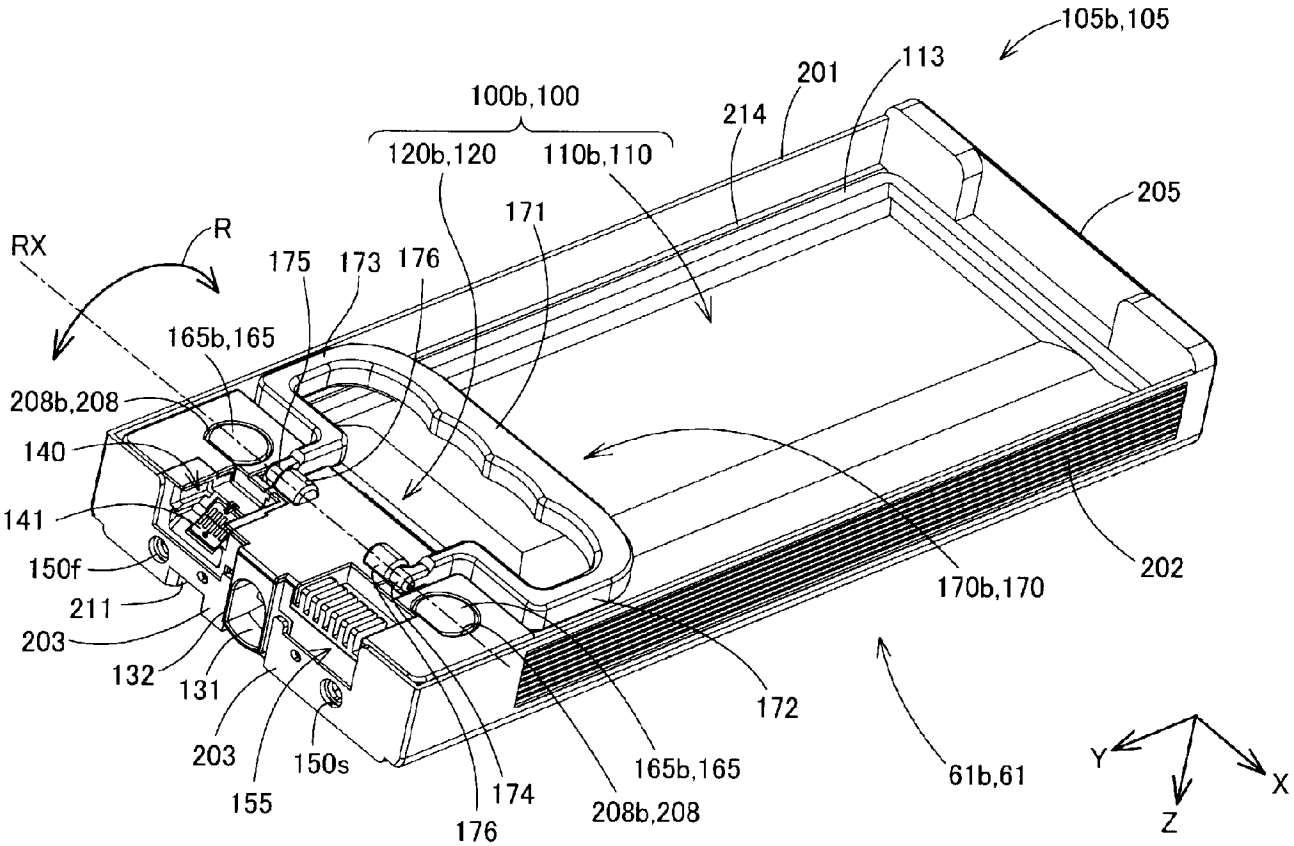
FIG. 17 is a schematic perspective diagram of a second mounting body when viewed from above.

The handle 170*a* pivots as indicated by an arrow R in FIG. 17 toward the connection member 120*a* as per a user operation. The handle 170*a* can pivot in two directions, namely, a direction from the bag-shaped member 110*a* side toward the first connection member 120*a* side and a direction from the first connection member 120*a* side toward the bag-shaped member 110*a* side. A pivot axis RX that is the center of pivot of the handle 170*a* coincides with the central axis of the two base end portions 174 and 175. In this embodiment, the pivot axis RX intersects a direction in which the first liquid container 100*a* is mounted to the first connection receiving unit 50*a* (namely, the +Y direction that is the opening direction of the liquid introducing outlet 131), and extends along the X direction. In this embodiment, the bag-shaped member 110*a* is positioned on the opposite side to the liquid introducing outlet 131, the container-side electrical connection unit 140, and the fitting structure receiving portion 155 with the pivot axis RX therebetween.

The handle 170*a* is pivotable in a state of being arranged in the first case 61*a*. In a state where the first liquid container 100*a* is mounted to the liquid ejection apparatus 10, the handle 170*a* is collapsed on the bag-shaped member 110*a* side, and is brought into a first orientation shown in FIG. 7. When the first liquid container 100*a* is carried or the like, the handle 170*a* is brought into a second orientation in which the handle 170*a* is pivoted from the first orientation toward the connection member 120*a* (see FIG. 35).

By using the handle 170*a*, the convenience when handling the first liquid container 100*a* such as when carrying the first liquid container 100*a*, mounting/removing the first liquid container 100*a* to/from the first case 61*a*, and the like is improved. Particularly, in this embodiment, the handle 170 has the grip portion 171 extending in the X direction, and thereby has a shape that can be easily gripped by the user. In addition, the handle 170 is fixed to the connection member 120 at two points, namely, the two base end portions 174 and 175, and thus can pivot in a stable manner. In this manner, high operability is obtained with the shape of the handle 170 of this embodiment, and thus the handleability of the liquid container 100 is improved. Additionally, the configuration and functions of the handle 170*a* will be described later in detail.

First Case

FIGS. 7 to 14 are referred to. The first case 61*a* has a substantially rectangular parallelepiped shape in which the Y direction is assumed to be a longitudinal direction. In addition, the first case 61*a* is formed as a hollow box that opens in the −Z direction and the +Y direction. For example, the first case 61*a* is formed of a resin member of polypropylene or the like.

The first case 61*a* is provided with a bottom face wall portion 200, two side wall portions 201 and 202 and the two back face wall portions 203 and a front face wall portion 205. The bottom face wall portion 200 is a wall portion having a substantially rectangular shape and constituting the bottom face portion of the first case 61*a* (FIGS. 8 and 10), and extends in the X direction and the Y direction. In this specification, "extend" refers to a configuration of continuously extending in a direction without being separated. Projections and recesses, a bent portion, a hole and an attachment portion may be provided midway in the extension. The first liquid container 100*a* is arranged on the bottom face wall portion 200 (FIGS. 7 and 13). The bottom face wall portion 200 has a size set to an extent to which at least the entirety of the bag-shaped member 110*a* is accommodated when the first liquid container 100*a* is arranged.

The first side wall portion 201 is a substantially rectangular shaped wall portion that intersects and is coupled with the longer side on the −X direction side of the bottom face wall portion 200, and constitutes the right side wall portion of the first case 61*a* (FIGS. 7 and 8). The second side wall portion 202 is a substantially rectangular shaped wall portion that intersects and is coupled with the longer side on the +X direction side of the bottom face wall portion 200, and constitutes the left side wall portion of the first case 61*a* (FIGS. 7 and 11). The first side wall portion 201 and the second side wall portion 202 extend in parallel substantially over the entire region of the first case 61*a* in the Y direction. The first side wall portion 201 and the second side wall portion 202 sandwich the bag-shaped member 110*a* of the first liquid container 100*a* in the X direction, and set the arrangement angle of the bag-shaped member 110*a* in a direction along the horizontal plane to a direction along the Y direction.

The height of the first side wall portion 201 and the second side wall portion 202 substantially coincide with the height of the third face portion 123 of the connection member 120*a* of the first liquid container 100*a* (FIGS. 7 and 11). In this embodiment, when the first mounting body 105*a* is viewed in the direction of the arrow X, a portion of the handle 170*a* in the first orientation protrudes from the upper ends of the first side wall portion 201 and the second side wall portion 202 (FIG. 11).

The two back face wall portions 203 erect in the −Z direction at the end portion on the +Y direction side of the bottom face wall portion 200 (FIG. 13). The back face wall portions 203 are provided on the two sides in the X direction, and are respectively coupled with the two side wall portions 201 and 202 that are on the same sides in the X direction as the back face wall portions 203. In a state where the first liquid container 100*a* is arranged, the liquid introducing outlet 131 and the peripheral edge portion 132 are arranged between the two back face wall portions 203 (FIG. 7). Portions of the back face wall portions 203 are respectively inserted into and fitted in the fitting recessed portions 161 formed on the two sides in the X direction of the liquid introducing outlet 131, and block the fitting recessed portions 161. The peripheral edge portion 132 slightly protrudes from the two back face wall portions 203 in the +Y direction (FIGS. 7 and 9).

The two back face wall portions 203 are lower than the side wall portions 201 and 202 (FIG. 13). In a state where the first liquid container 100*a* is arranged in the first case 61*a*, the two back face wall portions 203 are formed so as to cover a section below the container-side electrical connection unit 140 and the fitting structure receiving portion 155 of the connection member 120*a* (FIG. 7). The back face wall portions 203 are provided with through holes 203*h* into which the positioning portions 53*f* and 53*s* at positions corresponding to the first receiving portion 150*f* and the second receiving portion 150*s* are inserted (FIG. 13).

The front face wall portion 205 extends in the X direction and in the Z direction at the end portion on the −Y direction side of the bottom face wall portion 200, and is coupled with the bottom face wall portion 200 and the two side wall portions 201 and 202 (FIG. 7). The front face wall portion 205 is higher than the two side wall portions 201 and 202 (FIGS. 7 and 11). This makes it easy for the user to hook his or her finger on the front face wall portion 205 when pulling out the first case 61*a* from the case storage unit 60. When the first mounting body 105*a* is viewed in the Y direction, the handle 170*a* in the first orientation is covered and hidden by the front face wall portion 205 (FIG. 12). Because the handle 170*a* is compactly stored in this manner, the handle 170*a* is inhibited from obstructing mounting/removing of the first mounting body 105*a* to/from the case storage unit 60.

A bottom face 200*s* of the first case 61*a* that is a face directed in the −Z direction of the bottom face wall portion 200 is provided with the two guiding portions 208*a* that protrude in the −Z direction (FIG. 13). As described above, the two guiding portions 208*a* are respectively fitted into the corresponding two guide portions 165*a* in the connection member 120*a* of the first liquid container 100*a* (FIG. 7). Accordingly, positioning of the first liquid container 100*a* on the first case 61*a* is performed, and deviation of the arrangement position of the first liquid container 100*a* such as pivot in a direction along the horizontal direction of the first liquid container 100*a* is suppressed.

In the first case 61*a*, the guiding portions 208*a* are respectively integrated with the side wall portions 201 and 202 (FIG. 13). The guiding portions 208*a* are formed as projection portions protruding respectively from the side wall portions 201 and 202 toward the arrangement region of the connection member 120*a*. In this embodiment, the guiding portions 208*a* have a semicylindrical shape. The guiding portions 208*a* are desirably hollow in order to reduce the weight of the first case 61*a*.

The guiding portions 208*a* are shaped as if the end portion on the +Y direction side is chamfered. Accordingly, each guiding portion 208*a* is provided with a flat face portion 208*p* that has a flat face directed in the +Y direction. When the guiding portion 208*a* is fitted into the guide portion 165*a*, the flat face portion 208*p* of the guiding portion 208*a* comes into face contact with the flat face portion 165*p* of the guide portion 165*a* (FIG. 7). When the first liquid container 100*a* arranged in the first case 61*a* receives a load in the −Y direction, the position of the first liquid container 100*a* is stabilized by the contact between the flat face portion 165*p* and the flat face portion 208*p* that oppose each other in the Y direction.

The height in the Z direction of the guiding portion 208*a* is substantially equal to the thickness in the Z direction of the first connection member 120*a*. Therefore, in a state where the first liquid container 100*a* is arranged in the first case 61*a*, the guiding portion 208*a* is arranged in the corresponding guide portion 165*a* over the entire region thereof in the height direction. This makes it easy for the flat face portion 165*p* and the flat face portion 208*p* that oppose each other in the Y direction to come in contact with each other when the first liquid container 100*a* arranged in the first case 61*a* receives a load in the −Y direction. Therefore, the stability of the position of the first liquid container 100*a* is improved.

Additionally, in the first case 61*a*, on the bottom face 200*s* of the bottom face wall portion 200, a projection portion 210 protruding in the −Z direction is provided at the end portion on the +Y direction side (FIG. 13). The projection portion 210 is positioned at a position on the −X direction side relative to the central portion in the X direction, and is positioned on the −X direction side relative to a pair of fitting projection portions 207. In this embodiment, the projection portion 210 has a rectangular shape. The projection portion 210 is formed to be hollow. An internal space 211 of the projection portion 210 will be described later. When the first liquid container 100*a* is arranged in the first case 61*a*, the projection portion 210 is stored in the above-described recessed portion 160 of the connection member 120*a* (FIG. 16).

In this embodiment, when the projection portion 210 is stored in the recessed portion 160, the outer wall face of the projection portion 210 and the inner wall face of the recessed portion 160 come into face contact with each other. Accordingly, the projection portion 210 is fitted in the recessed portion 160. Therefore, in this embodiment, the projection portion 210 and the recessed portion 160 function as a positioning portion of the connection member 120*a* in the first case 61*a*.

As described above, in this embodiment, at least a portion of the container-side electrical connection unit 140 is arranged above the recessed portion 160, and in the first mounting body 105*a*, at least a portion of the container-side electrical connection unit 140 is arranged above the projection portion 210. Therefore, even if a liquid leaks to the bottom face 200*s* of the first case 61*a*, the projection portion 210 inhibits the liquid from traveling along the wall face of the first case 61*a* and reaching the container-side electrical connection unit 140.

In the face on the −Z direction side of the bottom face wall portion 200, a plurality of linear thin groove portions extending in the Y direction are arranged in parallel in the X direction (not illustrated). Using the thin groove portions, the moving of the bag-shaped member 110*a* of the first liquid container 100*a* when being arranged by being slid on the bottom face wall portion 200 in the Y direction is guided.

A corner portion between the bottom face wall portion 200 and the first side wall portion 201, a corner portion between the bottom face wall portion 200 and the second side wall portion 202, and a corner portion between the bottom face wall portion 200 and the front face wall portion 205 are provided with a step portion 214 (FIGS. 7 and 13) whose height increases in the −Z direction in a stepwise manner. When the first liquid container 100*a* is arranged in the first case 61*a*, the step portion 214 comes into contact with the outer peripheral end portion 113 of the bag-shaped member 110*a*, and supports the outer peripheral end portion 113 of the bag-shaped member 110*a*. This stabilizes the arrangement orientation of the bag-shaped member 110*a* on the first case 61*a*.

In this embodiment, the connection member 120*a* of the first liquid container 100*a* is fixed only at the arrangement position on the first case 61*a*, and the bag-shaped member 110*a* is not substantially restricted by the first case 61*a* except for the end portion on the +Y direction side. The bag-shaped member 110*a* is arranged on the first case 61*a* in a state where movement in a direction separating from the first case 61*a* is allowed. In this manner, the first liquid container 100*a* is not restricted relative to the first case 61*a* unnecessarily, and thus mounting/removing of the first liquid container 100*a* to/from the first case 61*a* is simplified. In addition, the bag-shaped member 110*a* is inhibited from receiving an unnecessary load other than the gravity, and deterioration in the pressure state in the storage portion 115 in the bag-shaped member 110 due to such an unnecessary load is suppressed.

The configuration of the bottom face wall portion 200 on the lower side will be described with reference to FIGS. 8 and 10. On the +Z direction side of the bottom face wall portion 200, a groove portion 215 is provided at the end portion on the +Y direction side. In this embodiment, the groove portion 215 is formed by being surrounded by a rib 216. The groove portion 215 constitutes a case-side fixing structure 220. The end portion on the +Y direction side of the groove portion 215 is constituted by the above-described internal space 211 of the projection portion 210. Specifically, the internal space 211 of the projection portion 210 constitutes a portion of the case-side fixing structure 220, and is included in the case-side fixing structure 220. The internal space 211 of the projection portion 210 opens in the +Y direction, and constitutes the entrance of the groove portion 215 (the case-side fixing structure 220).

The case-side fixing structure 220 restricts movement of the first case 61*a* in the Y direction in cooperation with the apparatus-side fixing structure 54 (FIG. 5). The case-side fixing structure 220 is provided with an engagement portion (which will be described later) to be engaged with the protrusion 54*p* (the engaging portion 54*p*) of the apparatus-side fixing structure 54 in a case-stored state where the first case 61*a* is arranged in the predetermined arrangement region LA (FIG. 3) of the case storage unit 60. Due to the protrusion 54*p* being engaged with the engagement portion, movement of the first case 61*a* is the −Y direction is restricted. In this embodiment, the groove portion 215 constituting the case-side fixing structure 220 is configured to have a heart cam groove structure that is a looped groove structure, which will be described later. The configuration of the case-side fixing structure 220 and the mechanism for engaging the engagement portion of the case-side fixing structure 220 with the protrusion 54*p* (the engaging portion 54*p*) of the apparatus-side fixing structure 54 will be described later.

The plurality of rail ribs 230 and a plurality of leg portions 231 are further provided on the face on the +Z direction side of the bottom face wall portion 200. The rail ribs 230 are configured as protruding wall portions protruding in the +Z direction, and extend linearly in the Y direction with a substantially constant width. As described above, the rail ribs 230 are fitted in the rail grooves 64 provided on the floor face of the case storage unit 60, and guide movement of the first case 61*a* in the Y direction. The plurality of leg portions 231 protrude in the +Z direction, and have the same height (FIG. 12). Due to the plurality of leg portions 231, the arrangement orientation of the first case 61*a* in the arrangement region LA (FIG. 3) of the case storage unit 60 is appropriately maintained.

Second Mounting Body, Second Liquid Container and Second Case

In the following description, first, an overview of the configuration of the second liquid container 100*b* will be given, and an overview of the configuration of the second case 61*b* will be given. Note that in the following description and reference drawings, the same reference numerals or reference numerals in which only the attached suffix is different and the numbers are the same are used for constituent elements that are the same as or correspond to the above-described various constituent elements of the first liquid container 100*a* and the first case 61*a*. In the second liquid container 100*b* or the second case 61*b*, constituent elements to which such corresponding reference numerals are assigned provide functions similar to those of the corresponding constituent elements in the first liquid container 100*a* or the first case 61*a*. Therefore, the various effects described above regarding the first liquid container 100*a* and first case 61*a* can be obtained also in the second liquid container 100*b* and the second case 61*b* using such corresponding constituent elements. Note that the same applies to embodiments other than the first embodiment and modified examples, which will be described later.

Figure 18:
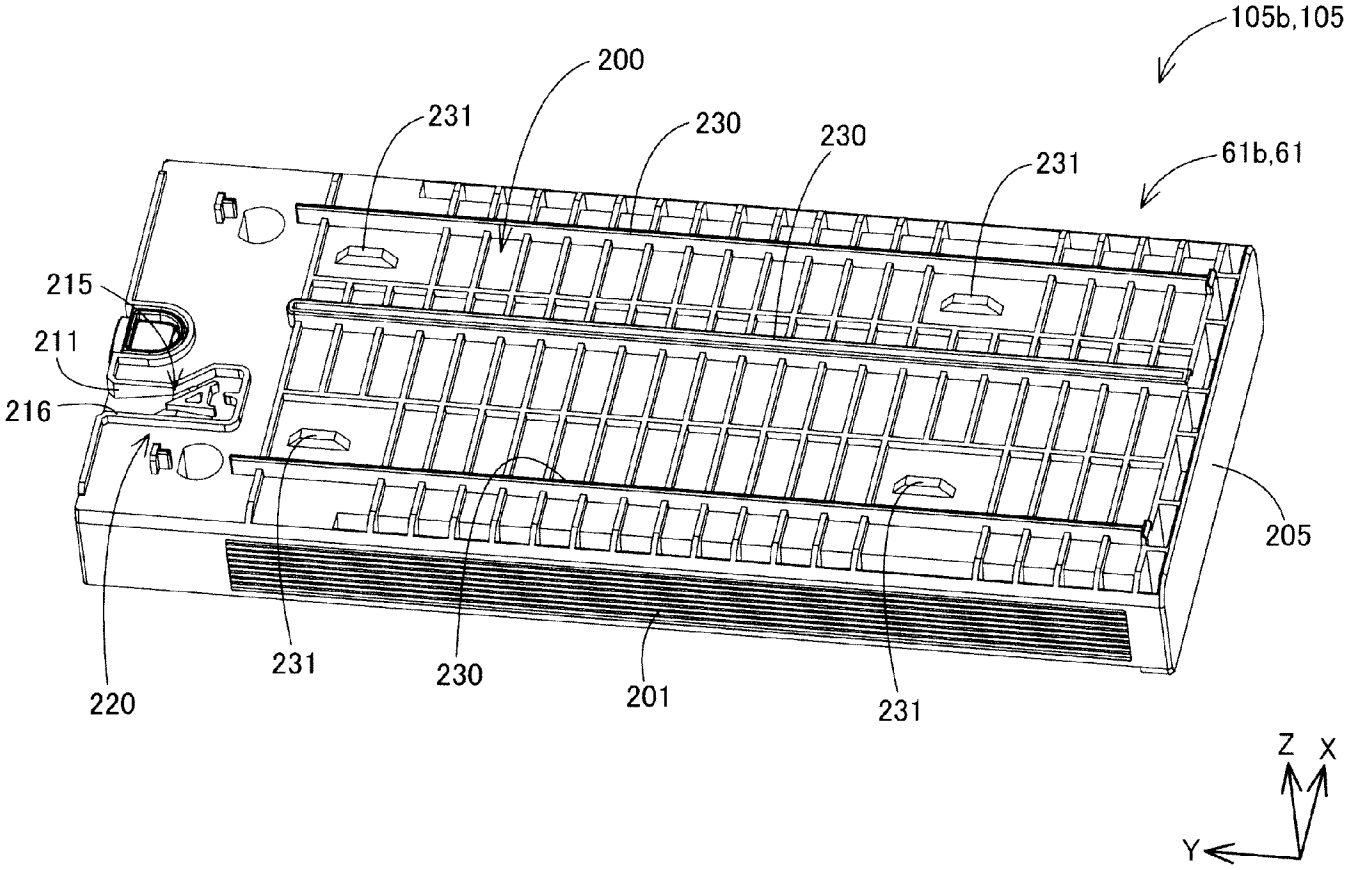
FIG. 18 is a schematic perspective diagram of the second mounting body when viewed from below.
Figure 19:
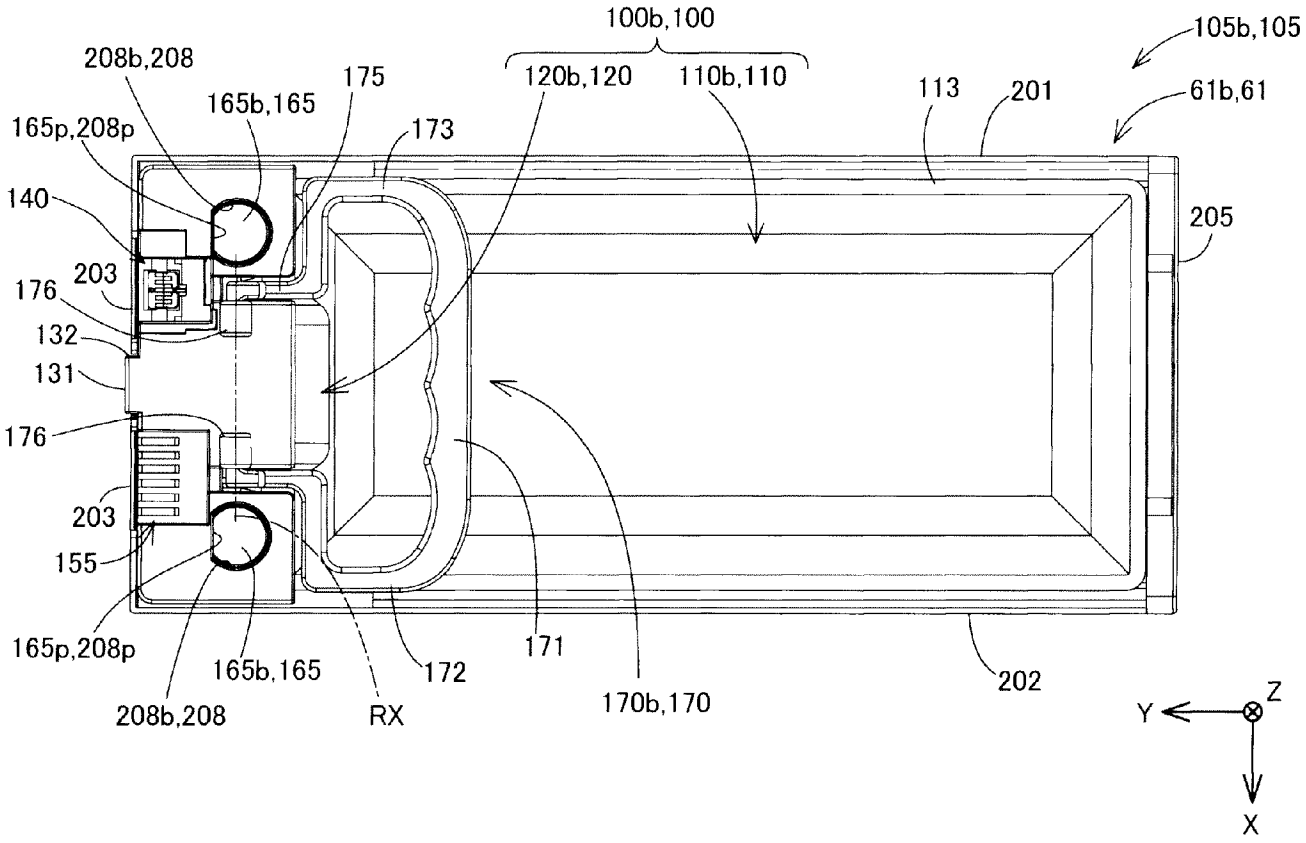
FIG. 19 is a schematic diagram showing the upper face side of the second mounting body.
Figure 20:
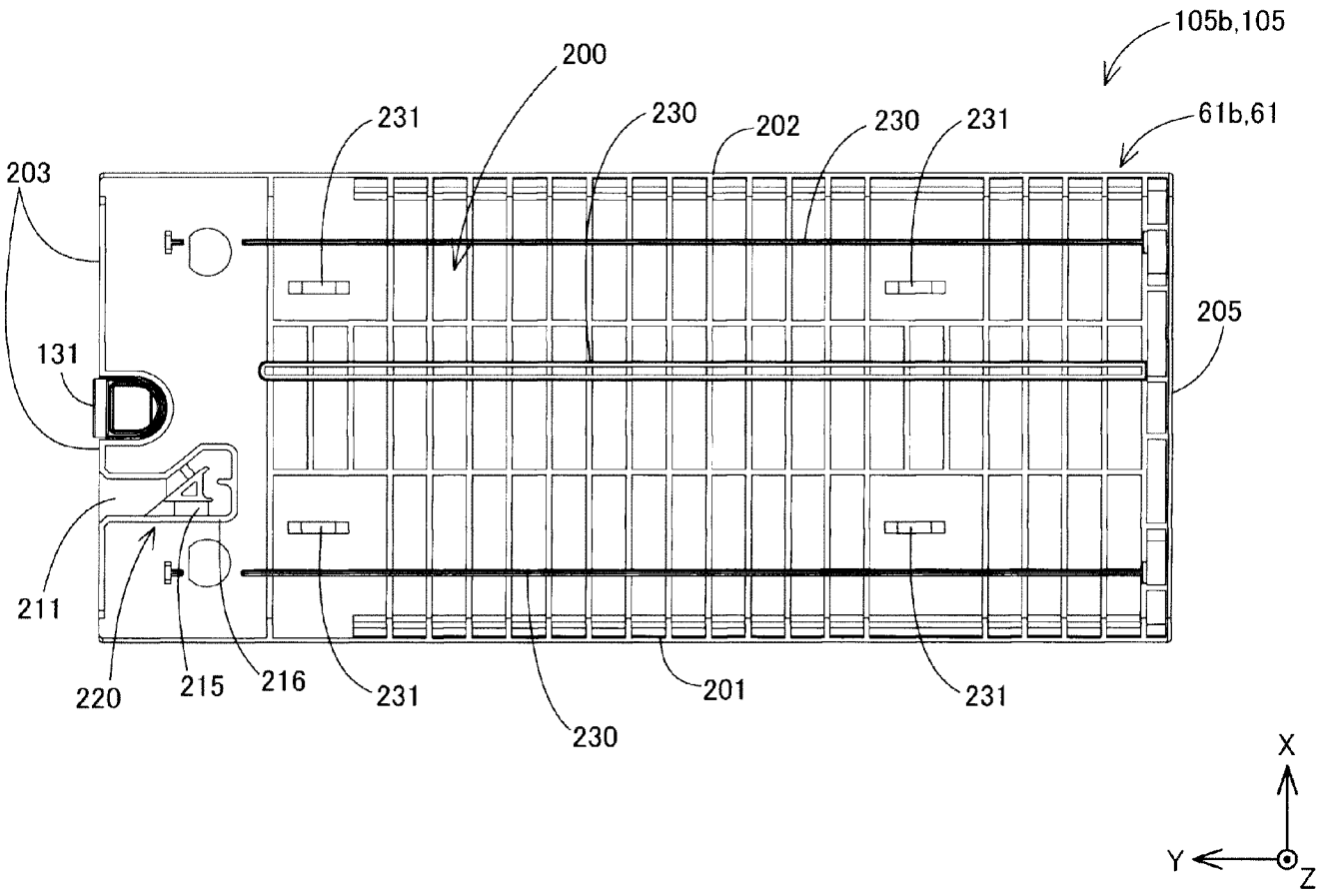
FIG. 20 is a schematic diagram showing the lower face side of the second mounting body.
Figure 21:
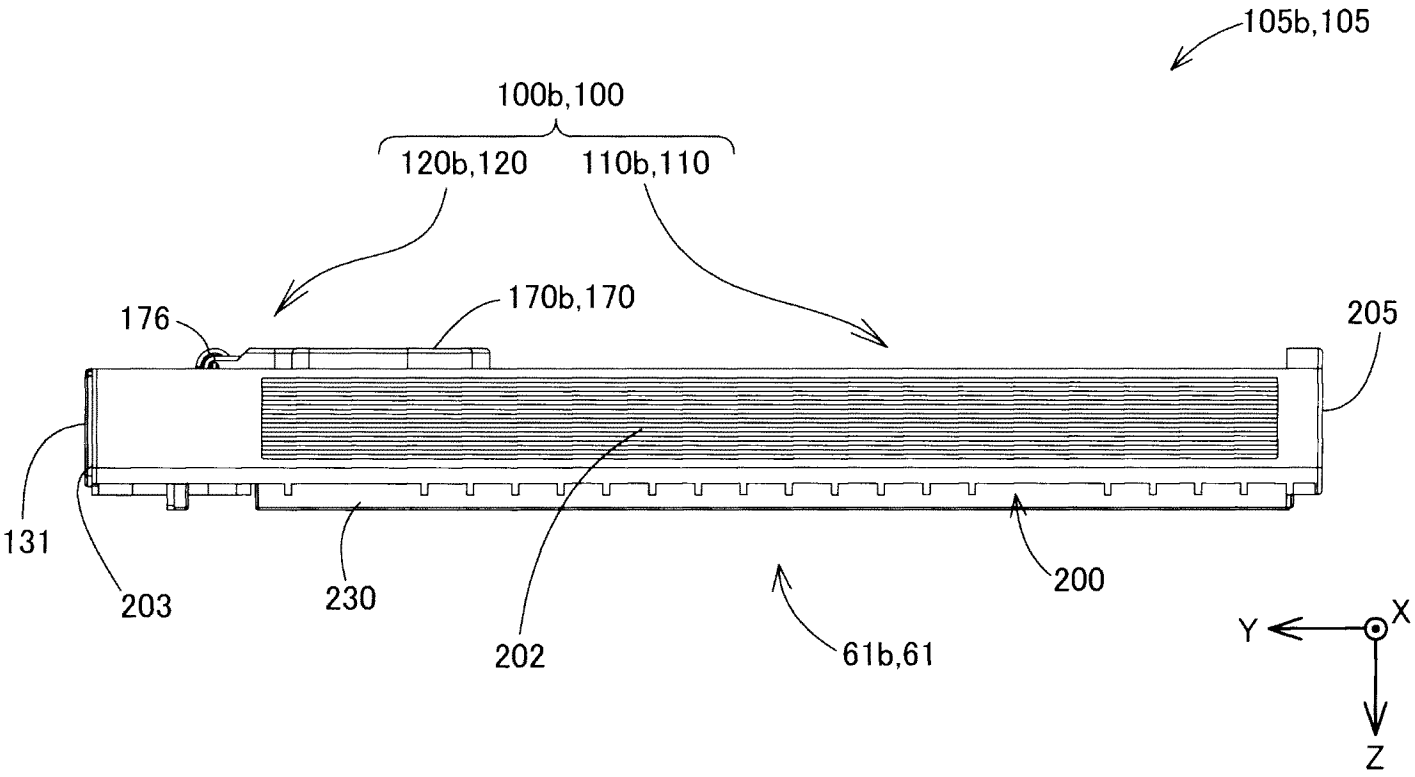
FIG. 21 is a schematic diagram showing the left face side of the second mounting body.
Figure 22:
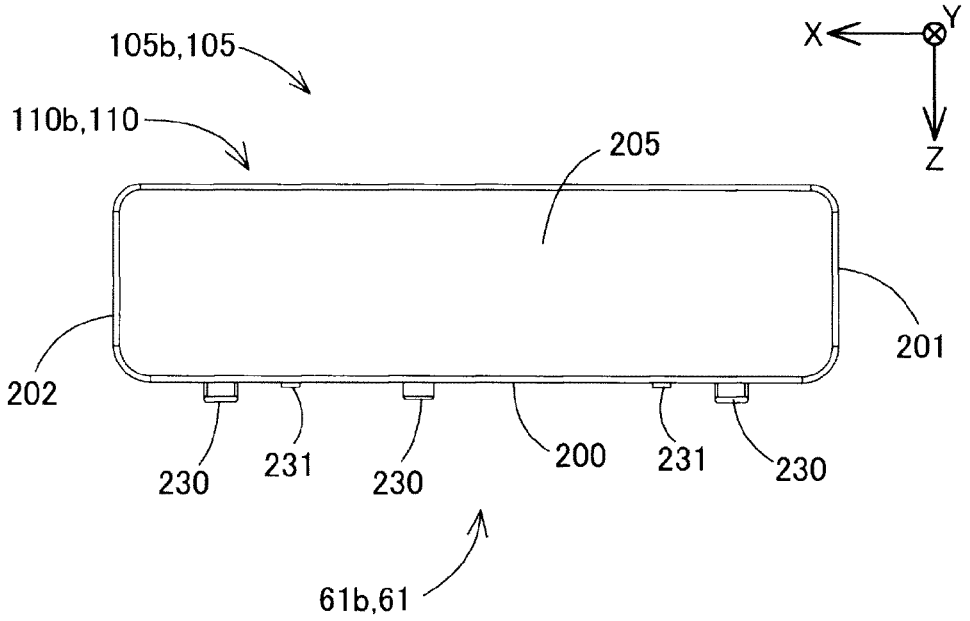
FIG. 22 is a schematic diagram showing the front face side of the second mounting body.
Figure 23:
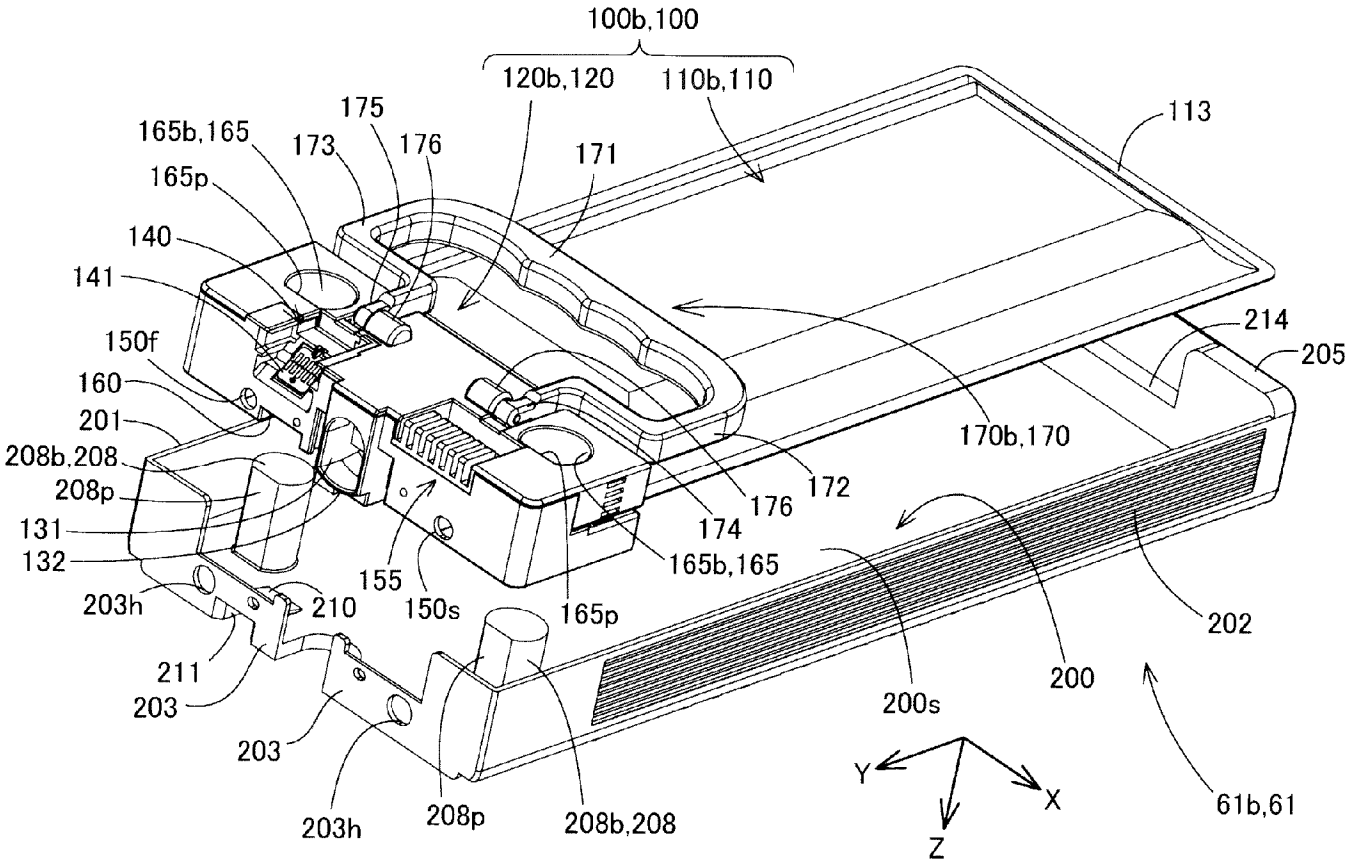
FIG. 23 is a schematic exploded perspective diagram separately showing a second case and a second liquid container.
Figure 24:
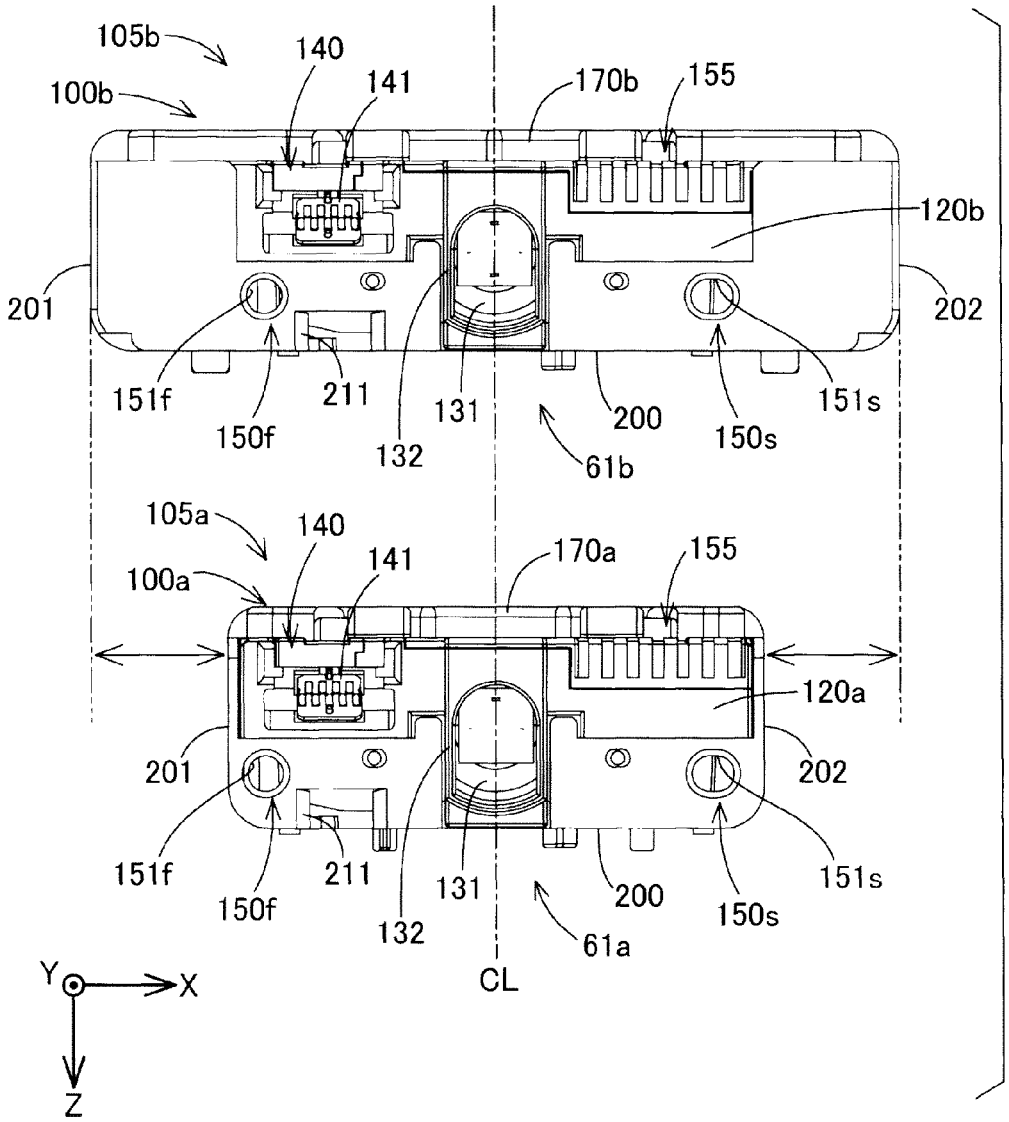
FIG. 24 is a schematic diagram showing the back face side of the second mounting body.

FIGS. 17 to 24 are referred to. FIG. 17 is a schematic perspective diagram of the second mounting body 105*b* when viewed from above. FIG. 18 is a schematic perspective diagram of the second mounting body 105*b* when viewed from below. FIG. 19 is a schematic diagram of the second mounting body 105*b* when viewed in the +Z direction, and shows the upper face side of the second mounting body 105*b*. FIG. 20 is a schematic diagram of the second mounting body 105*b* when viewed in the −Z direction, and shows the lower face side of the second mounting body 105*b*. FIG. 21 is a schematic diagram of the second mounting body 105*b* when viewed in the −X direction, and shows the left face side of the second mounting body 105*b*. FIG. 22 is a schematic diagram of the second mounting body 105*b* when viewed in the +Y direction, and shows the front face side of the second mounting body 105*b* (namely, the back end side in the mounting direction). FIG. 23 is a schematic exploded perspective diagram of a state where the second liquid container 100*b* is removed from the second case 61*b*, the state being viewed from above. FIG. 24 is a schematic diagram of the second mounting body 105*b* when viewed in the −Y direction, and shows the back face side of the second mounting body 105*b* (namely, the front end side in the mounting direction). For comparison, in the lower part of FIG. 24, the first mounting body 105*a* when viewed in the same direction is illustrated. In FIG. 24, a central axis CL of the mounting bodies 105*a* and 105*b* in the X direction is indicated by a dashed-dotted line.

Second Liquid Container

The second liquid container 100*b* has substantially the same configuration as the first liquid container 100*a* except for items described below (FIGS. 17, 19 and 23). The width in the X direction of the second liquid container 100*b* is larger than that of the first liquid container 100*a* so as to be able to store a larger amount of liquid than the first liquid container 100*a*.

Similarly to the first liquid container 100*a*, the second liquid container 100*b* is provided with a bag-shaped member 110*b* and a connection member 120*b* (FIGS. 17, 19, and 23). The bag-shaped member 110*b* of the second liquid container 100*b* has substantially the same configuration as the bag-shaped member 110*a* of the first liquid container 100*a*, except that the width in the X direction of the bag-shaped member 110*b* of the second liquid container 100*b* is larger.

The connection member 120*b* of the second liquid container 100*b* has substantially the same configuration as the connection member 120*a* of the first liquid container 100*a* except for items described below (FIGS. 23 and 24). The two end portions in the X direction of the connection member 120*b* extend in the +X direction and the −X direction further than the connection member 120*a* of the first liquid container 100*a* to match the width in the X direction of the bag-shaped member 110*b*. The width in the X direction of the connection member 120*b* is slightly larger than the width in the X direction of the bag-shaped member 110*b*, and the two corners on the +Y direction side of the bag-shaped member 110*b* are held by the connection member 120*b* (FIG. 19).

The arrangement configuration of the constituent elements at the end portion on the −Y direction side for connecting the connection member 120*b* of the second liquid container 100*b* to the second connection receiving unit 50*b* is substantially the same as the connection member 120*a* of the first liquid container 100*a* (FIG. 24). The positions of the constituent elements (the container-side electrical connection unit 140, the two receiving portions 150*f* and 150*s*, the fitting structure receiving portion 155, the recessed portion 160, and the fitting recessed portions 161) relative to the liquid introducing outlet 131 are common to the connection members 120*a* and 120*b* of two types (FIG. 24).

Two guide portions 165*b* are respectively provided on the two sides in the X direction of the second connection member 120*b* (FIGS. 17, 19, and 23). The two guide portions 165*b* are provided as through holes penetrating the connection member 120*b* in the Z direction at positions close to the two end portions in the X direction of the connection member 120*b* (FIG. 23).

Each of the guide portions 165*b* has an opening cross section of a substantially circular shape in a horizontal cross-section (FIG. 19). The end portion on the +Y direction side of the guide portion 165*b* has a chamfered shape. Specifically, a flat face portion 165*p* having a flat face directed in the −Y direction is formed in the end portion on the +Y direction side of the guide portion 165*b* (FIGS. 19 and 23). In this embodiment, each of the two guide portions 165*b* of the second connection member 120*b* has a section that substantially coincides with the shape of the corresponding guide portion 165*a* of the first connection member 120*a*, at a position corresponding to the corresponding guide portion 165*a* of the first connection member 120*a*.

The guide portions 165*b* are positioned on the −Y direction side relative to the liquid introducing outlet 131, the container-side electrical connection unit 140 and the fitting structure receiving portion 155 (FIGS. 17, 19, and 23). The two guide portions 165*b* are provided so as to be aligned in the X direction (FIG. 19). The two guide portions 165*b* are formed to be horizontally symmetrical relative to the center in the X direction of the second connection member 120*b*. Further detailed descriptions of the guide portions 165*b* will be described later.

A third face portion 123 of the second connection member 120*b* is provided with a handle 170*b* (FIG. 17). The handle 170*b* of the second connection member 120*b* has substantially the same configuration as the handle 170*a* except that the length in the X direction of a grip portion 171 is longer than that of the handle 170*a* of the first liquid container 100*a*.

Similarly to the handle 170*a*, the handle 170*b* pivots relative to an axis RX along the X direction as indicated by the arrow R (FIG. 17) according to a user operation, and is brought into the first orientation or the second orientation. The width in the X direction of the grip portion 171 of the handle 170*b* is slightly smaller than the width in the X direction of the connection member 120*b*, and is slightly larger than the width in the X direction of the bag-shaped member 110*b*. Two base end portions 174 and 175 of the handle 170*b* are positioned between the two guide portions 165*b* in the X direction. The distance between the two base end portions 174 and 175 of the handle 170*b* is substantially the same as the distance between the two base end portions 174 and 175 in the first liquid container 100*a*.

As described above, the difference between the connection member 120*b* of the second liquid container 100*b* and the connection member 120*a* of the first liquid container 100*a* is small, and thus constituent parts can be made common, and the manufacturing cost can be reduced. In addition, the configuration of the second connection receiving unit 50*b* corresponding to the connection member 120*b* of the second liquid container 100*b* can be substantially similar to the configuration of the first connection receiving unit 50*a* corresponding to the connection member 120*a* of the first liquid container 100*a*, and thus the manufacturing cost of the connection member 120 can be reduced.

In the following description, the bag-shaped member 110*a* of the first liquid container 100*a* and the bag-shaped member 110*b* of the second liquid container 100*b* are collectively referred to as the "bag-shaped member 110"

unless they need to be specifically distinguished apart from each other. Similarly, the connection members 120*a* and 120*b*, the guide portions 165*a* and 165*b*, and the handles 170*a* and 170*b* are also referred to as the "connection member 120", the "guide portion 165", and the "handle 170", respectively.

Second Case

The second case 61*b* has substantially the same configuration as the first case 61*a* except for items described below. The width in the X direction of the second case 61*b* is changed to be fitted with the width in the X direction of the second liquid container 100*b* (FIGS. 17 and 24). In the second case 61*b*, a first side wall portion 201 and a second side wall portion 202 are provided at positions extending further in the +X direction and the −X direction than the first case 61*a* (FIG. 24). In the second case 61*b*, a back face wall portion 203 (FIG. 24) and a front face wall portion 205 (FIG. 22) extend further in the X direction than the first case 61*a* does.

The second case 61*b* is provided with two guiding portions 208*b* corresponding to the guide portions 165*b* of the second connection member 120*b* (FIGS. 17, 19, and 23). In the second case 61*b*, the two guiding portions 208*b* protrude from the bottom face 200*s* of the bottom face wall portion 200 in the −Z direction, at positions separated from the first side wall portion 201 and the second side wall portion 202, respectively (FIG. 23). In this embodiment, each of the guiding portions 208*b* has a substantially columnar shape. The guiding portions 208*b* are desirably hollow.

The guiding portion 208*b* is shaped as if the curved surface on the +Y direction side is chamfered. Specifically, the guiding portion 208*b* is provided with a flat face portion 208*p* having a flat face directed in the +Y direction (FIGS. 19 and 23). Similarly to the first mounting body 105*a*, also in the second mounting body 105*b*, the flat face portion 208*p* of the guiding portion 208*b* comes into face contact with the flat face portion 165*p* of the guide portion 165*b* when the guiding portion 208*b* is fitted into the guide portion 165*b* (FIGS. 17 and 19).

The height in the Z direction of each of the guiding portions 208*b* is substantially equal to the thickness in the Z direction of the second connection member 120*b*. Therefore, in a state where the second liquid container 100*b* is arranged in the second case 61*b*, the guiding portion 208*b* penetrates the corresponding guide portion 165*b* (FIG. 17). This makes it easy for the flat face portion 165*p* (FIG. 19) and the flat face portion 208*p* (FIG. 19) that oppose each other in the Y direction to come into contact with each other when the second liquid container 100*b* arranged in the second case 61*b* receives a load in the −Y direction. Therefore, the stability of the position of the second liquid container 100*b* is improved.

In the following description, the guiding portion 208*a* of the first case 61*a* and the guiding portion 208*b* of the second case 61*b* are collectively referred to as a "guiding portion 208" unless they need to be specifically distinguished apart from each other.

Mechanism for Mounting Liquid Container

A mechanism for mounting the liquid container 100 to the connection receiving unit 50 will be described with reference to FIG. 25. In the upper part of FIG. 25, the first liquid container 100*a* arranged in the first case 61*a* when viewed in the −Y direction is illustrated. Also, in the lower part of FIG. 25, a portion of the first connection receiving unit 50*a* when viewed in the −Z direction is illustrated in correspondence with the first liquid container 100*a* in the upper part. Note that the following description is common to mounting of the first liquid container 100*a* to the first connection receiving unit 50*a* and mounting of the second liquid container 100*b* to the second connection receiving unit 50*b*.

In the case storage unit 60 (FIG. 3), when the liquid container 100 arranged in the case 61 is moved toward the arrangement region LA in the +Y direction, a pair of positioning portions 53*f* and 53*s* of the connection receiving unit 50 is first inserted into a pair of the receiving portions 150*f* and 150*s* of the liquid container 100, and positioning of the liquid introducing outlet 131 of the liquid container 100 is performed.

After that, the liquid introducing portion 51 of the connection receiving unit 50 is inserted into the liquid introducing outlet 131 of the liquid container 100, and the liquid introducing outlet 131 of the liquid container 100 and the liquid introducing portion 51 of the connection receiving unit 50 are connected. Note that before the connection between the liquid introducing outlet 131 and the liquid introducing portion 51 is complete, the peripheral edge portion 132 provided around the liquid introducing outlet 131 comes into contact with the base end member 57 around the liquid introducing portion 51. When the liquid container 100 and the case 61 are pressed in the +Y direction until the connection between the liquid introducing outlet 131 and the liquid introducing portion 51 is complete, the base end member 57 is shifted in the +Y direction. The liquid container 100 is biased in the −Y direction by the biasing member 57*e* (FIG. 5) provided inside the base end member 57.

In parallel with the above-described connection between the liquid introducing outlet 131 and the liquid introducing portion 51, the apparatus-side electrical connection unit 52 of the connection receiving unit 50 and the container-side electrical connection unit 140 of the liquid container 100 are connected. First, a pair of the guiding projections 52*g* (FIG. 5) of the apparatus-side electrical connection unit 52 are inserted into the corresponding guiding recessed portions 147, and positioning of the substrate portion 141 of the container-side electrical connection unit 140 relative to the apparatus-side electrical connection unit 52 is performed. The terminal portions 52*t* of the apparatus-side electrical connection unit 52 are then inserted into the substrate arrangement portion 144 of the liquid container 100, and come into electrical contact with the corresponding terminals 142 of the substrate portion 141. When the connection between the liquid introducing outlet 131 and the liquid introducing portion 51 is complete, electrical connection between the container-side electrical connection unit 140 and the apparatus-side electrical connection unit 52 is established.

Before the pair of positioning portions 53*f* and 53*s* are inserted into the pair of receiving portions 150*f* and 150*s*, the apparatus-side fixing structure 54 of the connection receiving unit 50 is inserted into the internal space 211 of the projection portion 210 constituting the entrance of the groove portion 215 of the case 61. When the connection between the liquid introducing outlet 131 and the liquid introducing portion 51 is complete, the protrusion 54*p* of the apparatus-side fixing structure 54 engages with an engagement portion of the case-side fixing structure 220 (FIGS. 10 and 20) of the case 61 due to an engagement mechanism to be described later. A state where the position of the case 61 is fixed to the predetermined arrangement region LA in the case 61 (FIG. 3) in this manner is "the case-stored state where the case 61 is mounted to the case storage unit 60".

In the liquid container 100 of this embodiment, the container-side electrical connection unit 140 is positioned between the liquid introducing outlet 131 and the first receiving portion 150*f* in the X direction. Therefore, due to the pair of positioning portions 53*f* and 53*s* and the pair of receiving portions 150*f* and 150*s*, the positioning accuracy of the container-side electrical connection unit 140 in the X direction relative to the apparatus-side electrical connection unit 52, along with the liquid introducing outlet 131, is improved.

In addition, in the liquid container 100 of this embodiment, the recessed portion 160 that stores the internal space 211 that is the entrance portion of the case-side fixing structure 220 is positioned between the liquid introducing outlet 131 and the first receiving portion 150*f* in the X direction. Therefore, movement of the apparatus-side fixing structure 54 in the Y direction after the apparatus-side fixing structure 54 is inserted into the groove portion 215 is guided by the pair of positioning portions 53*f* and 53*s* and the pair of receiving portions 150*f* and 150*s*, and the positioning accuracy of the apparatus-side fixing structure 54 relative to the case-side fixing structure 220 is improved.

In addition, in the liquid container 100 of this embodiment, as described above, the container-side electrical connection unit 140 and the recessed portion 160 are provided between the liquid introducing outlet 131 and the first receiving portion 150*f*, and the distance in the X direction between the pair of receiving portions 150*f* and 150*s* increases by an amount that corresponds thereto. Therefore, the above-described positioning accuracy obtained using the pair of positioning portions 53*f* and 53*s* and the pair of receiving portions 150*f* and 150*s* is further improved.

As described above, in the liquid container 100 of this embodiment, the first opening portion 151*f* of the first receiving portion 150*f* and the second opening portion 151*s* of the second receiving portion 150*s* have different opening shapes. An opening width $W_2$ in the X direction of the second opening portion 151*s* is larger than an opening width $W_1$ in the X direction of the first opening portion 151*f*. With this configuration, there is some freedom in the angle between the Y direction and the horizontal direction of the second positioning portion 53*s* when the second positioning portion 53*s* is inserted into the second receiving portion 150*s*. Therefore, an operation of connecting the liquid container 100 to the connection receiving unit 50 is made easier. In addition, by providing such freedom, when connecting the liquid container 100 to the connection receiving unit 50, stress generated when the second positioning portion 53*s* is inserted into the second receiving portion 150*s* is reduced. Note that, in this embodiment, the opening width in the Z direction of the first opening portion 151*f* is substantially the same as that of the second opening portion 151*s*, but the opening width in the Z direction of the first opening portion 151*f* may be different from that of the second opening portion 151*s*.

Figure 26A:
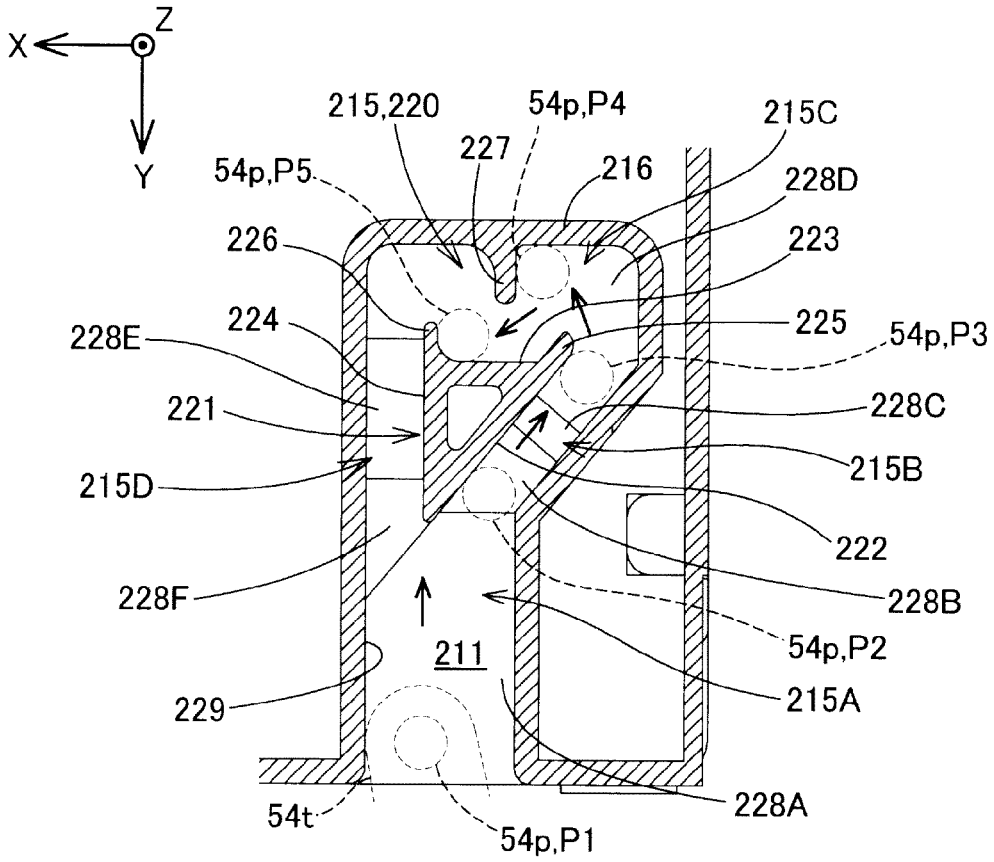
FIG. 26A is a schematic diagram for describing a mechanism for engaging an engaging portion with an engagement portion.
Figure 26B:
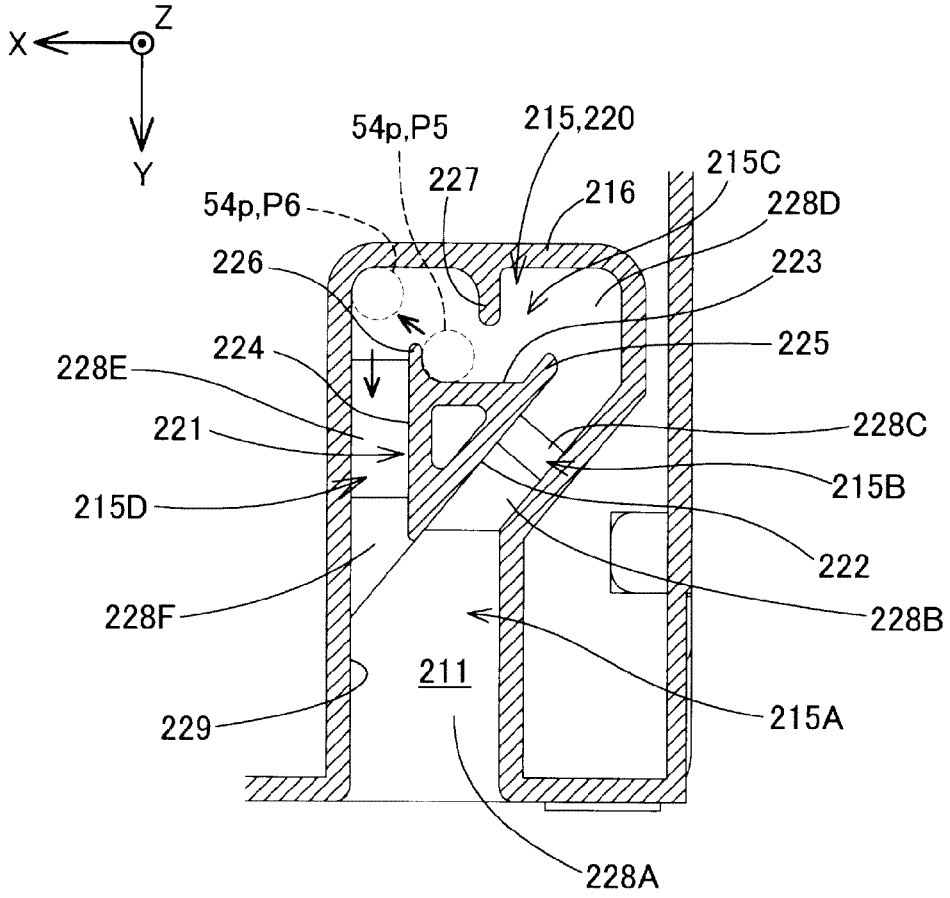
FIG. 26B is a schematic diagram for describing a mechanism for releasing an engagement state between the engaging portion and the engagement portion.

Mechanism for Engaging Apparatus-Side Fixing Structure with Case-Side Fixing Structure A mechanism for engaging the apparatus-side fixing structure 54 with the case-side fixing structure 220 of the case 61 will be described with reference to FIGS. 26A and 26B. FIG. 26A and FIG. 26B illustrate the case-side fixing structure 220 when viewed in the −Z direction. In addition, in FIGS. 26A and 26B, positions P1 to P6 of the protrusion 54*p* at different timings are indicated by broken lines in order to show the moving locus of the protrusion 54*p* of the apparatus-side fixing structure 54 inside the groove portion 215.

First, the configuration of the case-side fixing structure 220 will be described with reference to FIG. 26A. At the center of a recessed region on the −Y direction side relative to the internal space 211 of the projection portion 210, the case-side fixing structure 220 has a central projection portion 221 protruding in the +Z direction. When viewed in the Z direction, the outer periphery wall face of the central projection portion 221 constitutes an outer periphery outline having a substantially triangular shape. The central projection portion 221 is hollow.

The outer periphery wall face of the central projection portion 221 includes a first wall face 222, a second wall face 223, and a third wall face 224. The first wall face 222 extends in an oblique direction between the X direction and the Y direction. At least a portion of the first wall face 222 overlaps the internal space 211 in the Y direction. The second wall face 223 extends in the X direction, and intersects the first wall face 222. The third wall face 224 extends in the Y direction, and intersects the first wall face 222 and the second wall face 223. The third wall face 224 overlaps the internal space 211 of the projection portion 210 in the Y direction.

The central projection portion 221 has a first protruding wall portion 225 and a second protruding wall portion 226. As the end portion on the −X direction side of the second wall face 223, the first protruding wall portion 225 slightly extends from the second wall face 223 on the −Y direction side along a direction in which the first wall face 222 extends from the second wall face 223. The second protruding wall portion 226 is a wall portion functioning as an engagement portion. Hereinafter, the second protruding wall portion 226 may be referred to as an engagement portion 226. At the end portion on the +X direction side of the second wall face 223, the second protruding wall portion 226 slightly extends from the second wall face 223 on the −Y direction side along a direction in which the third wall face 224 extends.

The case-side fixing structure 220 further has a third protruding wall portion 227. The third protruding wall portion 227 is formed as a portion of the rib 216. At a position opposing the second wall face 223 of the central projection portion 221 in the Y direction, the third protruding wall portion 227 protrudes from the rib 216 in the +Y direction toward the second wall face 223.

For convenience of description, the groove portion 215 is divided into a first groove portion 215A, a second groove portion 215B, a third groove portion 215C, and a fourth groove portion 215D. The first groove portion 215A is a section that is formed by the internal space 211 and extends in the Y direction. The second groove portion 215B is a section that faces the first wall face 222, and extends in an oblique direction between the X direction and the Y direction. The third groove portion 215C includes a section facing the second wall face 223, and is a section formed so as to meander substantially in a zigzag in the X direction due to the three protruding wall portions 225 to 227. The fourth groove portion 215D is a section that faces the third wall face 224, and extends in the +Y direction toward the first groove portion 215A.

A first bottom face 228A that is the bottom face of the first groove portion 215A constitutes an inclined face extending in the −Y direction and gradually rising in the +Z direction. A second bottom face 228B that is the bottom face of a section coupled with the first groove portion 215A of the second groove portion 215B constitutes a substantially horizontal face. A third bottom face 228C positioned around the center of the second groove portion 215B constitutes an inclined face sunken from the second bottom face 228B in the −Z direction. A fourth bottom face 228D including the bottom face of an end portion section on the −Y direction side of the second groove portion 215B and the bottom face of the third groove portion 215C constitutes a substantially horizontal face. A fifth bottom face 228E that is the bottom face of the fourth groove portion 215D constitutes an inclined face rising from the fourth bottom face 228D in the +Z direction to the +Y direction side. A sixth bottom face 228F that is the bottom face between the first bottom face 228A and the fifth bottom face 228E constitutes a substantially horizontal face.

A mechanism until the second protruding wall portion 226 (the engagement portion 226) of the case-side fixing structure 220 is engaged with the protrusion 54*p* (engaging portion) of the apparatus-side fixing structure 54 will be described with reference to FIG. 26A. At the time when the tip end portion 54*t* of the apparatus-side fixing structure 54 is inserted into the first groove portion 215A in the −Y direction, the end face on the +X direction side of the tip end portion 54*t* comes into contact with a side wall face 229 on the +X direction side of the first groove portion 215A, and the protrusion 54*p* of the apparatus-side fixing structure 54 is positioned at a position separated from the side wall face 229 (P1). At this time, the apparatus-side fixing structure 54 is in a state of being further pivoted on the −X direction side than when an external force in a horizontal direction is not applied, since the end face of the tip end portion 54*t* is pressed in the −X direction by the side wall face 229. In a process of moving from the position P1 in the −Y direction, the protrusion 54*p* of the apparatus-side fixing structure 54 comes into contact with the first bottom face 228A that is an inclined face, and is pressed in the +Z direction by the first bottom face 228A.

When the liquid container 100 is further pressed in the +Y direction, the protrusion 54*p* of the apparatus-side fixing structure 54 is pressed in the +Z direction by the first bottom face 228A, and the tip end portion 54*t* of the apparatus-side fixing structure 54 is positioned on the +Z direction side relative to the end face on the +Z direction side of the rib 216, and is separated from the rib 216. The protrusion 54*p* of the apparatus-side fixing structure 54 then comes into contact with the first wall face 222, and rides over the horizontal second bottom face 228B (the position P2).

While being pressed on the −X direction side by the first wall face 222, the protrusion 54*p* of the apparatus-side fixing structure 54 moves along the first wall face 222 on the −Y direction side, goes down the second bottom face 228B, reaches the horizontal third bottom face 228C, and reaches a position at which the protrusion 54*p* comes into contact with the first protruding wall portion 225 (the position P3). After that, the protrusion 54*p* of the apparatus-side fixing structure 54 further moves in the −Y direction, and when the contact state with the first protruding wall portion 225 is released, instantaneously moves in the +X direction due to a biasing force applied to the apparatus-side fixing structure 54 toward the +X direction side, and collides with the third protruding wall portion 227 (the position P4). This collision generates a click sound.

Figure 25:
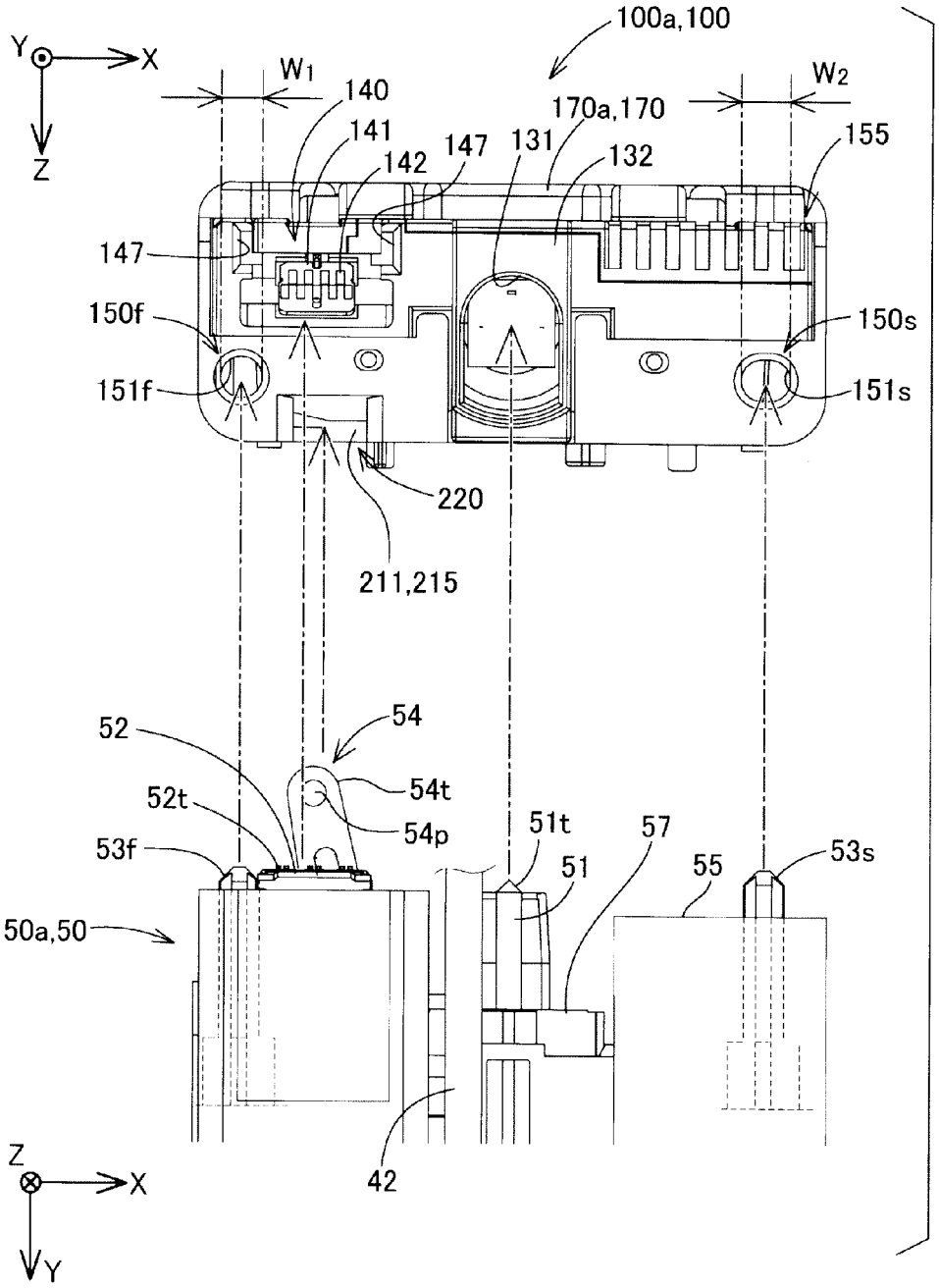
FIG. 25 is a schematic diagram for describing a mechanism for mounting a liquid container to the connection receiving unit.

When the user releases the force applied to the liquid container 100 and the case 61 in the +Y direction with the click sound serving as a signal, the liquid container 100 and the case 61 slightly move in the −Y direction due to a biasing force in the −Y direction of the base end member 57 (FIG. 25). Accordingly, the protrusion 54*p* of the apparatus-side fixing structure 54 moves along the third protruding wall portion 227 in the +Y direction, and the contact state between the protrusion 54*p* and the third protruding wall portion 227 is released. The protrusion 54*p* then instantaneously moves in the +X direction due to a biasing force applied to the apparatus-side fixing structure 54 toward the +X direction side, and collides with and is received by the second wall face 223 and the second protruding wall portion 226 (the position P5).

In this manner, at the position P5, the protrusion 54*p* of the apparatus-side fixing structure 54 is engaged with the second protruding wall portion 226 of the case-side fixing structure 220, and the second protruding wall portion 226 of the case-side fixing structure 220 and the protrusion 54*p* of the apparatus-side fixing structure 54 are engaged with each other. Hereinafter, the second protruding wall portion 226 may be referred to as an "engaging portion 226" in addition to "the engagement portion 226". Engagement between the second protruding wall portion 226 of the case-side fixing structure 220 and the protrusion 54*p* of the apparatus-side fixing structure 54 restricts movement of the case 61 in the −Y direction, and the case 61 is brought into the case-stored state of being mounted to the case storage unit 60. In this state, the protrusion 54*p* of the apparatus-side fixing structure 54 is in contact with the fourth bottom face 228D. As described above, the apparatus-side fixing structure 54 is biased in the −Z direction by an elastic member (not illustrated) arranged inside the connection receiving unit 50, and elastically pivots in the +Z direction upon receiving an external force in the +Z direction. This biasing force in the +Z direction is transmitted to the fourth bottom face 228D (FIG. 26A) via the protrusion 54*p*. Accordingly, in the case-stored state where the case 61 is mounted to the case storage unit 60, the protrusion 54*p* is in a state of applying a force to the case 61 in the −Z direction.

Here, in the case-stored state where the engagement portion 226 of the case-side fixing structure 220 is engaged with the engaging portion 54*p* of the apparatus-side fixing structure 54, the container-side electrical connection unit 140 is electrically connected to the apparatus-side electrical connection unit 52, and the container-side electrical connection unit 140 is in a state of receiving at least a force in the +Z direction from the apparatus-side electrical connection unit 52. With the liquid containers 100 of this embodiment, as described above, the recessed portion 160 and the container-side electrical connection unit 140 have a positional relationship in which the recessed portion 160 and the container-side electrical connection unit 140 at least partially overlap when viewed in the Z direction. The projection portion 210 of the case 61 is stored in the recessed portion 160. The internal space 211 of the projection portion 210 constitutes at least a portion of the case-side fixing structure 220. At least some of the force in the +Z direction received by the container-side electrical connection unit 140 from the apparatus-side electrical connection unit 52 is cancelled by the force in the −Z direction received by the case 61 from the protrusion 54*p*. Therefore, components in the Z direction of the force received by the liquid containers 100 on the +Y direction side is reduced, and deviation of the arrangement orientation in the Z direction of the liquid container 100 from envisioned appropriate orientation is suppressed. Therefore, deterioration of the arrangement orientation of the liquid container 100 relative to the connection receiving unit 50 is suppressed, and the connection state therebetween is improved. In addition, accompanied by deterioration of the arrangement orientation of the liquid container 100, generation of unnecessary stress in the connection section between the connection receiving unit 50 and the liquid container 100 is suppressed, and thus damage and deterioration of the above-described various constituent elements for connecting the connection receiving unit 50 and the liquid container 100 are suppressed.

A mechanism for releasing an engagement state between the case-side fixing structure 220 and the apparatus-side fixing structure 54 will be described with reference to FIG. 26B. In the liquid ejection apparatus 10 of this embodiment, as will be described below, in the above-described engagement state, the case-side fixing structure 220 and the apparatus-side fixing structure 54 are configured to release the engagement state when the case 61 is further pressed in the +Y direction. When the user presses the case 61 in the +Y direction, the protrusion 54*p* of the apparatus-side fixing structure 54 moves from the position P5 in the −Y direction, and is released from the state of being engaged with the second protruding wall portion 226 in the +X direction. Therefore, the protrusion 54*p* instantaneously moves in the +X direction due to a biasing force applied to the apparatus-side fixing structure 54 toward the +X direction side by the biasing member, and collides with the side wall face 229 on the +X direction side of the rib 216 (the position P6).

Accordingly, the protrusion 54*p* will be positioned at the fourth groove portion 215D, and thus movement in the +Y direction is allowed. Accordingly, the engagement state between the case-side fixing structure 220 and the apparatus-side fixing structure 54 is released. The above-mentioned click sound generated by the collision of the protrusion 54*p* with the rib 216 can inform the user that the engagement state between the case-side fixing structure 220 and the apparatus-side fixing structure 54 has been released. When movement of the protrusion 54*p* in the +Y direction is allowed, the liquid container 100 and the case 61 automatically moves in the −Y direction due to a force applied in the −Y direction by the base end member 57 (FIG. 25). After the base end member 57 is separated from the connection receiving unit 50, the liquid container 100 can be removed by the user pulling out the case 61. As is seen from the above description as well, the groove portion 215 forms a looped guiding path for guiding the protrusion 54*p*. The entrance and exit of the guiding path are the same. The guiding path is constituted by the engaging portion 226 that engages with the protrusion 54*p* provided midway, an entrance-side guide path and an exit-side guide path. The entrance-side guide path is a path portion from the above-mentioned entrance portion to the engaging portion 226. The exit-side guide path is a path portion from the engaging portion 226 to the above-mentioned exit portion.

Detailed Configuration and Functions of Guide Portions and Guiding Portions

Figure 27A:
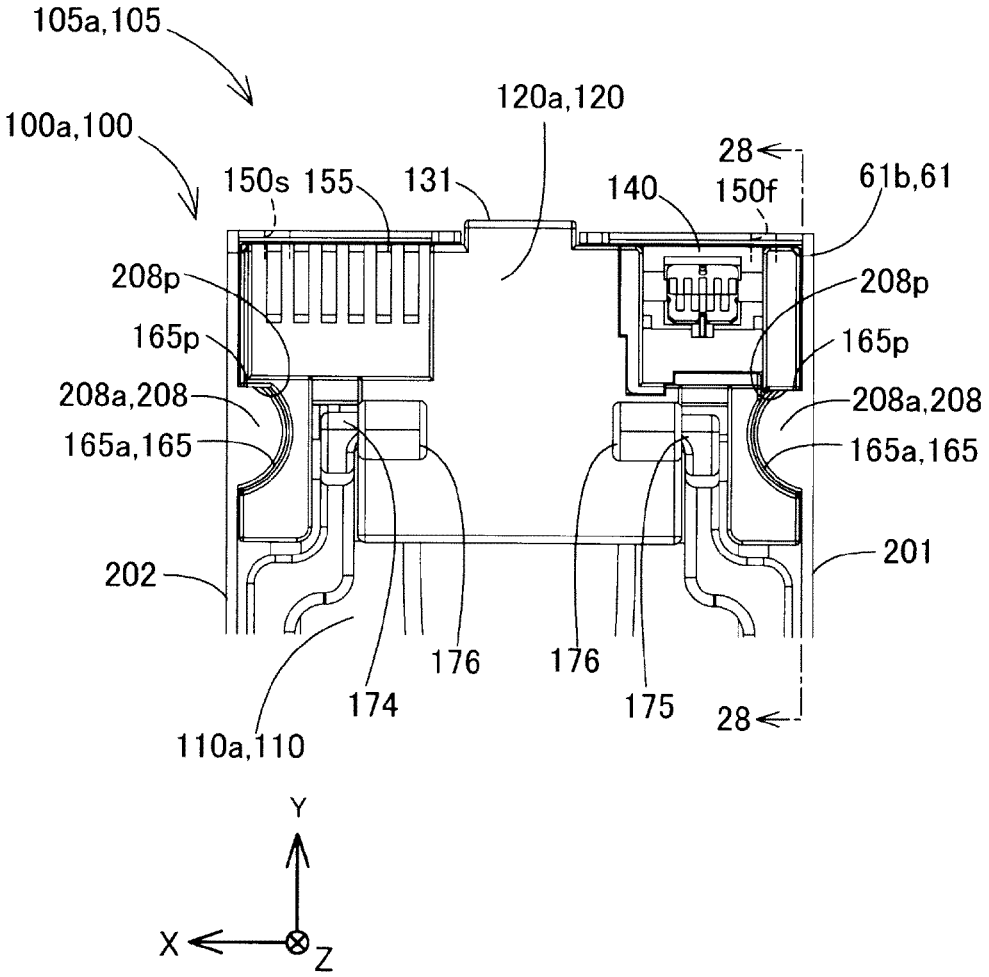
FIG. 27A is a schematic diagram of the first mounting body on the front end side in the mounting direction thereof when viewed in the +Z direction.
Figure 27B:
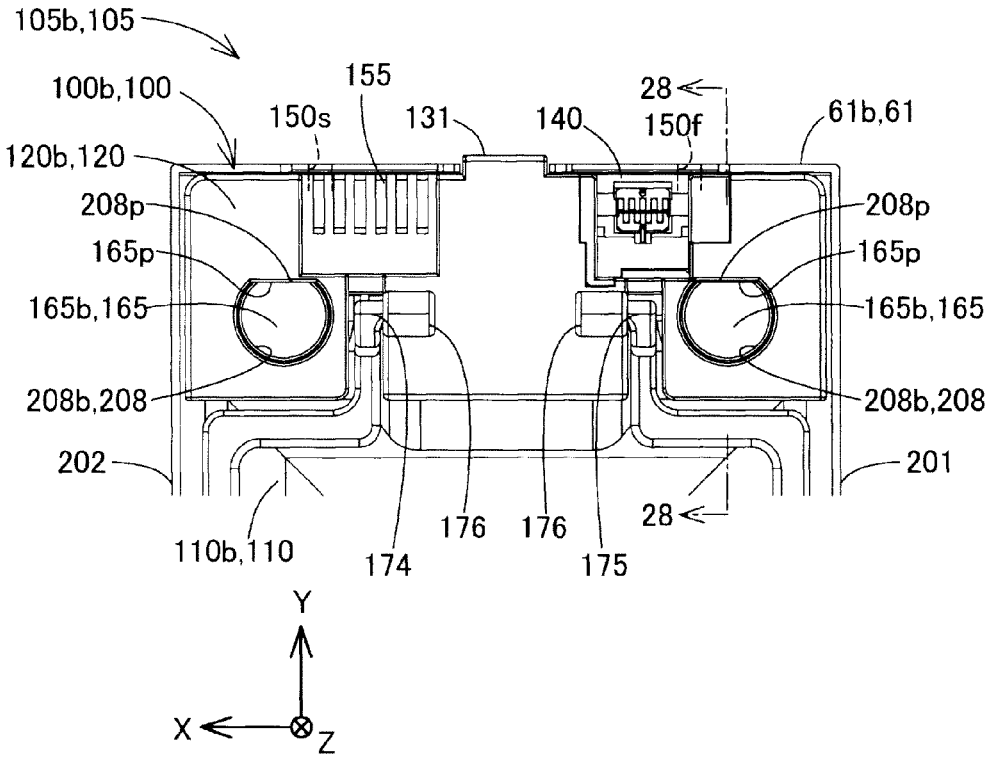
FIG. 27B is a schematic diagram of the second mounting body on the front end side in the mounting direction thereof when viewed in the +Z direction.
Figure 28:
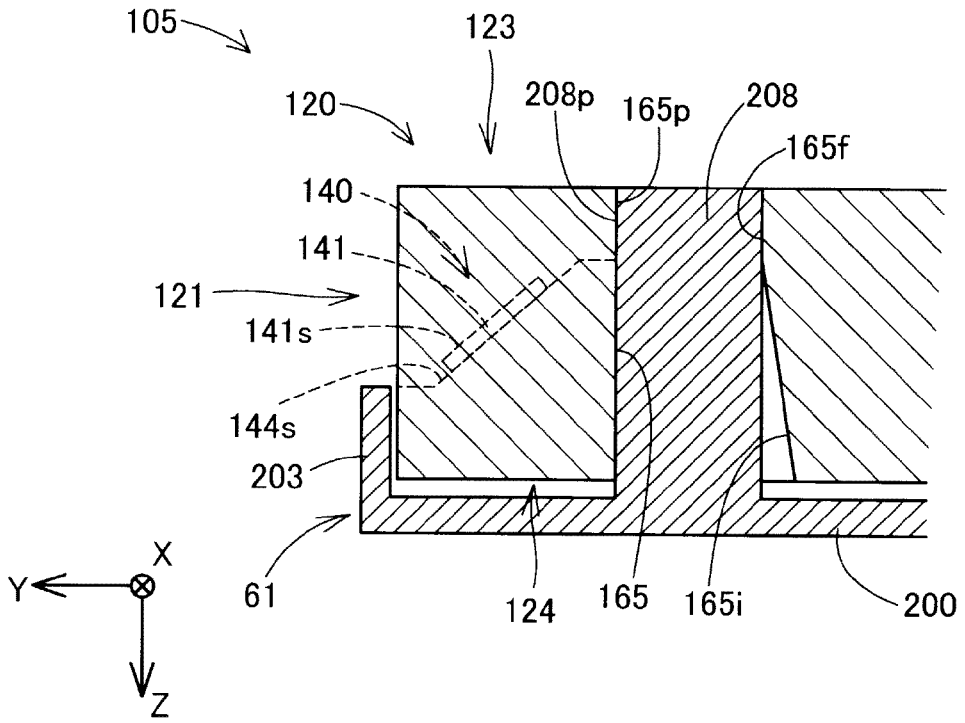
FIG. 28 is a schematic diagram schematically showing the cross-sectional structure of a mounting body.

FIGS. 27A, 27B, and 28 are referred to. FIG. 27A is a schematic diagram of the front end side in the mounting direction of the first mounting body 105*a* when viewed in the +Z direction. FIG. 27B is a schematic diagram of the front end side in the mounting direction of the second mounting body 105*b* when viewed in the +Z direction. FIG. 28 is a schematic diagram schematically showing the cross-sectional structure of the mounting body 105 in a 28-28 cross-section shown in FIGS. 27A and 27B. In FIG. 28, the arrangement region of the substrate portion 141 and the inclined face 144*s* on which the substrate portion 141 is arranged when viewed in the −X direction are indicated by broken lines.

As described above, in the mounting body 105, the two guide portions 165 are aligned in the X direction that is a longitudinal direction of the connection member 120 (FIGS. 27A and 27B). Therefore, on the case 61, pivotal movement of the liquid container 100 in a direction along the bottom face 200*s* of the bottom face wall portion 200 is suppressed. Therefore, deterioration of the connection state between the connection member 120 and the connection receiving unit 50 caused by orientation change of the liquid containers 100 is suppressed.

In this embodiment, the liquid introducing outlet 131 is positioned between the two guide portions 165 in the X direction. Therefore, in the liquid ejection apparatus 10, even if the orientation of the mounting body 105 changes causing deviation of the arrangement direction of the two guide portions 165 in the X direction, deviation of the liquid introducing outlet 131 relative to the liquid introducing portion 51 of the connection receiving unit 50 is suppressed. Therefore, deterioration of the connection state between the liquid introducing portion 51 and the liquid introducing outlet 131 caused by the orientation of the liquid container 100 changing is suppressed. In addition, the generation of stress at the contact section between the liquid introducing portion 51 and the liquid introducing outlet 131 caused by the orientation changing is suppressed, and thus damage and deterioration of the liquid introducing portion 51 and the liquid introducing outlet 131 are suppressed.

In this embodiment, the container-side electrical connection unit 140 is positioned between the two guide portions 165 in the X direction. Therefore, in the liquid ejection apparatus 10, even if the orientation of the mounting body 105 changes causing deviation of the arrangement direction of the two guide portions 165 in the X direction, deviation of the container-side electrical connection unit 140 relative to the apparatus-side electrical connection unit 52 of the connection receiving unit 50 is suppressed. Therefore, deterioration of the connection state between the apparatus-side electrical connection unit 52 and the container-side electrical connection unit 140 caused by the orientation change of the liquid container 100 is suppressed. In addition, generation of stress in the contact section between the apparatus-side electrical connection unit 52 and the container-side electrical connection unit 140 caused by the orientation changing is suppressed, and thus damage and deterioration of the apparatus-side electrical connection unit 52 and the container-side electrical connection unit 140 are suppressed.

Furthermore, in this embodiment, in the X direction, the container-side electrical connection unit 140 is positioned between one guide portion 165 on the −X direction side out of the two guide portions 165 and the liquid introducing outlet 131. Therefore, positioning of the container-side electrical connection unit 140 is performed at three points, namely, the two guide portions 165 and the liquid introducing outlet 131, and thus pivot of the arrangement orientation of the liquid container 100 relative to the apparatus-side electrical connection unit 52 is further suppressed. Therefore, deterioration of the connection state between the apparatus-side electrical connection unit 52 and the container-side electrical connection unit 140 is further suppressed.

Particularly, in this embodiment, the two guide portions 165 are arranged on the −Y direction side relative to the liquid introducing outlet 131. Accordingly, the liquid introducing outlet 131 is arranged at a position separated from a virtual straight line that connects the two guide portions 165, and the liquid introducing outlet 131 and the two guide portions 165 are arranged to be separated from each other in two directions, namely, the X and Y directions. Therefore, the stability of the arrangement orientation of the liquid container 100 being supported at the three points, namely, by the two guide portions 165 and the liquid introducing outlet 131 is improved, and the positioning accuracy of the container-side electrical connection unit 140 is further improved. In addition, the two guide portions 165 are arranged on the −Y direction side relative to the container-side electrical connection unit 140. Therefore, when connecting the container-side electrical connection unit 140 to the apparatus-side electrical connection unit 52, the container-side electrical connection unit 140 is supported by the guiding portions 208 fitted in the guide portions 165 in the −Y direction side. Therefore, deviation in the Y direction of the container-side electrical connection unit 140 caused by a load received from the apparatus-side electrical connection unit 52 is suppressed. In this embodiment, the liquid introducing outlet 131 and the container-side electrical connection unit 140 are gathered on the connection member 120 at the end portion on the +Y direction side, and thus the size of the connection member 120 can be reduced. In addition to that, connection of the liquid introducing outlet 131 to the liquid introducing portion 51 and connection of the container-side electrical connection unit 140 to the apparatus-side electrical connection unit 52 are made easier.

In this embodiment, the container-side electrical connection unit 140 is provided at a position closer to the guide portion 165 on the −X direction side than the center in the X direction of the liquid container 100. Therefore, positioning of the arrangement position of the container-side electrical connection unit 140 on the case 61 is performed highly accurately due to positioning of the liquid container 100 relative to the case 61 performed by the guiding portions 208 being fitted in the guide portions 165. Therefore, the connectability between the container-side electrical connection unit 140 and the apparatus-side electrical connection unit 52 is improved. In this embodiment, the container-side electrical connection unit 140 is provided at a position separated from the liquid introducing outlet 131 in the X direction, and is provided at a position separated from the two guide portions 165 in the Y direction. Accordingly, the substrate arrangement portion 144 of the container-side electrical connection unit 140 can be provided so as not to interfere with the liquid introducing outlet 131 and the guide portions 165 in the connection member 120, and the size of the connection member 120 can be reduced.

In this embodiment, the bag-shaped member 110 is arranged on the −Y direction side relative to the two guide portions 165, and the liquid introducing outlet 131 and the container-side electrical connection unit 140 are arranged at positions separated from the storage portion 115 of the bag-shaped member 110, sandwiching the two guide portions 165. Therefore, a force pulling the connection member 120 on the −Y direction side, which is caused by the load of a liquid stored in the bag-shaped member 110, is inhibited from being transmitted to the liquid introducing outlet 131 and the container-side electrical connection unit 140 due to the support by the guiding portions 208 respectively fitted in the guide portions 165. Also, deformation and change in orientation of the bag-shaped member 110 accompanied by liquid consumption is inhibited from affecting the connection site between the liquid introducing outlet 131 and the liquid introducing portion 51 as well as the connection site between the container-side electrical connection unit 140 and the apparatus-side electrical connection unit 52. Therefore, generation of continuous stress at those connection sites is suppressed, and deformation, deterioration, and the like due to creep in connection parts are suppressed. In addition, deterioration of the connection states at those connection sites is suppressed.

In this embodiment, the two guide portions 165 are formed spanning the entire connection member 120 in the thickness direction in the Z direction thereof, and the guiding portions 208 are respectively arranged inside the entirety of the corresponding guide portions 165 in the thickness direction thereof (FIG. 28). Therefore, when a load is received from the above-described bag-shaped member 110, the flat face portion 165*p* of the guide portion 165 and the flat face portion 208*p* of the guiding portion 208 are likely to come into contact with each other. Therefore, the stability of the arrangement position of the liquid container 100 is improved. Also, orientation change that causes pivot of the liquid container 100 on the case 61 in a direction separated from the case 61 is suppressed.

In this embodiment, when viewed in the Y direction, each of the two receiving portions 150*f* and 150*s* are provided at positions at least partially overlapping one of the two guide portions 165 (FIGS. 27A and 27B). Accordingly, the positioning accuracy of the connection member 120 of the mounting body 105 relative to the connection receiving unit 50 can be improved. Therefore, the connectability between the liquid introducing outlet 131 and the liquid introducing portion 51 as well as the connectability between the container-side electrical connection unit 140 and the apparatus-side electrical connection unit 52 are further improved.

In this embodiment, as described above, the two guide portions 165 are provided as recessed portions (including through hole) of the connection member 120 (FIGS. 13 and 23). Therefore, the user visually recognizes the positions of the two guide portions 165 with ease. Also, the user can recognize the positions of the two guide portions 165 by touching the two guide portions 165 and using their tactile sense. In this manner, the two guide portions 165 have a shape that allows the user to easily grasp the positions thereof, and thus when mounting the liquid container 100 to the case 61, the user can easily perform positioning of the liquid container 100 relative to the case 61 with the two guide portions 165 serving as marks.

In this embodiment, the guiding portions 208 of the case 61 are fitted into the guide portions 165 merely by being inserted into the guide portions 165 in the Z direction. Therefore, the operation of mounting the liquid container 100 to the case 61 is simplified.

In this embodiment, the guide portions 165*a* are provided so as to pass through the connection member 120 in the Z direction from the third face portion 123 to the fourth face portion 124 (FIG. 28). Accordingly, when arranging the liquid container 100 in the case 61, it is possible to visually recognize the positions of the guiding portions 208 on the case 61 in the +Z direction through internal spaces of the guide portions 165. Therefore, the operation of arranging the liquid container 100 on the case 61 is made easier, and the mountability of the liquid container to the case is improved.

Here, as described above, in this embodiment, the terminals 142 of the container-side electrical connection unit 140 are pressed by the terminal portions 52*t* (FIG. 5) of the apparatus-side electrical connection unit 52 in the +Z direction as well, in addition to the −Y direction. In addition, in the mounting body 105 of this embodiment, the upper end portions of the guiding portions 208 are positioned above the terminals 142 of the substrate portion 141. Therefore, pivot of the connection member 120 caused by being pressed in the +Z direction by the terminal portions 52*t* of the apparatus-side electrical connection unit 52 is suppressed by the contact between the upper end portions of the guiding portions 208 and the guide portions 165.

In addition, in this embodiment, an engaging portion 165*f* in which the entire internal wall face of the guide portion 165 is in face contact with the outer peripheral side face of the guiding portion 208 is provided in the upper end portion of the guide portion 165 (FIG. 28). This further improves the accuracy of positioning of the liquid container 100 on the case 61 performed by the guide portions 165 and the guiding portions 208. In addition, the engaging portion 165*f* is positioned above the terminals 142 of the substrate portion 141, and thus pivot of the connection member 120 caused by the above-described pressing on the +Z direction side by the terminal portions 52*t* of the apparatus-side electrical connection unit 52 is further suppressed. Furthermore, in this embodiment, the engaging portion 165*f* has the flat face portion 165*p* directed in the +Y direction, and when the connection member 120 receives a load in the −Y direction, the flat face portion 165*p* is supported through being in contact with the flat face portion 208*p* of the guiding portion 208. Therefore, pivot of the connection member 120 caused by being pressed by the terminal portions 52*t* of the apparatus-side electrical connection unit 52 is further suppressed.

In this embodiment, the guide portion 165 has an inclined face 165*i* directed in the +Z direction, at an end portion section on the +Z direction side that is the end portion on the entrance side where the guiding portion 208 is inserted (FIG. 28). In this embodiment, the inclined face 165*i* is positioned on the −Y direction side relative to the flat face portion 165*p*, and extends downward from the engaging portion 165*f*. In a state where the guiding portions 208 are fitted in the guide portion, the inclined face 165*i* faces the side face of the inserted guiding portion 208 165. By having the inclined face 165*i*, the opening area of the guide portion 165 at a section below the engaging portion 165*f*, in a cross section along the X and Y directions, increases downward. Accordingly, the upper end of the guiding portion 208 is smoothly guided to the engaging portion 165*f* of the guide portion 165, and thus the operation of mounting the liquid container 100 to the case 61 is made easier.

In addition, by having the inclined face 165*i*, the guide portion 165 and the guiding portion 208 are brought into a state of being locally fitted at the engaging portion 165*f* at the upper end. Therefore, the engagement state between the guide portion 165 and the guiding portion 208 can be easily released, and the operation of removing the liquid container 100 from the case 61 is made easier. Besides, for example, even if an unexpected shock force is applied to the mounting body 105 from the outside due to the mounting body 105 or the like being dropped, the engagement state between the guide portion 165 and the guiding portion 208 is quickly released, and thus the shock force applied to the mounting body 105 can be decentralized, and damage and breakage of the liquid container 100 are suppressed.

In this embodiment, regarding the guide portion 165 and the guiding portion 208, the substantial entireties of the flat face portions 165*p* and 208*p* are in face contact with each other in the Z direction. Therefore, even if the liquid container 100 on the case 61 receives a load applied in the −Y direction, the position of the liquid container 100 is unlikely to fluctuate.

Combination of First liquid Container and Second Case

Figure 29:
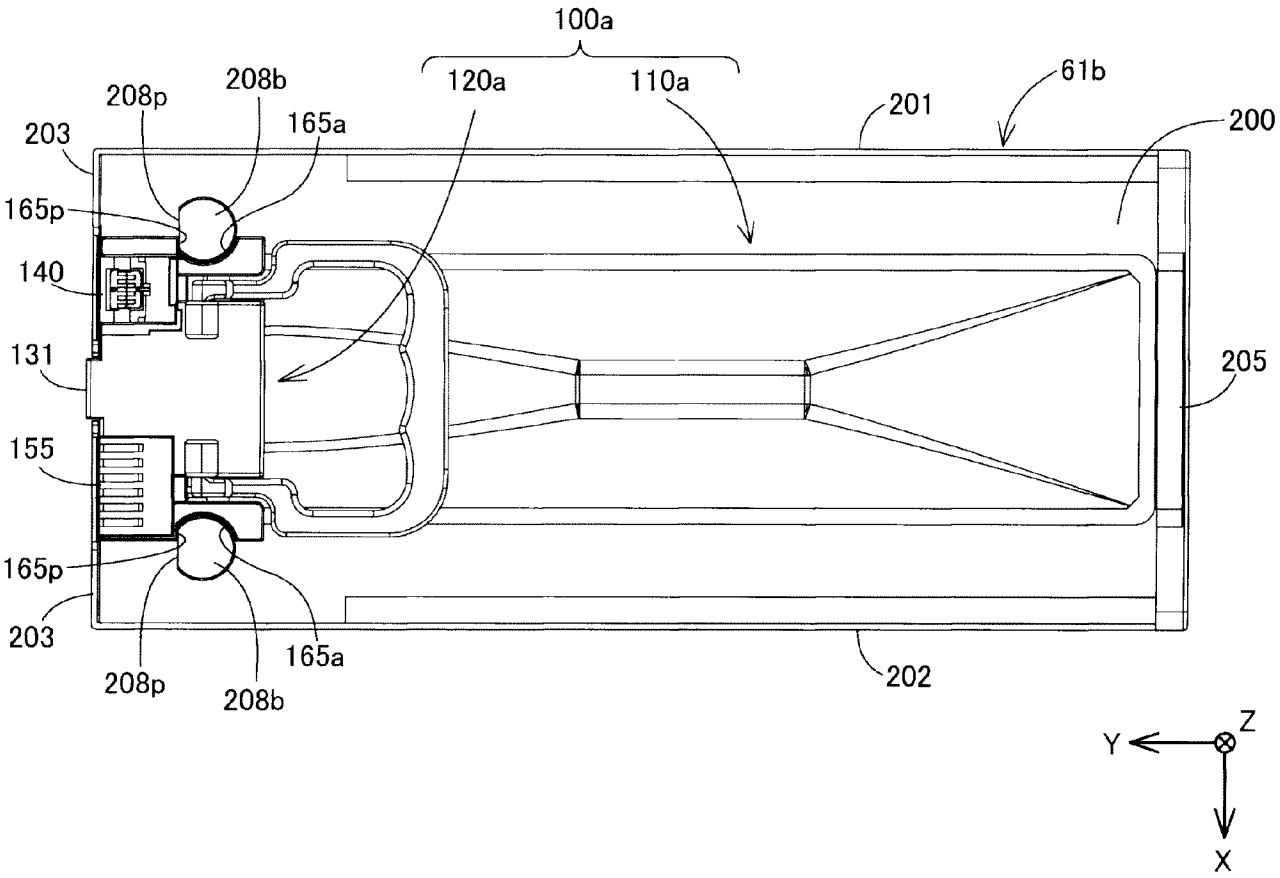
FIG. 29 is a schematic diagram showing the first liquid container arranged in the second case.

FIG. 29 is a schematic diagram of the first liquid container 100*a* in a state of being arranged in the second case 61*b*, when viewed in the +Z direction. In this embodiment, regarding the first connection member 120*a* of the first liquid container 100*a*, the arrangement layout of each of the constituent elements for connection to the connection receiving unit 50 substantially coincides with that of the second connection member 120*b* of the second liquid container 100*b*. In addition, as described above, the two guide portions 165*b* of the second connection member 120*b* are respectively provided at positions corresponding to the guide portions 165*a* of the first connection member 120*a*, and have a section whose shape coincides with the shape of the guide portions 165*a* of the first connection member 120*a*. Therefore, the first liquid container 100*a* can be mounted to the second case 61*b* configured to fit with the second connection member 120*b* of the second liquid container 100*b*. When the first liquid container 100*a* is mounted to the second case 61*b*, portions of the two guiding portions 208*b* of the second case 61*b* are fitted in the guide portions 165*a* of the first connection member 120*a*. Accordingly, positioning of the first liquid container 100*a* on the second case 61*b* is performed.

Fixing Structure of Bag-Shaped Member in Connection Member

Figure 30:
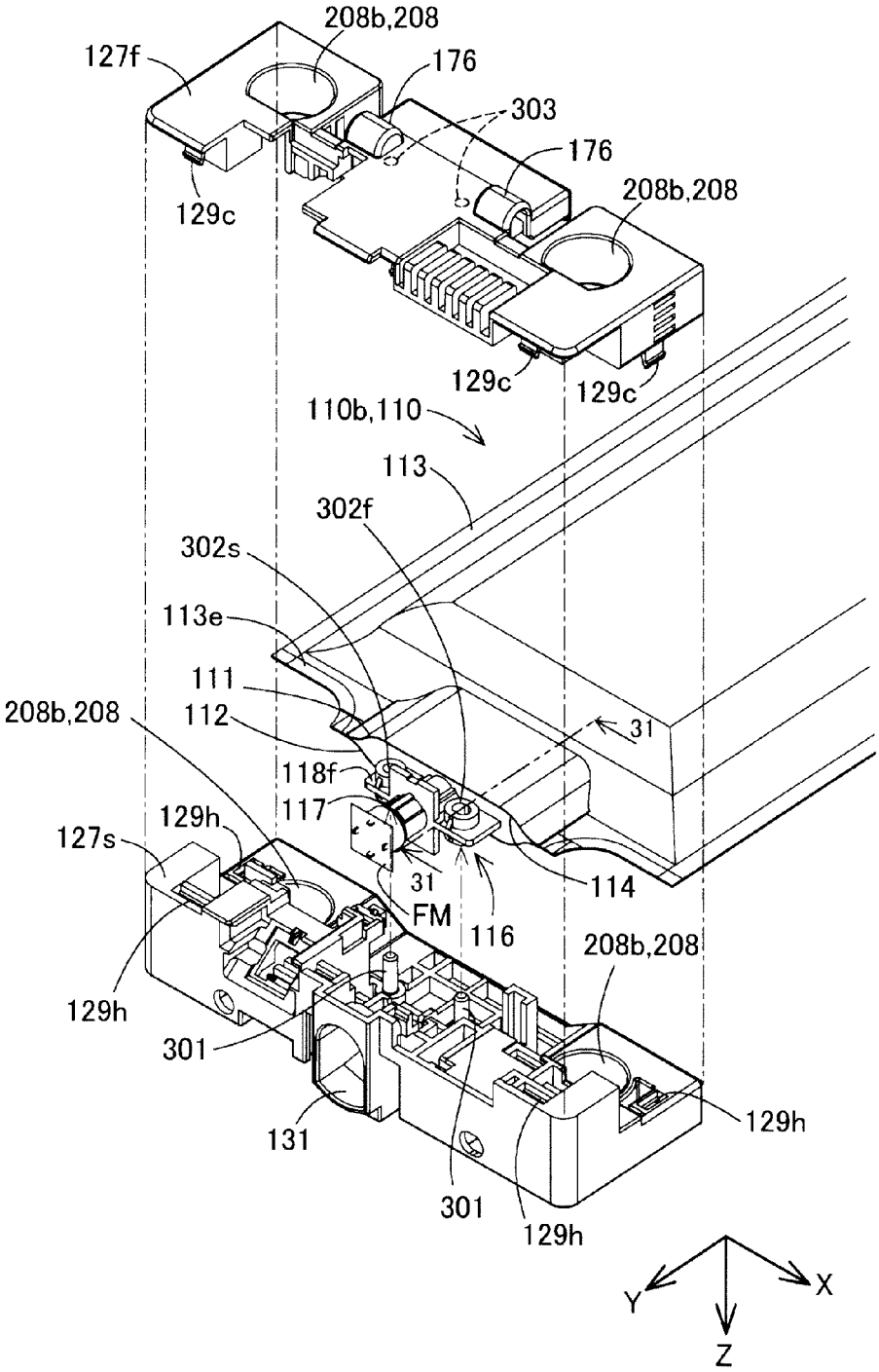
FIG. 30 is an exploded perspective diagram of the liquid container.
Figure 31:
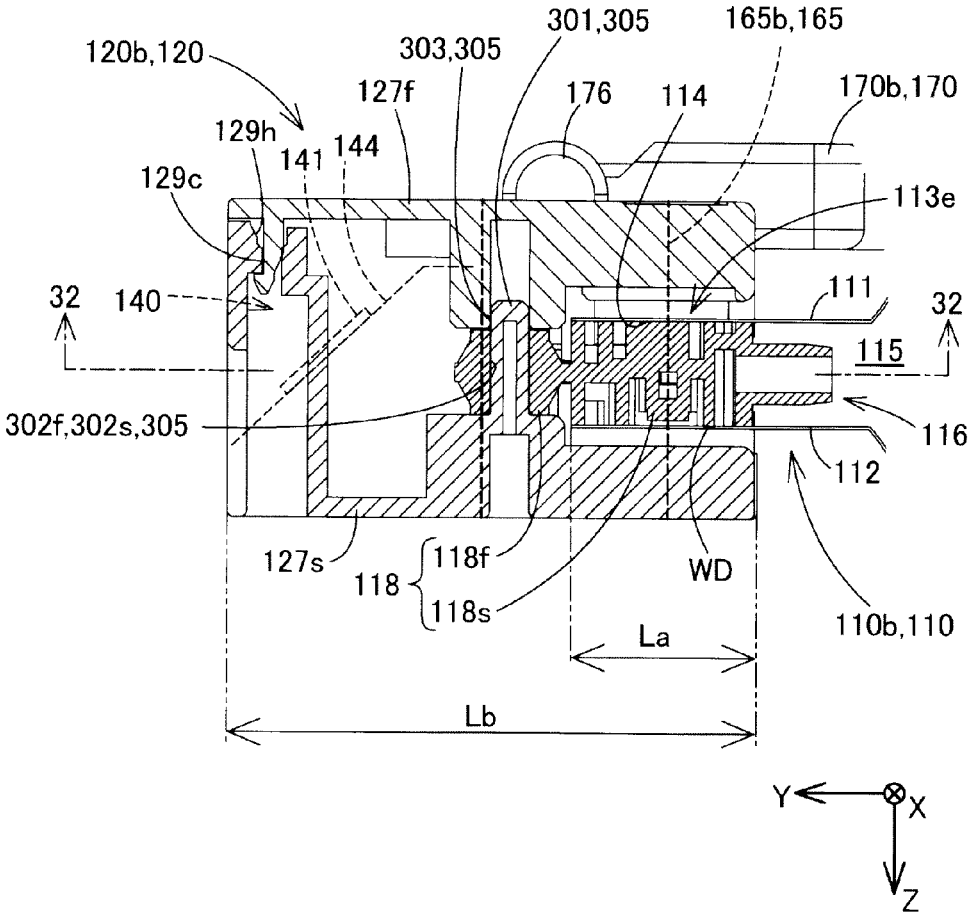
FIG. 31 is a first schematic cross-sectional diagram of the connection member.
Figure 32:
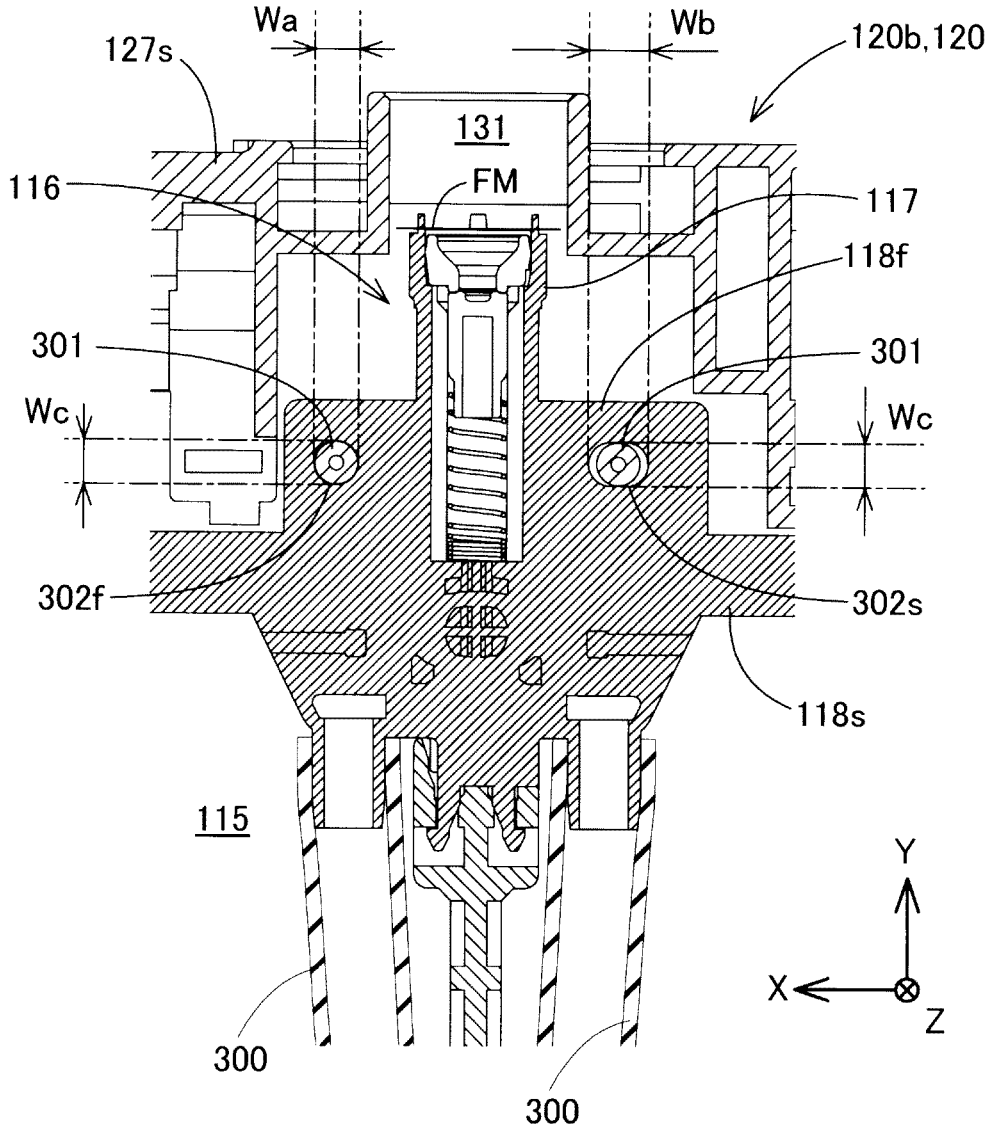
FIG. 32 is a second schematic cross-sectional diagram of the connection member.

The fixing structure of the bag-shaped member 110 in the connection member 120 of the liquid container 100 will be described in detail with reference to FIGS. 30 to 33B. FIG. 30 is a schematic exploded perspective diagram of the liquid container 100 and shows a state where the first member 127*f* and the second member 127*s* of the connection member 120 are separated. FIG. 31 is a first schematic cross sectional diagram of the connection member 120 in a 31-31 cross-section shown in FIG. 30. FIG. 32 is a second schematic cross-sectional diagram of the connection member 120 in a 32-32 cross-section shown in FIG. 31. FIGS. 30 to 32 illustrate the configuration of the second liquid container 100*b*, but the following description is common to the first liquid container 100*a* and the second liquid container 100*b*.

The connection member 120 has a configuration acquired by overlapping and coupling the first member 127*f* and the second member 127*s* in the Z direction (FIG. 30). The first member 127*f* has a plurality of claw portions 129*c* protruding downward in the +Z direction. The second member 127*s* has engaging holes 129*h* corresponding to the claw portions 129*c*. The first member 127*f* and the second member 127*s* are coupled to each other by the claw portions 129*c* being respectively engaged with the corresponding engaging holes 129*h*. When coupled to each other, the first member 127*f* and the second member 127*s* sandwich and hold, in the Z direction, a tip end portion 113*e* on the +Y direction side of the outer peripheral end portion 113 of the bag-shaped member 110.

The tip end portion 113*e* of the bag-shaped member 110 is provided with a supply port 114, which is an opening portion communicating with the storage portion 115 (FIGS. 30 and 31). The supply port 114 is, in the outer peripheral end portion 113 of the bag-shaped member 110, a section in which the first sheet member 111 and the second sheet member 112 are not joined. The supply port member 116 constituting a fluid flow passage for allowing the liquid introducing outlet 131 and the supply port 114 to communicate with each other is inserted into the supply port 114 of the bag-shaped member 110.

The supply port member 116 is manufactured by molding a resin member of polypropylene or the like. The supply port member 116 has a pipe portion 117 (FIG. 30) and a connection main body portion 118 (FIG. 31). The pipe portion 117 (FIG. 30) is a tubular section extending in the Y direction at the center of the supply port member 116 in the X direction, and the opening end portion on the +Y direction side thereof is connected to the liquid introducing outlet 131 of the connection member 120. A film member FM is adhered to the opening portion on the +Y direction side of the pipe portion 117 to seal the opening portion. When the liquid introducing portion 51 is connected to the liquid introducing outlet 131, the liquid introducing portion 51 passes through the film member FM, and is connected to the opening portion of the pipe portion 117.

The connection main body portion 118 is a section provided on the −Y direction side of the pipe portion 117 (FIGS. 30 and 31). The fluid flow passage that is connected to the pipe portion 117 and extends in the Y direction is provided inside the connection main body portion 118 (not illustrated). The connection main body portion 118 has a first fixing portion 118*f* and a second fixing portion 118*s*. The first fixing portion 118*f* is a section arranged outside the bag-shaped member 110, and coupled and fixed to the connection member 120 (FIGS. 30 and 31). The second fixing portion 118*s* is a section arranged inside the bag-shaped member 110, and fixed to the bag-shaped member 110 (FIG. 31). The second fixing portion 118*s* is joined to the inner periphery face of the supply port 114 of the bag-shaped member 110 in an air-tight manner (FIGS. 30 and 31). The tubular member 300 that is arranged inside the storage portion 115, and is for guiding the liquid in the storage portion 115 to outside of the bag-shaped member 110 is connected to the end portion on the −Y direction side of the second fixing portion 118*s* (FIG. 32).

Two protrusions 301 are provided on the upper face of the second member 127*s* (FIG. 30). The two protrusions 301 are shaft-like sections extending in the −Z direction. In this embodiment, the two protrusions 301 have a substantially columnar shape. When viewed in the Y direction, the two protrusions 301 are provided at positions sandwiching the liquid introducing outlet 131 and the pipe portion 117 in the X direction (FIG. 32).

The first fixing portion 118*f* of the connection main body portion 118 is provided with two through ports 302*f* and 302*s* passing through the first fixing portion 118*f* in the Z direction (FIG. 30). The two through ports 302*f* and 302*s* are arranged in the X direction. The fluid flow passage connected to the pipe portion 117 is provided between the two through ports 302*f* and 302*s* (FIG. 32). A corresponding one of the two protrusions 301 of the second member 127*s* is inserted into each of the through ports 302*f* and 302*s* (FIG. 30). The protrusion 301 on the +X direction side is inserted into the first through port 302*f*, and the protrusion 301 on the −X direction side is inserted into the second through port 302*s*.

On the lower face of the first member 127*f*, two holes 303 into which the protrusions 301 are respectively fitted are provided at positions corresponding to the two protrusions 301 of the second member 127*s*. In FIG. 30, the positions at which the two holes 303 are formed are illustrated using broken lines. When the first member 127*f* and the second member 127*s* are coupled, the upper end portions of the two protrusions 301 of the second member 127*s* passing through the above-described two through ports 302*f* and 302*s* in the first fixing portion 118*f* are fitted in the two holes 303 of the first member 127*f* (FIG. 31). Accordingly, the bag-shaped member 110 is fixed to the connection member 120. Hereinafter, the two protrusions 301 of the second member 127*s*, the two through ports 302*f* and 302*s* of the supply port member 116, and the two holes 303 of the first member 127*f* are also collectively referred to as a "fixing structure 305" for fixing the bag-shaped member 110 to the connection member 120 (FIG. 31).

In this manner, in the liquid container 100 of this embodiment, the tip end portion 113*e* that has the supply port 114 of the bag-shaped member 110 is sandwiched between and held by the first member 127*f* and the second member 127*s* that constitute the connection member 120, in the Z direction. This suppresses deviation of the supply port 114 relative to the connection member 120, and deterioration of the connection state of the liquid supply path between the liquid ejection apparatus 10 and the liquid container 100. In addition, the bag-shaped member 110 can be fixed to the connection member 120 through a process for coupling the first member 127*f* and the second member 127*s* in the Z direction, and thus assembly of the bag-shaped member 110 is made easier.

In the connection member 120 of this embodiment, the entirety of the supply port member 116 attached to the bag-shaped member 110 is covered by the first member 127*f* and the second member 127*s* constituting the main body portion of the connection member 120, and the protection performance of the supply port member 116 is improved. In the connection member 120 of this embodiment, the two protrusions 301 and the two through ports 302*f* and 302*s* constituting the fixing structure 305 for fixing the bag-shaped member 110 are arranged in the X direction, sandwiching the fluid flow passage in the supply port member 116. This suppresses deviation of the connection member 120 and the bag-shaped member 110 rotating relative to each other in the X direction. Deviation between the liquid introducing outlet 131 of the connection member 120 and the fluid flow passage of the supply port member 116 is also suppressed, and deterioration of the communication state of the liquid supply flow passage in the connection member 120 is suppressed. Furthermore, in the connection member 120 of this embodiment, the two protrusions 301 for fixing the supply port member 116 extend in the Z direction over the first member 127*f* and the second member 127*s*. This improves the strength of the fixing structure 305 for fixing the supply port member 116, and further suppresses deviation of the supply port member 116 in the connection member 120.

As described above, in this embodiment, in the supply port 114 of the bag-shaped member 110, the supply port member 116 is welded to the sheet members 111 and 112 in the second fixing portion 118*s*. A length La in the Y direction of a welding region WD in the second fixing portion 118*s* is smaller than a length Lb in the Y direction of the connection member 120 (FIG. 31). The entirety of the welding region WD is covered by the connection member 120. Accordingly, the welding region WD is protected by the connection member 120, and the sheet members 111 and 112 are inhibited from being stripped off from the supply port member 116.

In FIG. 31, the arrangement position of the substrate portion 141 in the container-side electrical connection unit 140 is illustrated with broken lines. In this embodiment, the container-side electrical connection unit 140 is provided on the +Y direction side relative to the supply port 114. Therefore, as described above, the substrate arrangement portion 144 can be provided as a recessed portion sunken in the +Z direction without interfering with the bag-shaped member 110, and the substrate portion 141 can be arranged at a position where at least a portion thereof overlaps the supply port 114 in the Y direction. Therefore, the thickness in the Z direction of the connection member 120 can be reduced correspondingly, and the size of the connection member 120 can be reduced.

In this embodiment, the container-side electrical connection unit 140 is provided at a position on the +Y direction side separated relative to the fixing structure 305 of the supply port member 116. Therefore, for example, even if the liquid container 100 receives an unexpected shock or the like, and the fixing structure 305 of the supply port member 116 is broken, the breakage is inhibited from affecting the container-side electrical connection unit 140. Therefore, the protection performance for the substrate portion 141 is improved.

In this embodiment, the two through ports 302*f* and 302*s* provided in the first fixing portion 118*f* of the supply port member 116 have different opening widths in the X direction (FIG. 32). The opening width here refers to the maximum value of the opening width in the X direction. An opening width Wb in the X direction of the second through port 302*s* is larger than an opening width Wa in the X direction of the first through port 302*f*. Accordingly, the insertion angle of the protrusion 301 in the X direction when inserting the protrusion 301 corresponding to the second through port 302*s* can have some freedom. Therefore, after the protrusion 301 corresponding to the first through port 302*f* is inserted and a reference position is determined, the corresponding protrusion 301 can be easily inserted into the second through port 302*s*. Therefore, a process for attaching the bag-shaped member 110 to the second member 127*s* is made easier, and an assembly process for fixing the bag-shaped member 110 to the connection member 120 is made easier. In addition, due to the fixing structure 305 having such freedom, stress generated in the fixing structure 305 is reduced when assembling the connection member 120, and deterioration of the fixability of the bag-shaped member 110 in the connection member 120 is suppressed. Note that in this embodiment, opening widths We in the Y direction of the first through port 302*f* and the second through port 302*s* are substantially equal to the diameter in the Y direction of the protrusion 301. However, the opening widths in the Y direction of the first through port 302*f* and the second through port 302*s* may be different from each other.

Figure 33A:
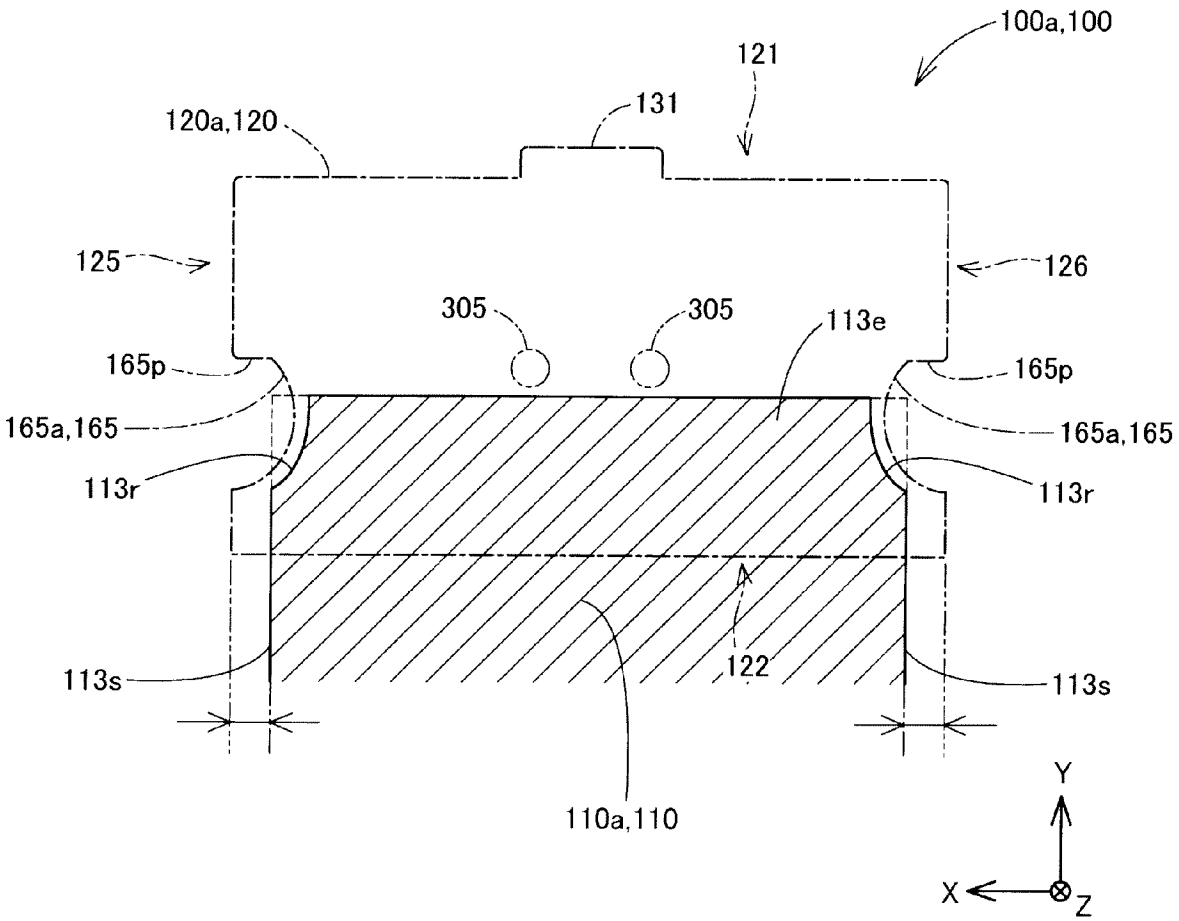
FIG. 33A is a schematic diagram showing the arrangement position of a bag-shaped member relative to a connection member of the first liquid container.
Figure 33B:
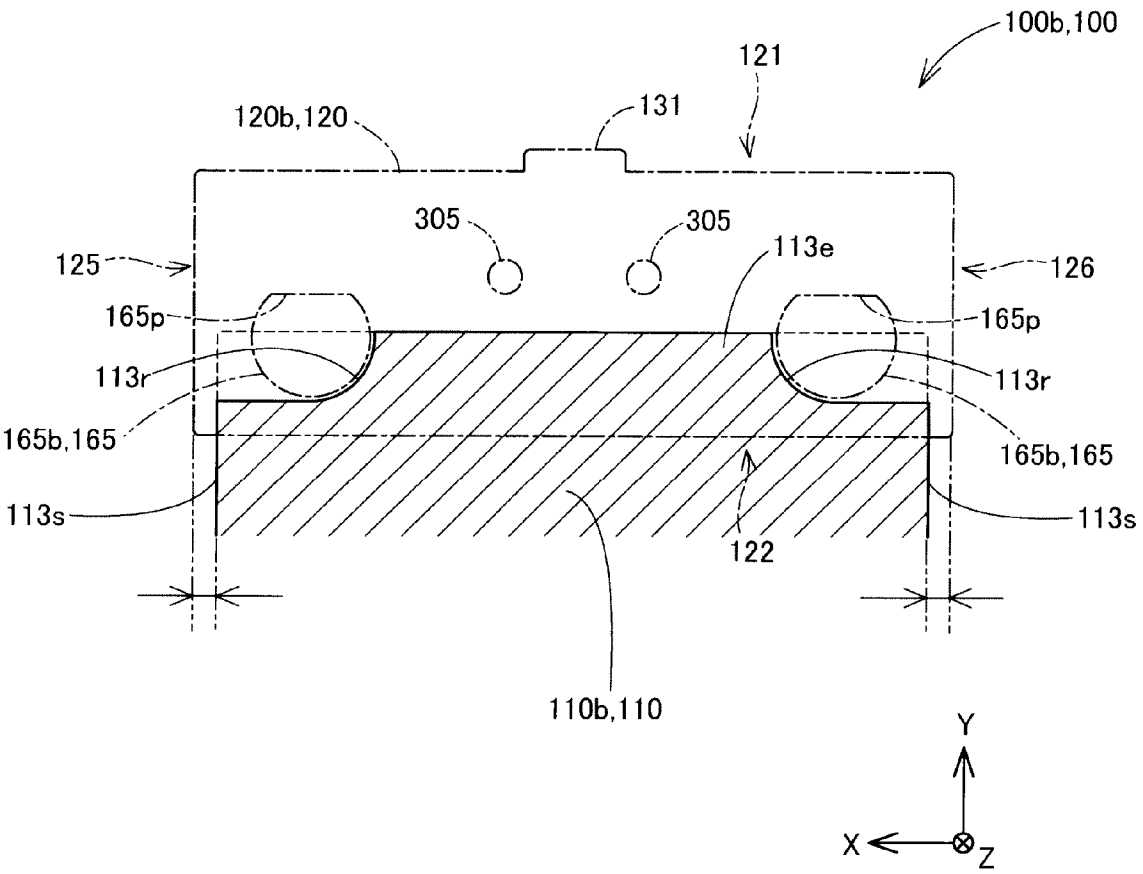
FIG. 33B is a schematic diagram showing the arrangement position of the bag-shaped member relative to a connection member of the second liquid container.

FIGS. 33A and 33B are schematic diagrams for describing the position of the tip end portion 113*e* of the bag-shaped member 110 in the connection member 120. FIG. 33A is a diagram related to the first liquid container 100*a*, and FIG. 33B is a diagram related to the second liquid container 100*b*. In FIGS. 33A and 33B, the outlines of the connection members 120*a* and 120*b* when viewed in the +Z direction are illustrated using dashed-dotted lines, and the arrangement regions of the bag-shaped members 110*a* and 110*b* are indicated by hatching diagonal lines, respectively. Also, in FIG. 33A, the position of the above-described fixing structure 305 for fixing the bag-shaped member 110*a* to the connection member 120*a* is illustrated using dashed double-dotted lines, and in 33B, the position of the above-described fixing structure 305 for fixing the bag-shaped member 110*b* to the connection member 120*b* is illustrated using dashed double-dotted lines.

In this embodiment, the tip end portion 113*e* of the bag-shaped member 110 is provided at a position where it is sandwiched between the two guide portions 165 in the connection member 120. When viewed in the X direction, the tip end portion 113*e* of the bag-shaped member 110 is at a position overlapping the two guide portions 165. Accordingly, for example, when a shock is applied to the mounting body 105 in the X direction or the like, the tip end portion 113*e* of the bag-shaped member 110 held in the connection member 120 is supported by the guide portions 165 in the X direction. Therefore, the shock resistance properties of the liquid containers 100 are improved.

In this embodiment, when viewed in the X direction, the fixing structure 305 for fixing the tip end portion 113*e* of the bag-shaped member 110 is provided at a position overlapping the two guide portions 165. Accordingly, the tip end portion 113*e* of the bag-shaped member 110 is supported against the above-described shock force in the X direction by the fixing structure 305 in addition to the above-described guide portions 165 and the guiding portions 208. Therefore, the shock resistance properties of the liquid container 100 are further improved.

In this embodiment, side end portions 113*s* of the bag-shaped member 110 are positioned inward of the fifth face portion 125 and the sixth face portion 126 of the connection member 120 in the X direction. As a result of the side end portions 113*s* of the bag-shaped member 110 not extending outside of the connection member 120 in the X direction, the protection performance for the side end portions 113*s* of the bag-shaped member 110 is improved. In this embodiment, when the liquid container 100 is viewed in the Y direction, at least a portion of the bag-shaped member 110 overlaps the guide portions 165. Accordingly, deviation in the +Y direction of the bag-shaped member 110 in the connection member 120 is suppressed.

In this embodiment, in order to inhibit the two corner portions on the +Y direction side of the bag-shaped member 110 from interfering with the guide portions 165, the bag-shaped member 110 has a shape in which the corner portions have been cut off. Accordingly, at the end portion on the +Y direction side in the side end portions 113*s* of the bag-shaped member 110, sunken portions 113*r* sunken in a direction from the guide portions 165 toward the bag-shaped member 110 are respectively formed along the inner periphery faces of the two guide portions 165. In FIGS. 33A and 33B, the shape before the corner portions are cut off is illustrated using broken lines.

By providing the sunken portions 113*r* as described above, the corner portions of the bag-shaped member 110 are not obstructive when fixing the bag-shaped member 110 to the connection member 120, and thus assembly of the liquid container 100 is made easier. In addition, at the sunken portions 113*r*, the tip end portion 113*e* and the side end portions 113*s* of the bag-shaped member 110 can be arranged in proximity to the guide portions 165. Therefore, the outer peripheral end portion 113 of the bag-shaped member 110 can be held by the connection member 120. Accordingly, the bag-shaped member 110 can be protected by the connection member 120. The sunken portions 113*r* are formed by welding the supply port member 116 to the supply port 114 of the bag-shaped member 110, then identifying the positions of the guide portions 165 based on the positions of the two through ports 302*f* and 302*s* in the supply port member 116, and cutting away the welding portions of the bag-shaped member 110.

Configuration of Container

Figure 34:
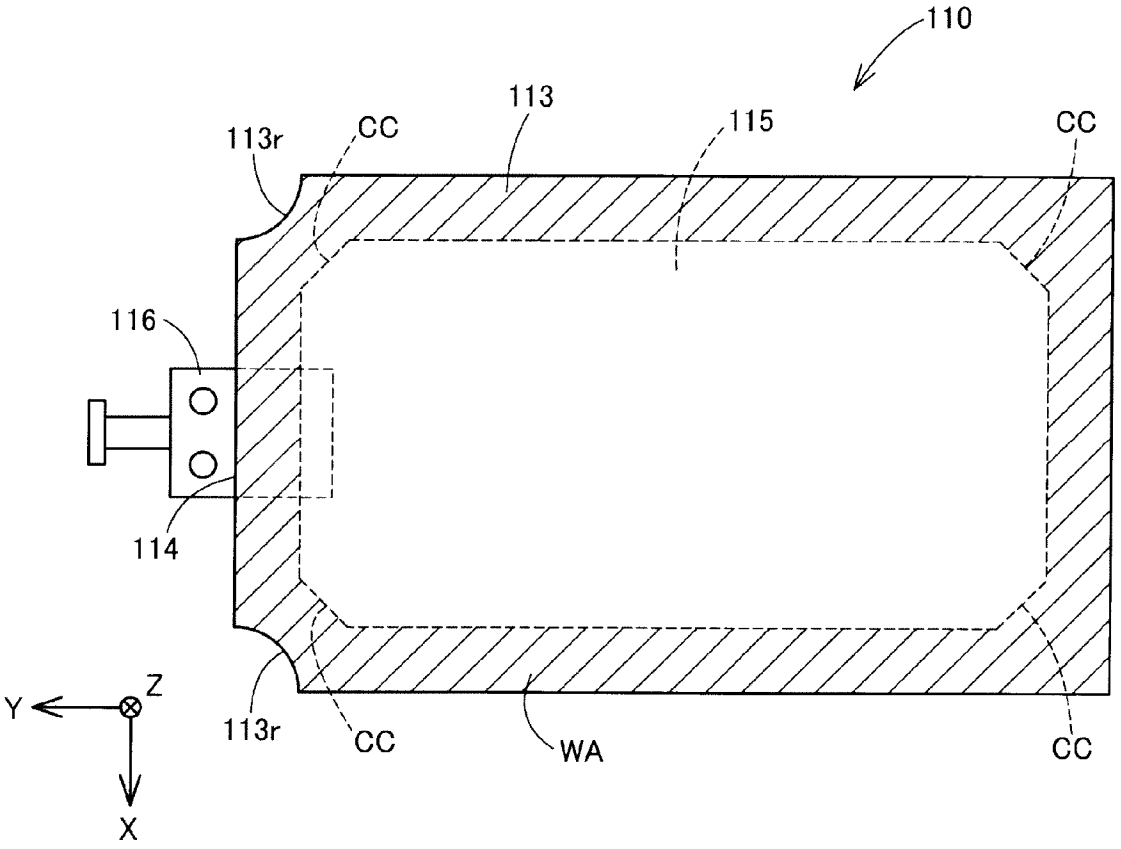
FIG. 34 is a schematic diagram for describing the configuration of a storage portion inside the bag-shaped member.

The configuration of the storage portion 115 inside the bag-shaped member 110 will be described with reference to FIG. 34. FIG. 34 schematically shows the bag-shaped member 110 when viewed in the +Z direction. In FIG. 34, a welding region WA in the outer peripheral end portion of the bag-shaped member 110 is illustrated using hatching lines. The welding region WA is formed along the outer peripheral end portion 113 of the bag-shaped member 110, and the storage portion 115 is formed as a region surrounded by the welding region WA. The welding region WA desirably has inclined connection portions CC such that the four corners of the storage portion 115 do not form right angles. Specifically, the welding region WA desirably has, at the four corners of the storage portion 115, sections increasing in size toward the center of the storage portion 115. Due to the storage portion 115 having the connection portions CC in this manner, when the liquid in the storage portion 115 is consumed in the liquid ejection apparatus 10, the liquid is inhibited from remaining at the four corners of the storage portion 115. Note that in the storage portion 115, if at least one connection portion CC is formed, such an effect can be acquired. In addition, the connection portion CC may be formed in a curved line instead of a straight line.

Detailed Configuration/Functions of Handle

Figure 35:
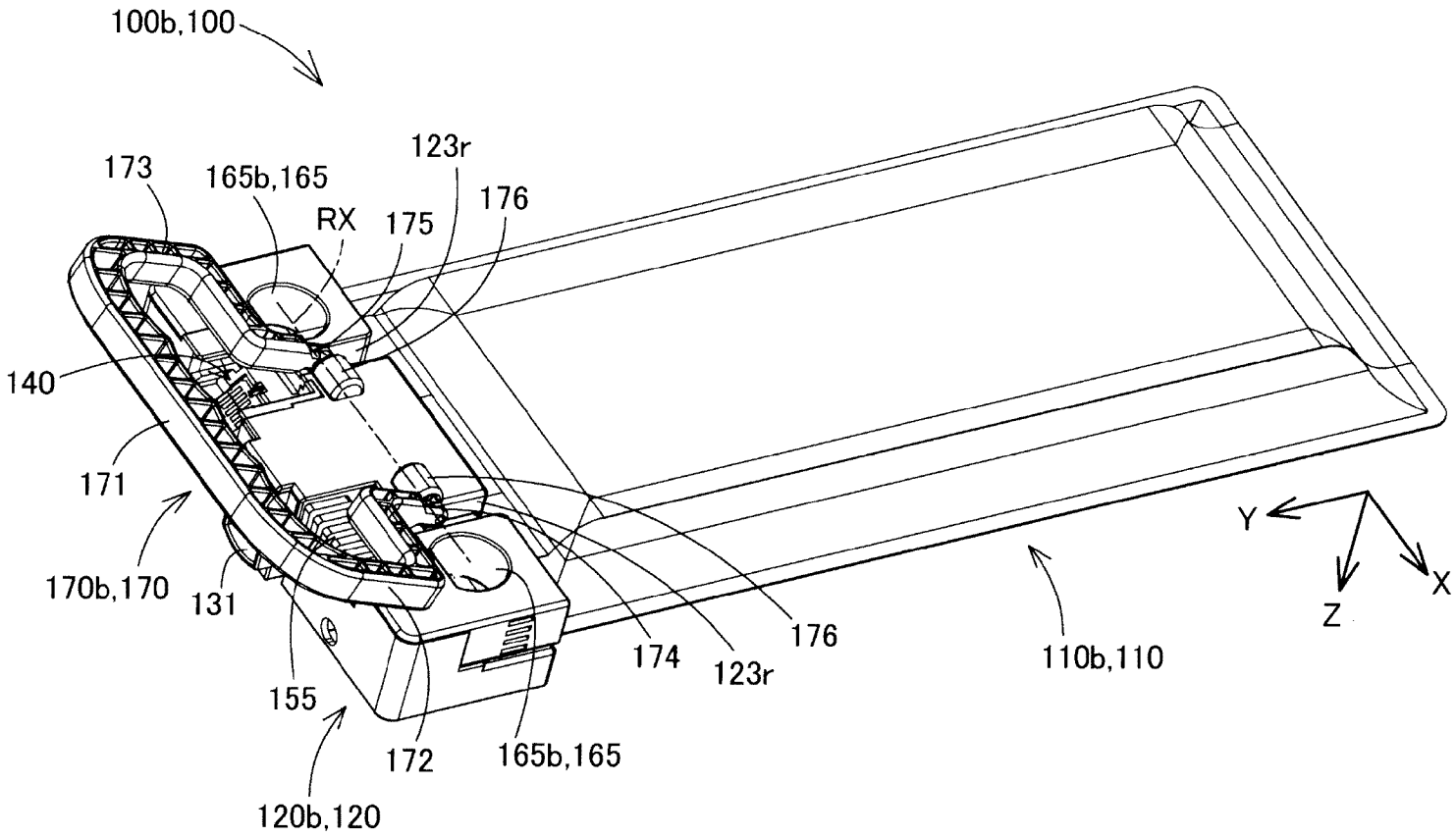
FIG. 35 is a schematic perspective diagram showing the first liquid container when a handle is in a second orientation.
Figure 36:
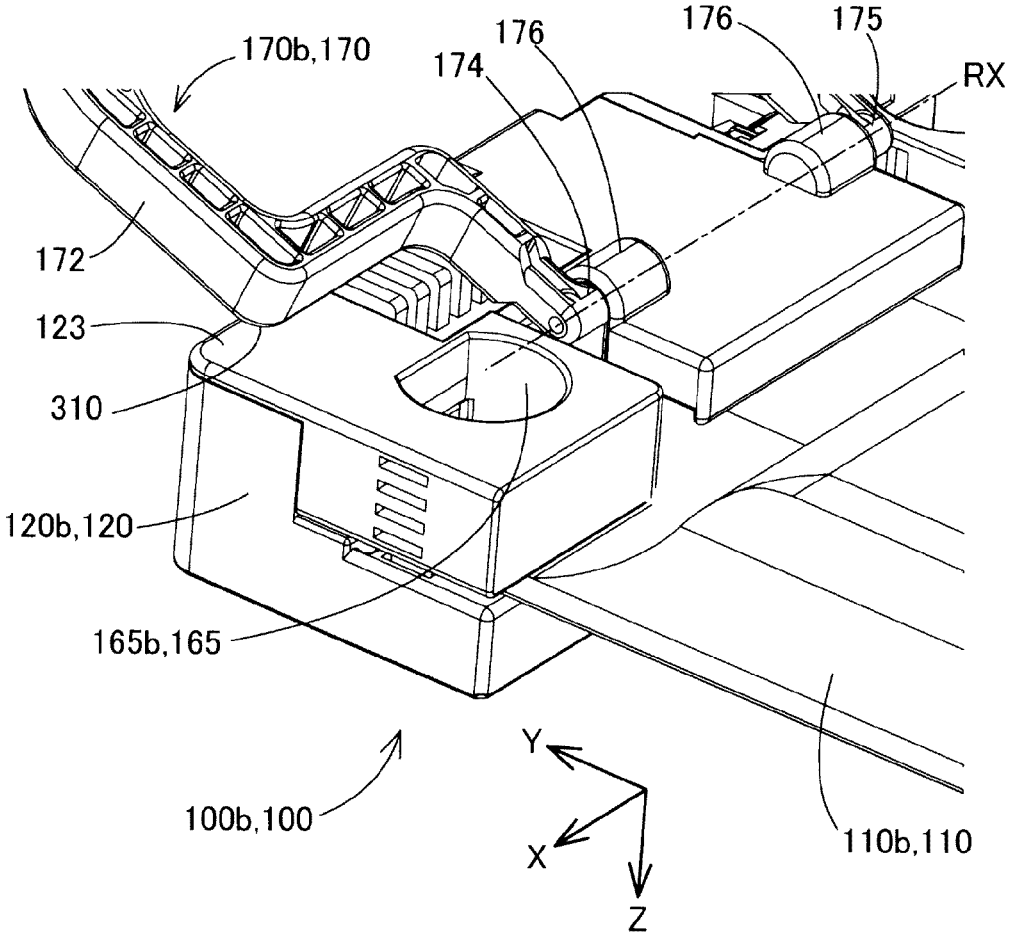
FIG. 36 is a schematic diagram showing the vicinity of a base end portion of the handle in the second orientation among others.
Figure 37:
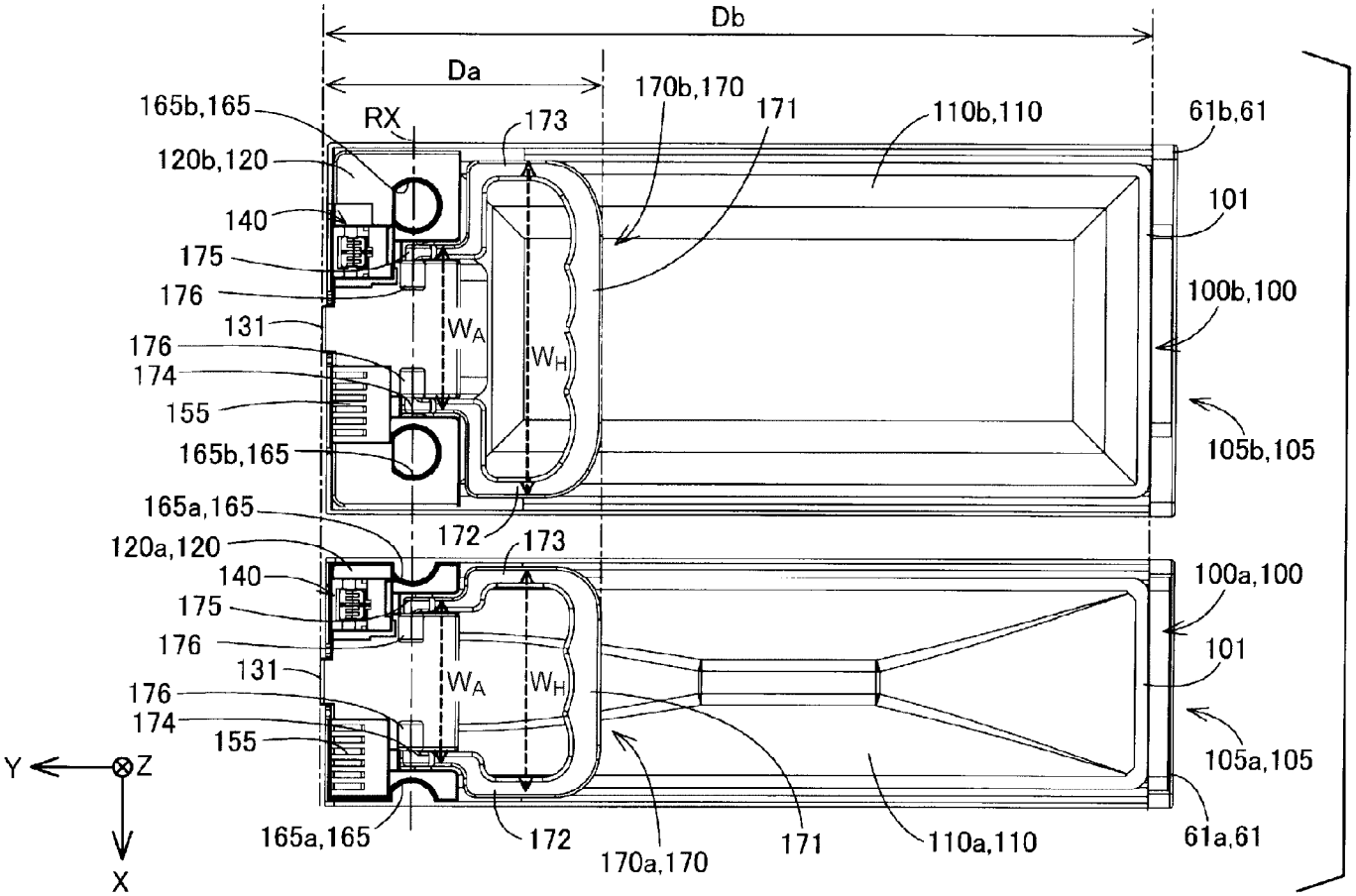
FIG. 37 is a schematic diagram showing the mounting body when the handle is in a first orientation.

The configuration and functions of the handle 170 will be described in detail with reference to FIGS. 35 to 37. FIG. 35 is a schematic perspective diagram showing the second liquid container 100*b* when the handle 170*b* is in the second orientation. Note that in the first liquid container 100*a* as well, in the second orientation, the handle 170*a* is in an orientation similar to that of the handle 170*b* shown in FIG. 35. FIG. 36 is a schematic diagram showing the vicinity of the second base end portion 175 of the handle 170*b* in the second orientation among others. FIG. 37 is a schematic diagram of two types of mounting bodies, namely, the mounting bodies 105*a* and 105*b* when viewed in the +Z direction when the handles 170*a* and 170*b* are in the first orientation. The following description is common to the handle 170*a* of the first liquid container 100*a* and the handle 170*b* of the second liquid container 100*b*, unless specifically stated otherwise.

As described above, when the liquid container 100 is transported or the like, the handle 170 is brought from the first orientation of being tilted on the bag-shaped member 110 side into the second orientation of being upright by being pivoted toward the connection member 120 (FIG. 35). The handle 170 is provided on the connection member 120 positioned at the end portion on the +Y direction side of the liquid container 100. Therefore, when the user holds the handle 170 to move the liquid container 100, the orientation of the liquid container 100 becomes stable in an orientation in which the liquid container 100 is hung on the bag-shaped member 110 side on which the centroid of the liquid container 100 is positioned. Therefore, the handleability of the liquid container 100 is improved, and mounting to/removing from the case 61 is made easier.

In this embodiment, when the handle 170 is in the second orientation, portions of the coupling portions 172 and 173 come into contact with the connection member 120 in the pivot direction of the handle 170, and stops the handle 170 (FIG. 36). The handle 170 stops in a state where the grip portion 171 is positioned above the fixing portions 176. The contact sections of the handle 170 on the connection member 120 at this time function as restriction portions 310 that restrict pivot of the handle 170. The restriction portions 310 are on the opposite side to the bag-shaped member 110 with the pivot axis RX of the handle 170 therebetween. Shaking of the liquid container 100 when the user holds the handle 170 is suppressed by having the restriction portions 310, and thus the orientation of the liquid container 100 in the second orientation can be further stabilized. Note that the centroid of the liquid container 100 is desirably positioned on the bag-shaped member 110 side relative to the pivot axis RX when viewed from the restriction portions 310. Accordingly, by abutting the handle 170 on the restriction portions 310 when the user holds the handle 170 and hang the liquid containers 100, shaking of the bag-shaped member 110 can be suppressed, and shaking of the liquid in the bag-shaped member 110 can be suppressed.

In this embodiment, the handle 170 in the second orientation overlaps the container-side electrical connection unit 140 in the Z direction, and is held at a position separated from the container-side electrical connection unit 140 (FIG. 36). Therefore, when handling the liquid container 100, the container-side electrical connection unit 140 is covered and protected by the handle 170 in the second orientation.

As described above, in this embodiment, the base end portions 174 and 175 of the handle 170 are provided between the two guide portions 165 in the X direction, and the user easily understands the positions of the guide portions 165 based on the position of the handle 170 (FIG. 35). Therefore, the operation of mounting/removing the liquid container 100 to/from the case 61 using the handle 170 is simplified. In addition, positioning of the liquid container 100 when arranging the liquid container 100 in the case 61 is made easier.

In the liquid container 100 of this embodiment, in the first orientation, the grip portion 171 of the handle 170 is arranged at a position protruding from the connection member 120 toward the bag-shaped member 110 on the −Y direction side (FIG. 37). Therefore, when the handle 170 is in the first orientation, the user can easily grip the grip portion 171. When the handle 170 is in the second orientation, the grip portion 171 of the handle 170 is arranged at a position protruding from the connection member 120 on the +Y direction side opposite to the bag-shaped member 110 (FIG. 35). Therefore, also when the handle 170 is in the second orientation, the user can easily grip the grip portion 171. Particularly, in this embodiment, in the second orientation, the handle 170 is tilted further upward than the horizontal direction, and thus the grip portion 171 is positioned at a position where it can be more easily gripped by the user. In this manner, in the liquid container 100, both in the first orientation and the second orientation, the grip portion 171 of the handle 170 is positioned at a position where it can be easily gripped by the user. Therefore, operations of the handle 170 become easy, and the operation of mounting/removing the liquid container 100 from/to the case 61 is made easier.

In this embodiment, in the first orientation, the liquid introducing outlet 131 and the container-side electrical connection unit 140 are arranged at such positions as not to overlap the handle 170 in the Z direction (FIG. 37). In addition, the fitting structure receiving portion 155 is also arranged at a position not overlapping the handle 170 in the Z direction. Therefore, with the connection member 120 of this embodiment, the third face portion 123 of the connection member 120 can be provided with recessed portions 123*r* (FIGS. 15 and 35) that can store at least a portion of the handle 170 in the first orientation. In this embodiment, when the handle 170 is in the first orientation, portions of the coupling portions 172 and 173 are stored in the recessed portions 123*r*. Accordingly, it is possible to allow at least a portion of the handle 170 in the first orientation to enter the connection member 120 in the Z direction, and to reduce the size in the Z direction of the liquid container 100.

In this embodiment, the handle 170 in the first orientation is arranged at a position where it does not interfere with the liquid introducing outlet 131, the container-side electrical connection unit 140, and the fitting structure receiving portion 155. Therefore, the handle 170 is inhibited from obstructing the connection between the mounting body 105 and the connection receiving unit 50.

In this embodiment, in the first orientation, the handle 170 is brought into an orientation in which the handle 170 is positioned along a plane orthogonal to the Z direction (FIGS. 37 and 14). Accordingly, in a state where the liquid container 100 is arranged in the case 61, it is possible to inhibit the handle 170 from unnecessarily protruding in the −Z direction, and to make the mounting body 105 compact. Therefore, the space capacity of the case storage unit 60 in the liquid ejection apparatus 10 can be reduced, and the size of the liquid ejection apparatus 10 can be reduced.

In this embodiment, the two coupling portions 172 and 173 of the handle 170 have a section extending in a direction from the two ends of the grip portion 171 toward the center in the X direction of the grip portion 171 (FIG. 37). In this embodiment, the coupling portions 172 and 173 are bent in a crank-like shape from the two ends of the grip portion 171 toward the center of the grip portion 171 in the X direction. With this configuration, in the handle 170, a width $W_H$ in the X direction of the grip portion 171 is longer than a width $W_B$ in the X direction of the base end portions 174 and 175. Accordingly, the grip portion 171 can be sized so as to be easily gripped while reducing the size of a section on the base end portions 174 and 175 side of the handle 170.

In this embodiment, the coupling portions 172 and 173 of the handle 170 extend so as to bypass the guide portions 165 in order not to overlap the guide portions 165 in the Z direction both in the first orientation and the second orientation. Therefore, the handle 170 is inhibited from obstructing visual recognition of the guide portions 165 by the user.

In the first orientation, the grip portion 171 of the handle 170 may be in contact with the bag-shaped member 110. However, in the first orientation, the grip portion 171 of the handle 170 is desirably held at a position separated from the bag-shaped member 110 as illustrated in FIG. 14. Accordingly, the bag-shaped member 110 is not pressed by the handle 170 in the Z direction, and thus deterioration of the pressure state in the storage portion 115 inside the bag-shaped member 110 due to a load received from the handle 170 is suppressed. Therefore, a decrease in the supplying performance of liquid from the liquid container 100 to the liquid ejection apparatus 10 is suppressed. The connection member 120 may be provided with a restriction portion that comes into contact with a portion of the handle 170 in the first orientation and restricts pivot of the handle 170 in a direction toward the bag-shaped member 110. The restriction portion may inhibit the handle 170 in the first orientation from coming into contact with the bag-shaped member 110.

FIG. 37 is referred to. The distance in the Y direction from the end portion on the +Y direction side of the connection member 120 to the end portion on the −Y direction side of the handle 170 in the first orientation is denoted by Da. In addition, the distance in the Y direction from the end portion on the +Y direction side of the connection member 120 to the end portion 101 on the −Y direction side of the bag-shaped member 110 is denoted by Db. At this time, the distance Da is desirably ⅓ of the distance Db or less ($Da \leq Db/3$). Accordingly, it is possible to reduce the range in which the handle 170 and the bag-shaped member 110 overlap in the Y direction. Also, the grip portion 171 of the handle 170 can be positioned above a section at which the thickness in the Z direction of the bag-shaped member 110 is relatively small. Therefore, in the first orientation, the grip portion 171 of the handle 170 can be positioned at a position where it can be easily gripped, and it is possible to inhibit the bag-shaped member 110 from receiving a load from the handle 170. In addition, increase in the size of the handle 170 is suppressed, and thus it is possible to reduce the size of the liquid container 100, and to compactly store the liquid container 100 in the case storage unit 60 of the liquid ejection apparatus 10.

Overview of First Embodiment

As described above, according to the liquid container 100 of this embodiment, the convenience when handling the liquid container 100 such as when carrying the liquid container 100 and mounting/removing the liquid container 100 to/from the case 61 is improved by using the handle 170. Also, according to the liquid container 100 of this embodiment, various actions and effects described in the above embodiment can be provided.

B. Second Embodiment

Figure 38:
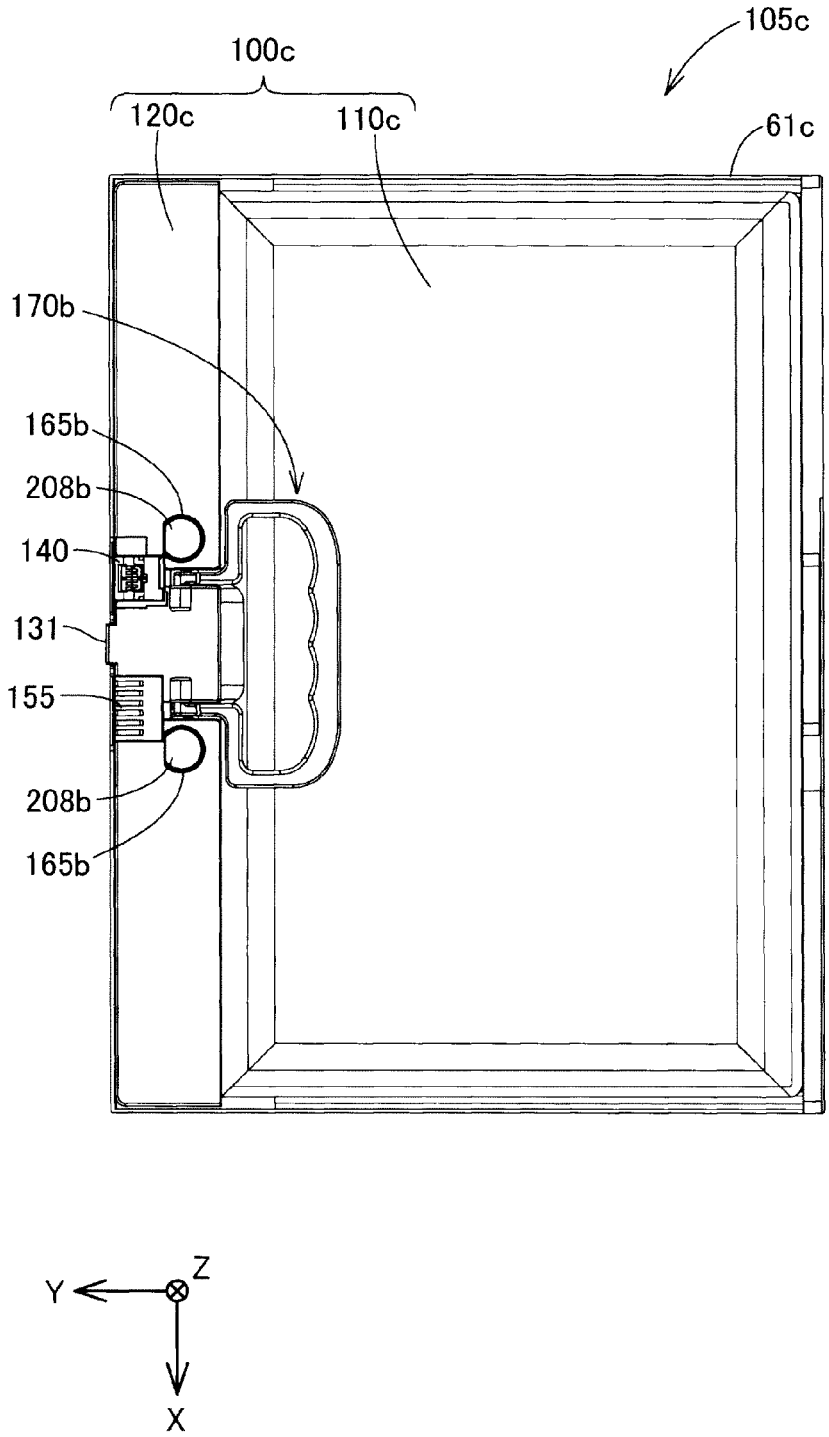
FIG. 38 is a schematic diagram showing a mounting body in a second embodiment.

FIG. 38 is a schematic diagram of a mounting body 105*c* in a second embodiment when viewed in the +Z direction. The mounting body 105*c* in the second embodiment is constituted by a liquid container 100*c* and a case 61*c* whose sizes in the X direction are larger than in the first embodiment. The liquid container 100*c* and the case 61*c* have substantially the same configurations as those of the second liquid container 100*b* and the second case 61*b* in the first embodiment except that the side end portion in the X direction extends in the +X direction and the −X direction.

A liquid ejection apparatus to which the liquid container 100*c* of the second embodiment is mounted is substantially the same as the liquid ejection apparatus 10 described in the first embodiment except that the liquid ejection apparatus to which the liquid container 100*c* of the second embodiment is an inkjet printer that executes single-color printing. In the liquid ejection apparatus of the second embodiment, a case storage unit 60 is occupied by one liquid container 100*c*. One connection receiving unit 50 is installed substantially at the center in the X direction, in a region on the +Y direction side of the case storage unit 60.

The width in the X direction of a bag-shaped member 110*c* of the liquid container 100*c* of the second embodiment extends further than the bag-shaped member 110*b* of the second liquid container 100*b* of the first embodiment. The width in the X direction in the bag-shaped member 110*c* is larger than the width in the Y direction.

The two end portions in the X direction of a connection member 120*c* of the liquid container 100*c* of the second embodiment respectively extend in the +X direction and the −X direction matching the width in the X direction of the bag-shaped member 110*c*. The end portion on the +Y direction side of the bag-shaped member 110*c* is held over the entirety of the connection member 120*c* in the X direction.

The connection member 120*c* of the second embodiment is configured to be connectable to the connection receiving unit 50 having the same configuration as that described in the first embodiment. The arrangement layout of various constituent elements for connection to the connection receiving unit 50 in the connection member 120*c* is substantially the same as the second connection member 120*b* of the first embodiment. The connection member 120*c* has two guide portions 165*b* similar to those described in the first embodiment.

The width in the X direction of the case 61*c* of the second embodiment is increased so as to be suitable for the liquid container 100*c*. The case 61*c* has two guiding portions 208*b* similar to those described in the first embodiment, at the bottom face of a bottom face wall portion 200. Also in the mounting body 105*c* of the second embodiment, due to the guiding portions 208*b* being fitted in the guide portions 165*b*, the positioning accuracy of the liquid container 100*c* on the case 61*c* is improved.

According to the liquid container 100*c* of the second embodiment, the ink storage amount can be increased. In addition, the stability of the arrangement orientation of the liquid container 100*c* is improved. Also, according to the liquid container 100*c* of the second embodiment, various actions and effects described in the first embodiment can be provided. Note that the liquid ejection apparatus to which the liquid container 100*c* of the second embodiment is mounted may be configured to allow the plurality of liquid containers 100*c* to be mounted in parallel in a layered manner in the Z direction. In this case, a configuration may adopted in which the plurality of liquid containers 100*c* that store different types of color ink are mounted to the liquid ejection apparatus, and multi-color printing is executed.

C. Third Embodiment

Figure 39:
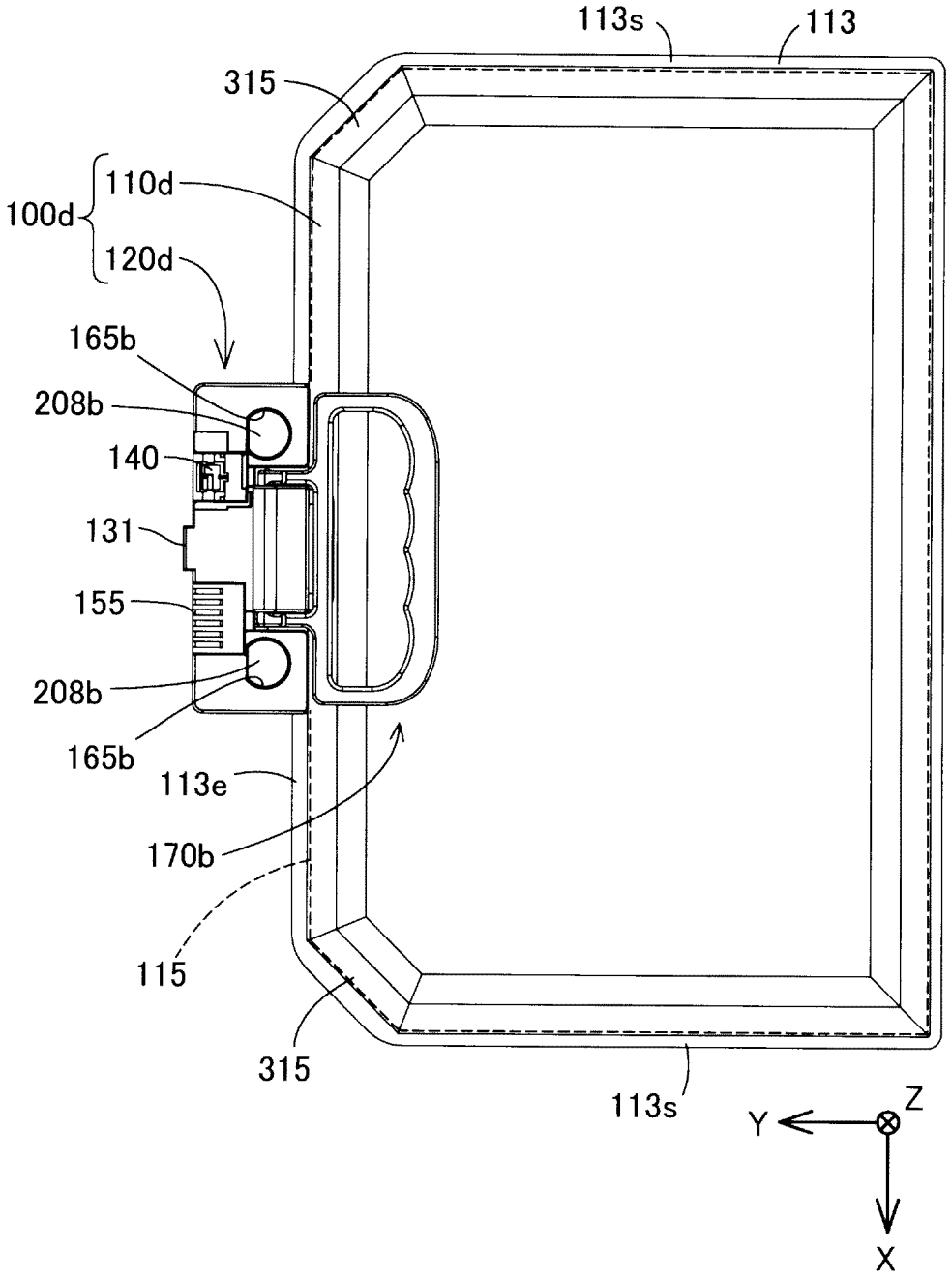
FIG. 39 is a schematic diagram showing a liquid container in a third embodiment.

FIG. 39 is a schematic diagram of a liquid container 100*d* in a third embodiment when viewed in the +Z direction. The liquid container 100*d* of the third embodiment is substantially the same as the liquid container 100*c* of the second embodiment except that the liquid container 100*d* has a bag-shaped member 110*d* whose shape is different when viewed in the Z direction, and a connection member 120*d* that has a configuration similar to that of the second connection member 120*b* described in the first embodiment.

The liquid container 100*d* of the third embodiment is equivalent to a configuration in which, in the second liquid container 100*b* described in the first embodiment, side end portions 113*s* on the two sides in the X direction of the bag-shaped member 110*b* extend from the second connection member 120*b* in the +X direction and the −X direction. The liquid container 100*d* is arranged in the case 61*c* described in the second embodiment, and is mounted to a liquid ejection apparatus similar to that described in the second embodiment.

In the liquid container 100*d* of the third embodiment, a central portion in the X direction of a tip end portion 113*e* of the bag-shaped member 110*d* is held by the connection member 120*d*. Therefore, side end portions 113*s* on the two sides in the X direction of the bag-shaped member 110*d* of the third embodiment extend from the connection member 120*d* in the X direction.

Two corner portions 315 at the end portion on the +Y direction side of the bag-shaped member 110*d* have a chamfered shape. Accordingly, damage and deterioration of a welding region in the corner portion 315 is suppressed. In addition, similarly, in the bag-shaped member 110*d*, the storage portion 115 inside is also shaped as if the corner portions are chamfered (illustrated with broken lines). Therefore, when liquid in the storage portion 115 is consumed in the liquid ejection apparatus, the liquid is inhibited from remaining in the corner portions in the storage portion 115. Also, with the liquid container 100*d* of the third embodiment, various actions and effects similar to those described in the above embodiments can be provided.

D. Fourth Embodiment

Figure 40:
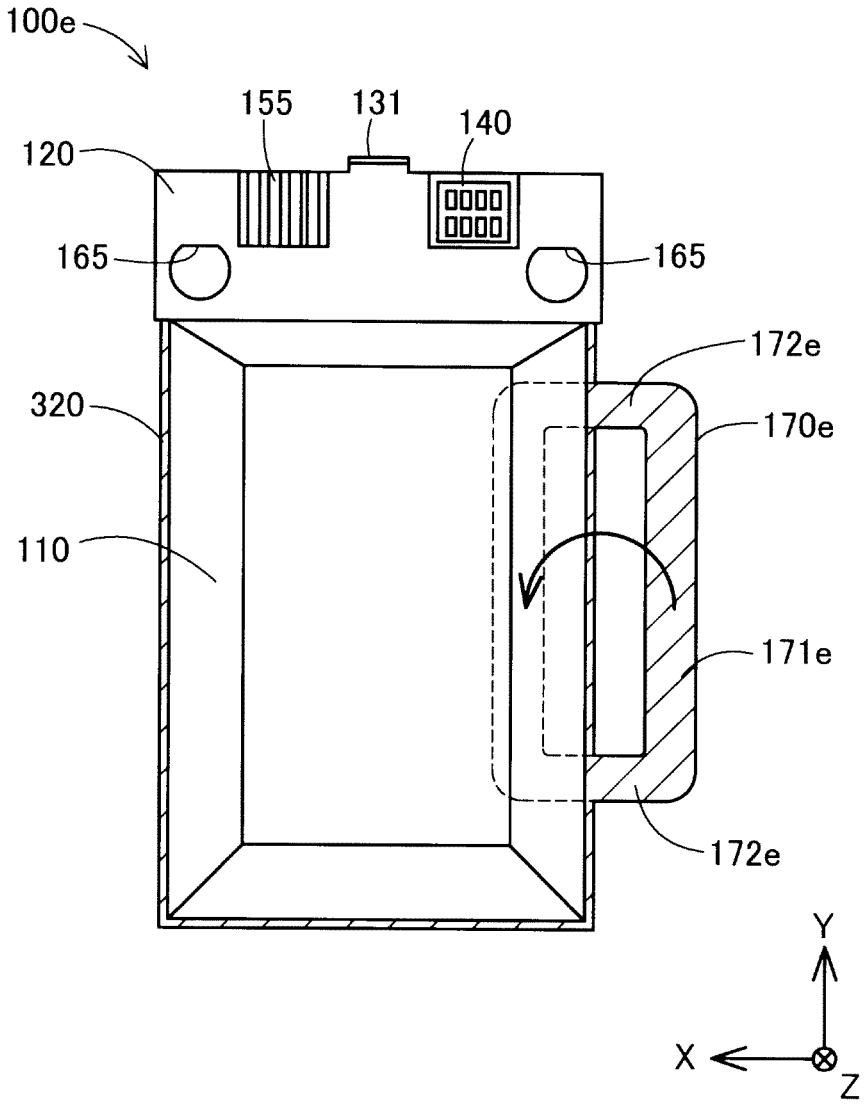
FIG. 40 is a schematic diagram showing a liquid container in a fourth embodiment.

FIG. 40 is a schematic diagram showing a liquid container 100*e* in a fourth embodiment. The liquid container 100*e* has a configuration substantially similar to the configuration of the liquid container 100 described in the first embodiment except that the liquid container 100*e* has a handle 170*e* attached to a sheet member 320 instead of the handle 170 attached to the connection member 120. The liquid container 100*e* is mounted to the case 61 similar to that described in the first embodiment, and is mounted to the liquid ejection apparatus 10 having a configuration similar to that described in the first embodiment.

The liquid container 100*e* is provided with, under the bag-shaped member 110, the sheet member 320 for supporting the bag-shaped member 110. The sheet member 320 is arranged so as to support the entirety of the bag-shaped member 110. For example, the sheet member 320 may be configured by forming a film out of a resin such as polyethylene terephthalate (PET). The sheet member 320 may be constituted by a plate-shaped member made of paper, plastic or metal.

One end portion in the X direction of the sheet member 320 is provided with the handle 170*e*. In FIG. 40, the handle 170*e* is provided at the end portion on the −X direction side. The handle 170*e* extends from the side end portion 113*s* of the bag-shaped member 110 in the X direction. The handle 170*e* is provided with a grip portion 171*e* extending along the side end portion 113*s* of the bag-shaped member 110 in the Y direction and two coupling portions 172*e* for coupling the two ends of the grip portion 171*e* to the sheet member 320. The handle 170*e* may be configured as a portion of the sheet member 320, and may be configured by joining a member other than the sheet member 320 to the sheet member 320.

Normally, the handle 170*e* is in a second orientation extending from the bag-shaped member 110 in the X direction. The user can carry the liquid container 100*e* by gripping the handle 170*e* in the second orientation. The handle 170*e* is pivotable using the coupling section between the two coupling portions 172*e* and the sheet member 320 as a fulcrum. The handle 170*e* can be in a first orientation tilted on the bag-shaped member 110 side so as to be folded over the bag-shaped member 110 (illustrated with broken lines). Accordingly, the handle 170*e* is inhibited from obstructing storage of the liquid container 100*e* in the case 61.

In a state where the liquid container 100*e* is stored in the case 61, the handle 170*e* does not need to be completely folded onto the bag-shaped member 110. The handle 170*e* may be in a state of being in contact with the side wall portions 201 and 202 of the case 61 after rotating upward from the first orientation. Due to the handle 170*e* being in contact with the case 61, the position in the X direction of the liquid container 100*e* is stabilized.

The handle 170*e* may be configured to be able to be separated from the sheet member 320, by providing perforations at the coupling section between the two coupling portions 172*e* and the sheet member 320 in advance. Accordingly, the liquid container 100*e* can be mounted to the liquid ejection apparatus 10 in a compact state where the handle 170*e* is separated, and the mountability of the liquid container 100*e* to the liquid ejection apparatus 10 is improved.

The handle 170*e* may be provided at the two sides in the X direction of the bag-shaped member 110, and may be provided at the end portion on the −Y direction side of the bag-shaped member 110. According to the liquid container 100*e* of the fourth embodiment, various actions and effects described in the above embodiments can be provided in addition to above-described actions and effects.

E. Fifth Embodiment

Figure 41:
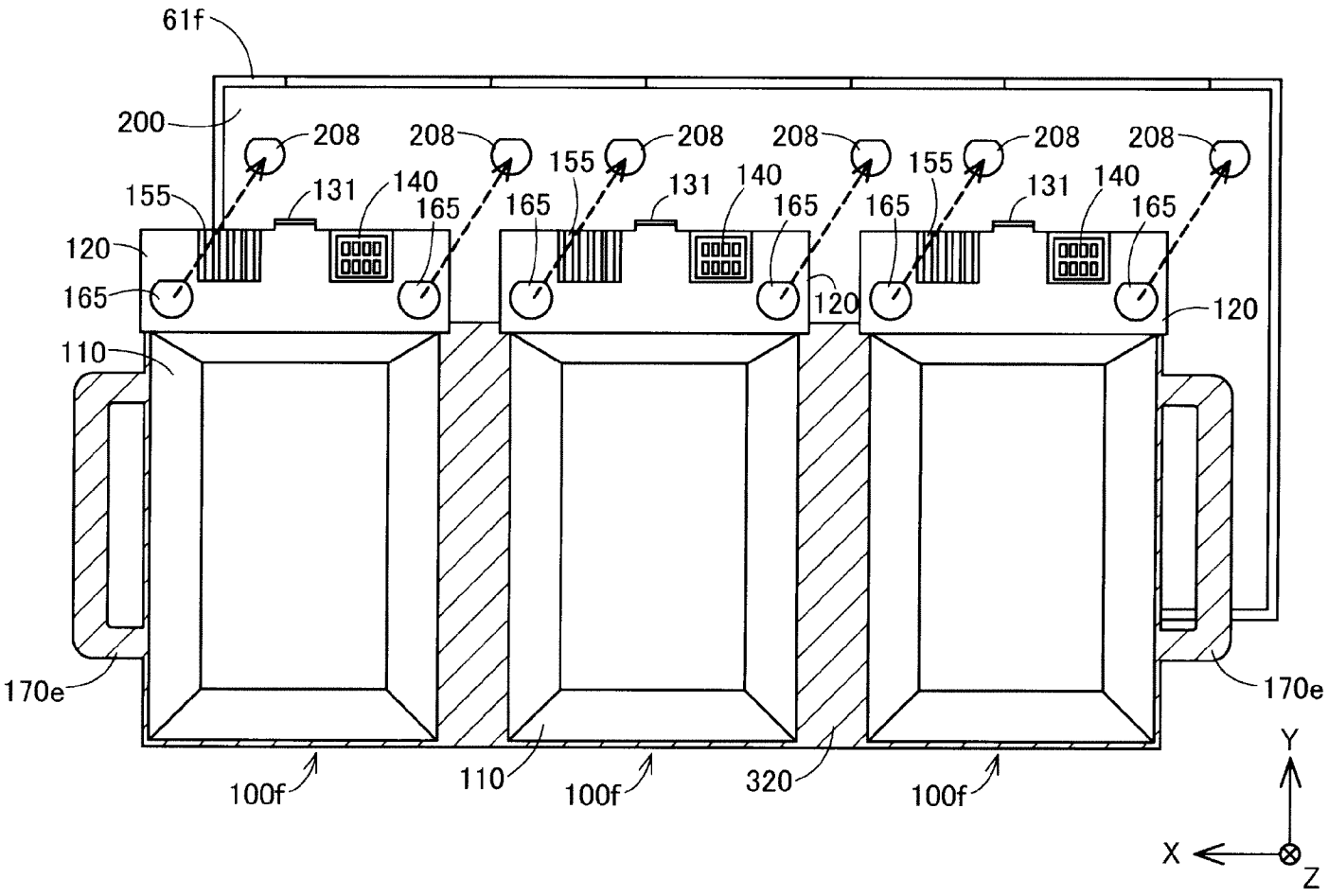
FIG. 41 is a schematic diagram for describing the configuration of a liquid container in a fifth embodiment.

FIG. 41 is a schematic diagram for describing the configuration of liquid containers 100*f* in a fifth embodiment. FIG. 41 illustrates the plurality of liquid containers 100*f* and one case 61*f* in which the plurality of liquid containers 100*f* are arranged in common. The liquid container 100*f* of the fifth embodiment has a configuration similar to that of the liquid container 100*e* of the fourth embodiment except for items described below. In the fifth embodiment, the plurality of liquid containers 100*f* are arranged in a line in the X direction, and are coupled with each other via the sheet member 320. The handles 170*e* similar to that described in the fourth embodiment are respectively provided in the liquid containers 100*f* at positions at the two edges in the X direction.

The handles 170*e* are respectively provided on the two sides in the X direction of a coupling body of the plurality of liquid containers 100*f*. Accordingly, the handleability of the plurality of liquid containers 100*f* connected in the X direction is improved, and the operation of mounting the liquid containers 100*f* to the case 61 is simplified. Note that a handle 170*e* may be provided only on one side in the X direction. Even with one handle 170*e*, the convenience thereof is exhibited in transportation of the plurality of liquid containers 100*f*.

The plurality of liquid containers 100*f* are arranged on the case 61*f* in a state of being coupled by the sheet member 320. The bottom face wall portion 200 of a case 61*f* is provided with the guiding portions 208 corresponding to the guide portions 165 of each of the liquid container 100*f*. Due to the guiding portions 208 being respectively fitted in the corresponding guide portions 165, positioning of the liquid container 100*f* is performed at a predetermined arrangement position of the case 61*f*.

As described in the fourth embodiment, when the coupling body of the liquid containers 100*f* is stored in the case 61*f*, the handle 170*e* may be folded to the bag-shaped member 110 side, and may be in a state of being in contact with a side wall portion of the case 61 and pivoted upward. Alternatively, the handle 170*e* may be separated from the liquid containers 100*f*.

The plurality of liquid containers 100*f* are mounted to a liquid ejection apparatus in a state of being arranged in the case 61*f*. The plurality of the liquid containers 100*f* may store ink of the same color. In this case, the capacity of the color ink can be easily increased. Also, the plurality of liquid containers 100*f* may store color ink of different colors. In this case, a plurality of types of color ink can be handled at the same time, which is efficient.

As described above, according to the liquid containers 100*f* of the fifth embodiment, in a coupled state, the plurality of liquid containers 100*f* can be handled at the same time using the handle 170*e*. Therefore, the liquid containers 100*f* can be mounted to/removed from the case 61*f* efficiently. Besides, according to the liquid containers 100*f* of the fifth embodiment, various actions and effects described in the above embodiments can be provided.

F. Sixth Embodiment

Figure 42:
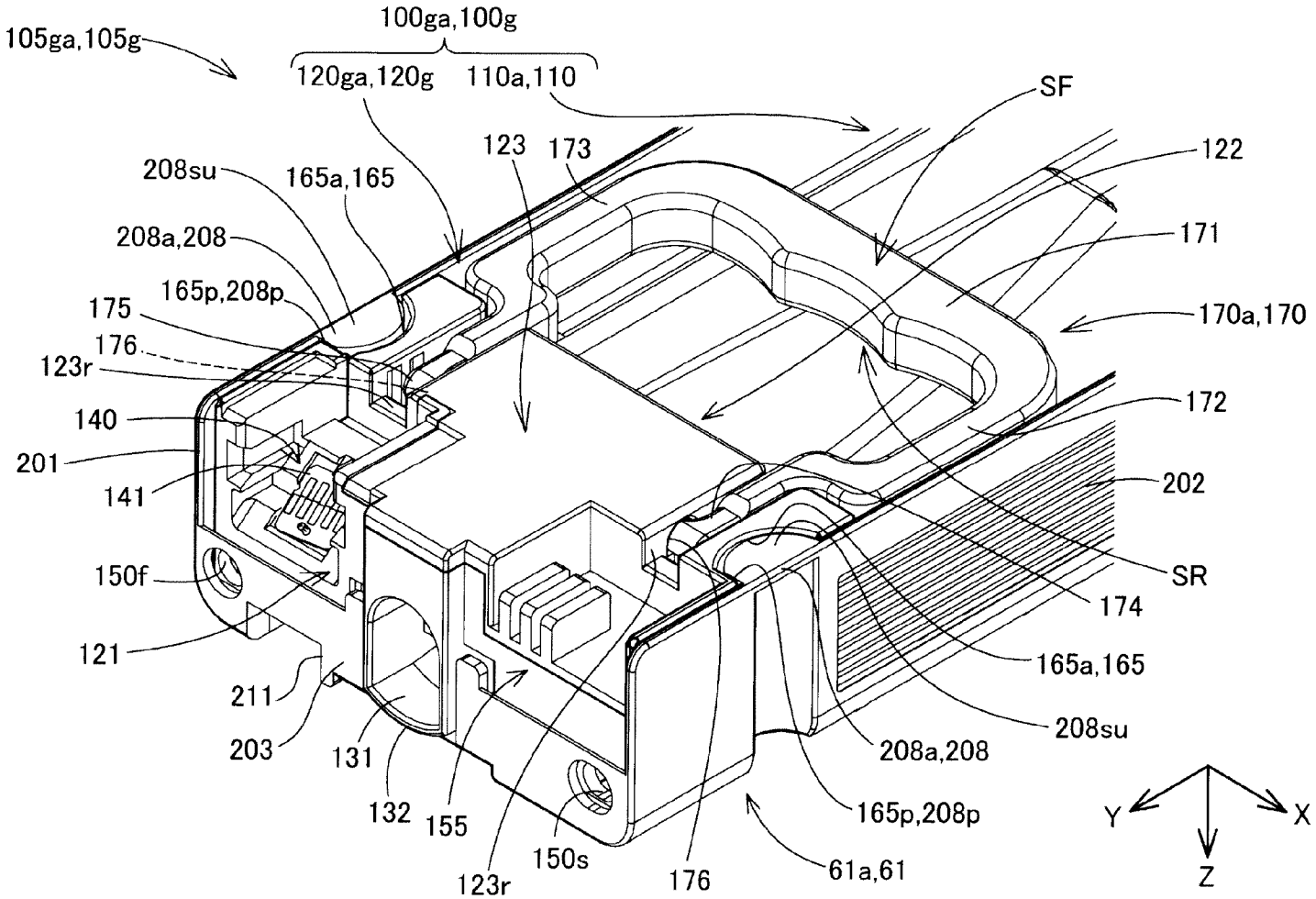
FIG. 42 is a schematic perspective diagram showing the end portion on the front end side of a first mounting body in a sixth embodiment.
Figure 43:
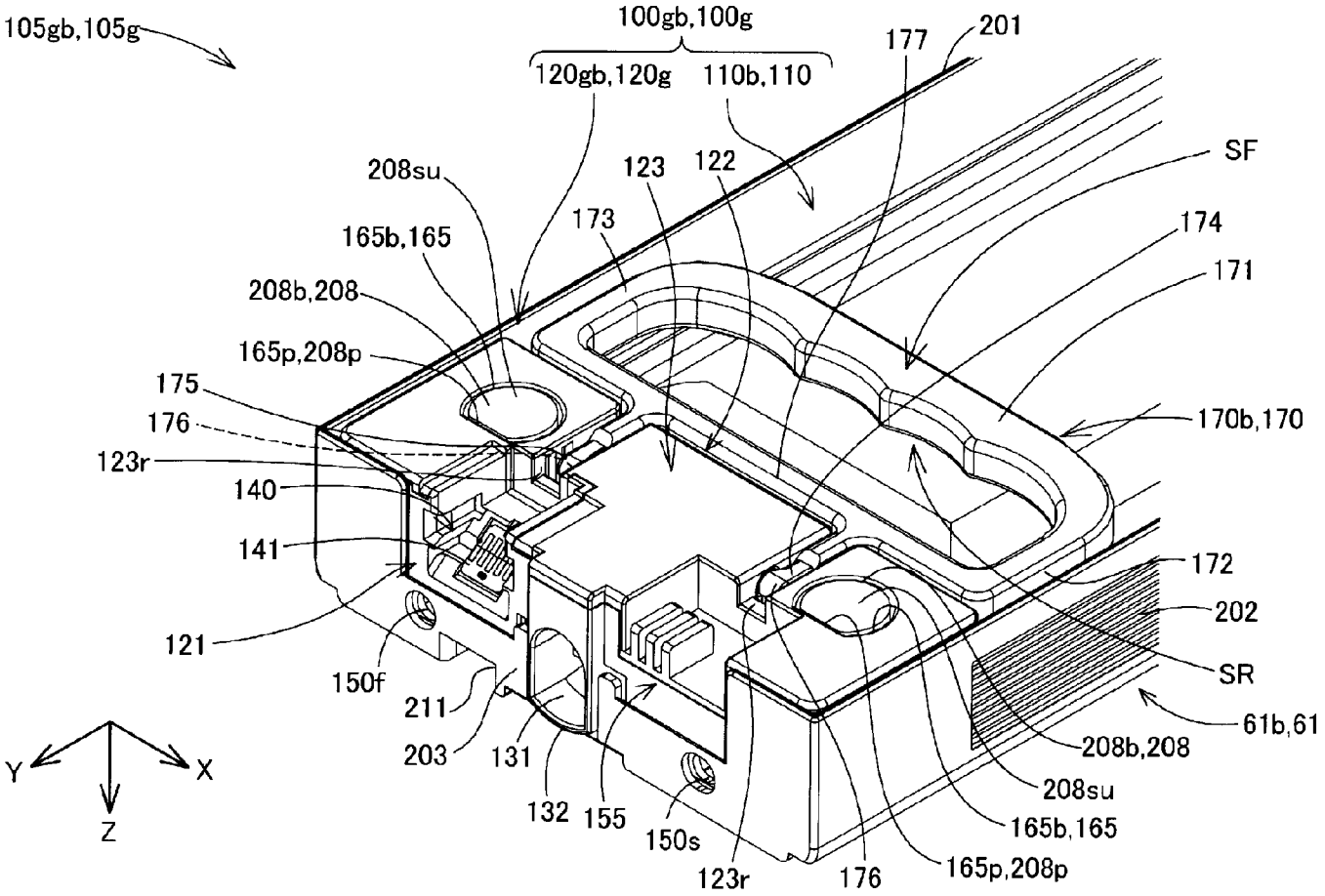
FIG. 43 is a schematic perspective diagram showing the end portion on the front end side of a second mounting body in the sixth embodiment.
Figure 44:
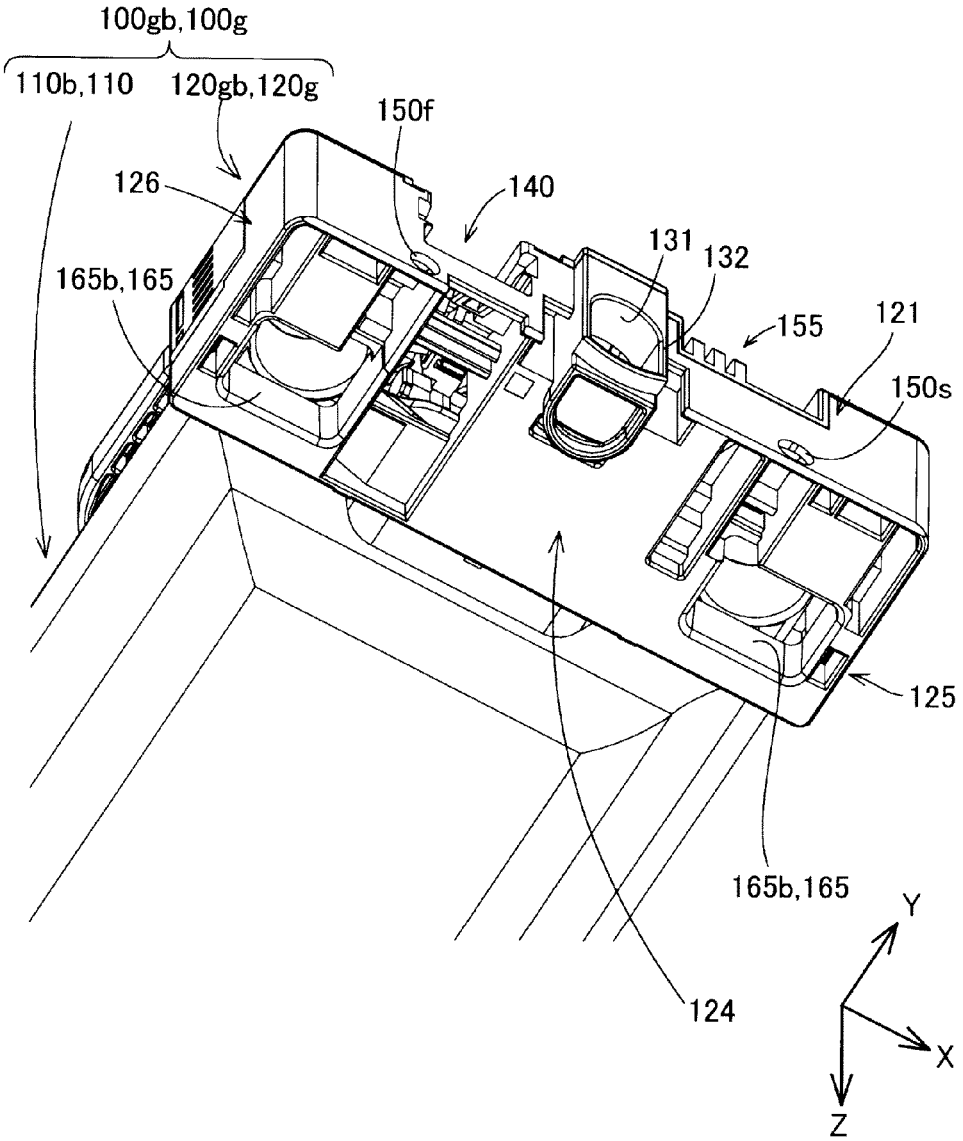
FIG. 44 is a schematic perspective diagram showing the end portion on the front end side of a second liquid container in the sixth embodiment.
Figure 45A:
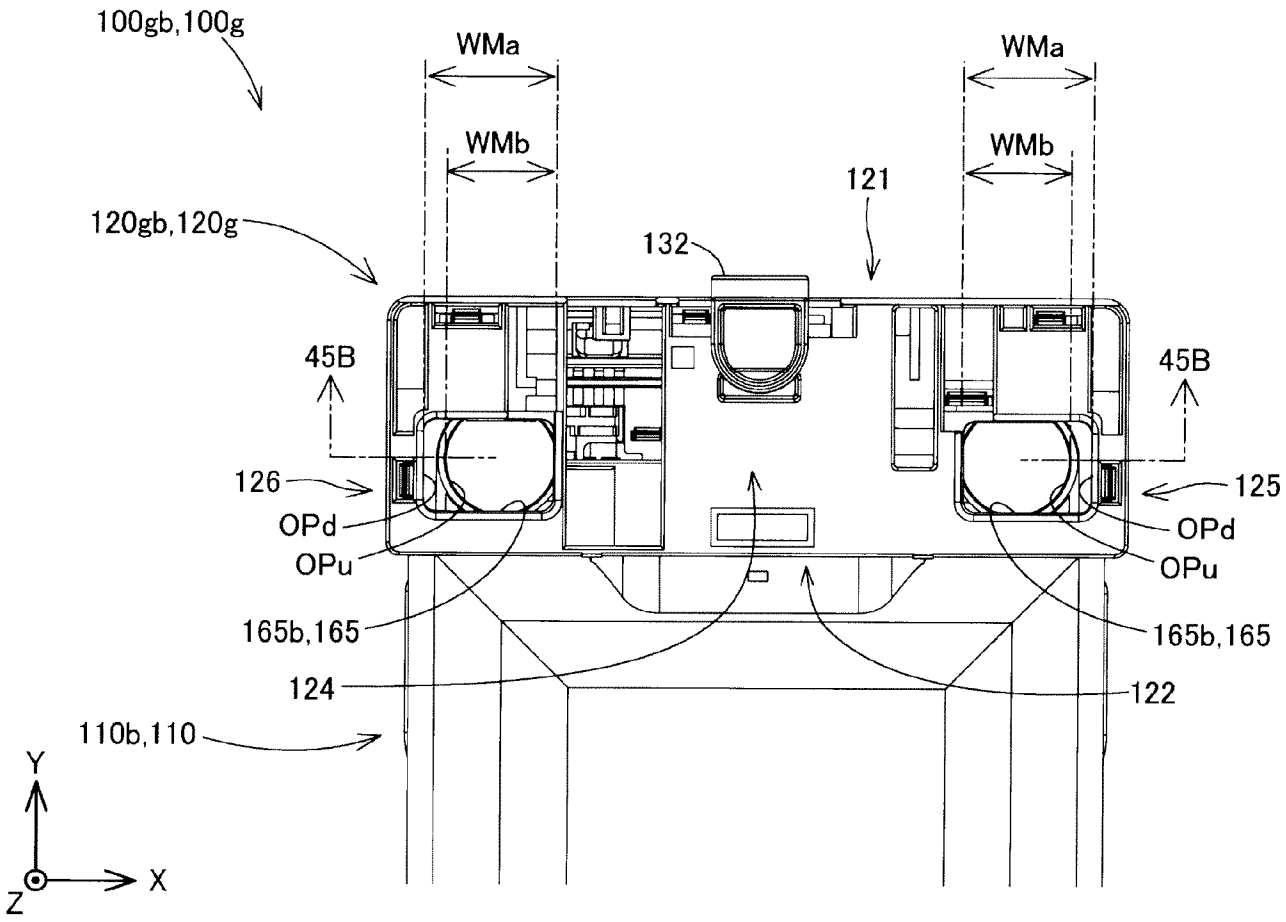
FIG. 45A is a schematic diagram showing a connection member of the second liquid container in the sixth embodiment.
Figure 45B:
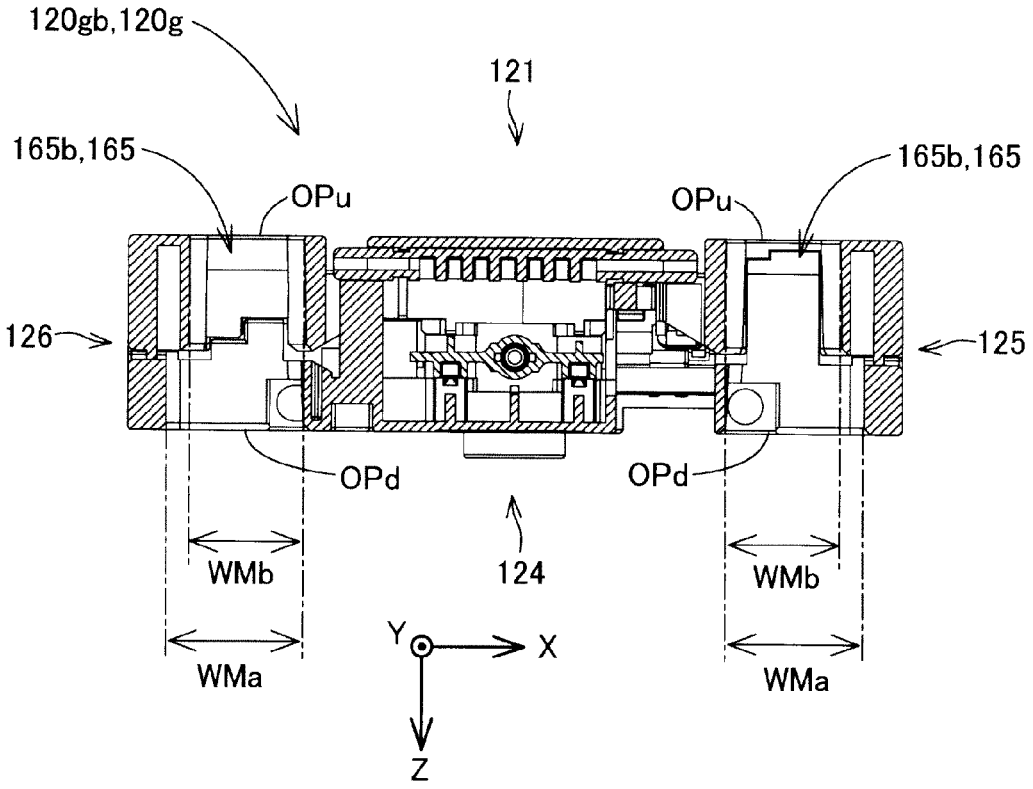
FIG. 45B is a schematic cross-sectional diagram of the connection member of the second liquid container in the sixth embodiment.

The configuration of liquid containers 100*ga* and 100*gb* in a sixth embodiment will be described with reference to FIGS. 42 to 45A and 45B. FIG. 42 is a schematic perspective diagram of the end portion on the front end side (the +Y direction side) in the mounting direction of a first mounting body 105*ga* in which the first liquid container 100*ga* of the sixth embodiment is arranged in the first case 61*a*, when viewed from the −Z direction side. FIG. 43 is a schematic perspective diagram of the end portion on the front end side of a second mounting body 105*gb* in which the second liquid container 100*gb* of the sixth embodiment is arranged in the second case 61*b*, when viewed from the −Z direction side. FIG. 44 is a schematic perspective diagram of the end portion on the +Y direction side of the second liquid container 100*gb*, when viewed from the +Z direction side. FIG. 45A is a schematic diagram of the connection member 120*b* of the second liquid container 100*gb* when viewed in the −Z direction. FIG. 45B is a schematic cross-sectional diagram of the connection member 120*b* in a 45B-45B cross-section shown in FIG. 45A.

The configurations of the liquid containers 100*ga* and 100*gb* of the sixth embodiment are substantially the same as those of the corresponding liquid containers 100*a* and 100*b* of the first embodiment except that the configuration of a first connection member 120*ga* and the configuration of a second connection member 120*gb* are different, as will be described below. Also, the configurations of the cases 61*a* and 61*b* in which the liquid containers 100*ga* and 100*gb* are arranged are substantially the same as those of the cases 61*a* and 61*b* of the first embodiment. The liquid containers 100*ga* and 100*gb* are respectively arranged in the corresponding cases 61*a* and 61*b*, constituting the mounting bodies 105*ga* and 105*gb*, which are mounted to the liquid ejection apparatus 10 having a configuration similar to that described in the first embodiment. In the following description, the liquid containers 100*ga* and 100*gb* are collectively referred to as a "liquid container 100*g*", unless they need to be specifically distinguished apart from each other. Similarly, the mounting bodies 105*ga* and 105*gb* and the connection members 120*ga* and 120*gb* are referred to as a "mounting body 105*g*" and a "connection member 120*g*", respectively.

In the liquid container 100*g*, the fixing portions 176 of the handle 170 are provided in the recessed portions 123*r* of the connection member 120*g*, and the pivot shaft (not illustrated) of the handle 170*a* are positioned on the +Z direction side relative to the third face portion 123 of the connection member 120*g* (FIGS. 42 and 43). Due to the fixing portions 176 being provided at positions recessed in the connection member 120*g*, breakage of the fixing portions 176 and the base end portion 174 of the handle 170 is suppressed, and the handle 170 is inhibited from coming off from the connection member 120*g*.

In the first orientation, the face portion of the handle 170 directed in the −Z direction is referred to as an "upper face portion SF", and the face portion on the side opposite thereto is referred to as a "lower face portion SR" (FIGS. 42 and 43). In the liquid container 100*g*, when the handle 170 is in the first orientation, the entirety of the upper face portion SF of the handle 170 is positioned on the +Z direction side relative to the third face portion 123. The upper face portion SF of the handle 170 is positioned slightly (for example, about 0.1 to 1.0 mm) on the +Z direction side relative to the third face portion 123 of the connection member 120*g*. Accordingly, when the mounting body 105*g* is inserted into the case storage unit 60 (FIG. 3), the handle 170 is inhibited from interfering with the opening member 62 (FIG. 4) of the entrance of the case storage unit 60. Therefore, an operation of mounting/removing the mounting body 105*g* to/from the case storage unit 60 performed by the user is made smoother. In addition, the handle 170 does not protrude in the −Z direction, and the height of the internal space of the case storage unit 60 can be reduced correspondingly. Note that, in the liquid container 100*g*, when the handle 170 is in the first orientation, the entirety of the upper face portion SF of the handle 170 may be positioned at the same position in the Z direction as the third face portion 123 that is the upper face portion of the connection member 120. Also in this case, an effect similar to that described above can be provided.

In the second liquid container 100*gb*, a third coupling portion 177 is added between the first coupling portion 172 and the second coupling portion 173 of the handle 170*b* (FIG. 43). As described with reference to FIG. 37 in the first embodiment, the two coupling portions 172 and 173 of the handle 170 are provided with a section bent in a crank-like shape, such that the distance in the X direction between the two base end portions 174 and 175 is smaller than the width in the X direction of the grip portion 171 (FIGS. 42 and 43). The third coupling portion 177 is installed in the X direction so as to couple the corner portions of the above-mentioned bent section of the two coupling portions 172 and 173 of the handle 170*b* to each other (FIG. 43). When the handle 170*b* is in the first orientation, the third coupling portion 177 is arranged compactly at a position in proximity to the second face portion 122 of the second connection member 120*gb* along the second face portion 122 of the second connection member 120*gb*. The strength of the handle 170*b* is improved by having the third coupling portion 177, making it possible to hold a heavier object hanging down therefrom.

In the mounting body 105*g*, an upper end face 208*su* on the −Z direction side of each of the guiding portions 208 of the case 61 and the third face portion 123 that is the upper face portion of the connection member 120*g* are at positions aligned with each other in the Z direction relative to the bottom face 200*s* (FIG. 13) of the case 61 (FIGS. 42 and 43). In other words, the upper end face 208*su* of the guiding portion 208 and the third face portion 123 of the connection member 120*g* are at substantially the same position (height position) in the Z direction. Here, "substantially the same" means being equal within the range of tolerance or within the range of an error of about 0 to 5%, for example. The user can easily confirm that the liquid container 100*g* is properly arranged in the case 61 by checking, using their visual sense or tactile sense, the upper end face 208*su* of the guiding portion 208 and the third face portion 123 of the connection member 120*g* constitute a flat face. Note that it suffices for the position in the Z direction of the upper end face 208*su* of the guiding portion 208 to be substantially the same as at least the peripheral edge portion of the guide portion 165*b* in the third face portion 123.

The opening shape at the end portion on the +Z direction side of each of the two guide portions 165*b* in the second connection member 120*gb* of the second liquid container 100*gb* has a substantially rectangular shape in which the X direction is assumed to be a longitudinal direction (FIG. 44). In each of the guide portions 165*b*, an opening region OPd at the end portion on the +Z direction side is enlarged further outward in the X direction than an opening region OPu at the end portion on the −Z direction side (FIGS. 45A and 45B). Therefore, in each of the guide portions 165*b*, the maximum value WMa of the opening width in the X direction at the end portion on the +Z direction side is larger than the maximum value WMb of the opening width in the X direction at the end portion on the −Z direction side. Accordingly, insertion of the guiding portions 208*b* into the guide portions 165*b* is made easier, and the operation of mounting the second liquid container 100*gb* to the second case 61*b* is made easier. In addition, according to the second mounting body 105*gb*, even if the user drops the second mounting body 105*gb* accidentally, the guiding portions 208*b* are easily released from the guide portions 165*b*, and the second liquid container 100*b* is easily separated from the second case 61*b*. Therefore, even if such an unexpected shock is applied to the second mounting body 105*b*, it is possible to suppress breakage of the second liquid container 100*gb* and the second case 61*b* caused by the unexpected shock.

As described above, according to the liquid container 100*g* of the sixth embodiment, various actions and effects described in the sixth embodiment such as an improvement in easiness of mounting to the case 61 and the case storage unit 60 can be provided. Also, according to the liquid container 100*g* of the sixth embodiment, various actions and effects similar to those described in other embodiments above can be provided.

G. Seventh Embodiment

Figure 46:
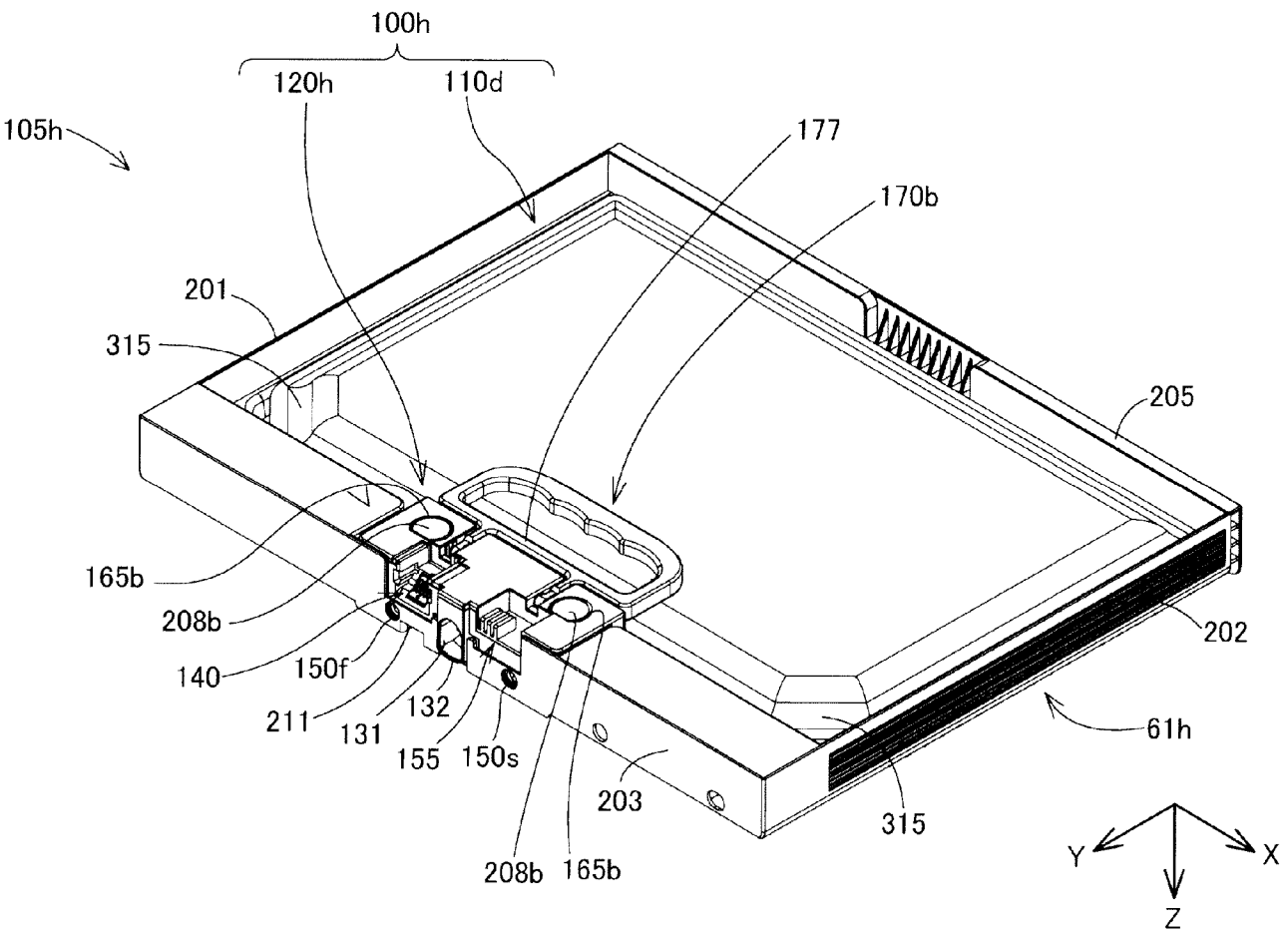
FIG. 46 is a schematic perspective diagram showing a mounting body of a seventh embodiment.

FIG. 46 is a schematic perspective diagram of a mounting body 105*h* in which a liquid container 100*h* of a seventh embodiment is arranged in a case 61*h*, when viewed from the −Z direction side. The configuration of the liquid container 100*h* of the seventh embodiment is substantially the same as the liquid container 100*d* of the third embodiment (FIG. 39) except that the liquid container 100*h* has a connection member 120*h* having a configuration similar to that of the second connection member 120*gb* described in the sixth embodiment instead of the connection member 120*d* of the third embodiment. The configuration of the case 61*h* is substantially the same as the configuration of the case 61*c* (FIG. 38) described in the second embodiment. The mounting body 105*h* of the seventh embodiment is mounted to a liquid ejection apparatus that executes single-color printing similar to that described in the second embodiment. According to the liquid container 100*h* of the seventh embodiment, performance in mounting to/removing from the case 61*h* and the case storage unit 60 is improved similarly to the sixth embodiment. Besides, according to the liquid container 100*h* of the seventh embodiment, various actions and effects similar to those described in the above embodiments can be provided.

H. Modified Examples

Various configurations described in the above embodiments can be modified as follows, for example. All the modified examples, which will be described, are classified as an example of a mode for implementing the invention.

H1. Modified Example 1

The configuration of the handle 170 is not limited to those described in the above embodiments. The handle 170 may have a configuration in which one of the two coupling portions 172 and 173 is omitted. In this case, one of the base end portions 174 and 175 is omitted. The grip portion 171 may extend while being curved in the X direction, or may extend while being bent. The two coupling portions 172 and 173 may extend linearly, and may extend in a curved manner. The coupling portions 172 and 173 may be constituted by a flexible member. The fixing portions 176 do not need to be constituted by shaft holes into which the shaft-like base end portions 174 and 175 are inserted. The fixing portions 176 may be constituted by a hinge, for example. The fixing portions 176 of the handle 170 do not need to be provided in the third face portion 123 of the connection member 120. For example, the fixing portions 176 of the handle 170 may be provided in the second face portion 122 (FIG. 15) directed in the −Y direction of the connection member 120, and may be provided in the fifth face portion 125 or the sixth face portion 126 of the connection member 120.

H2. Modified Example 2

In the above embodiments, the handle 170 is configured to protrude from the connection member 120 toward the bag-shaped member 110 in the first orientation, and to protrude from the connection member 120 in the opposite direction to the bag-shaped member 110 in the second orientation. However, the handle 170 does not need to protrude from the connection member 120 toward the bag-shaped member 110 in the first orientation, and does not need to protrude from the connection member 120 in the opposite direction to the bag-shaped member 110 in the second orientation. The handle 170 may be configured to pivot in such a range as not to protrude from the connection member 120 in the Y direction.

H3. Modified Example 3

In the above embodiments, in the first orientation, the handle 170 is arranged in an orientation of lying along a plane orthogonal to the Z direction. However, in the first orientation, the handle 170 may be arranged in an orientation inclined toward a plane orthogonal to the Z direction. In the first orientation, the handle 170 may be inclined such that the grip portion 171 is positioned above the fixing portions 176, or may be inclined such that the grip portion 171 is positioned below the fixing portions 176.

H4. Modified Example 4

In the embodiments of the above modes, the connection member 120 is provided with the restriction portion 310 that comes into contact with the handle 170 in the second orientation and restricts the pivot range of the handle 170. However, the connection member 120 does not need to be provided with the restriction portion 310. For example, the handle 170 may be configured such that, when the grip portion 171 is pivoted in a direction to be distanced from the bag-shaped member 110, the pivot of the handle 170 is allowed until a position at which the grip portion 171 is positioned below the fixing portions 176 is reached.

H5. Modified Example 5

In the embodiments of the above modes, the base end portions 174 and 175 of the handle 170 are provided between the two guide portions 165 in the X direction. However, the base end portions 174 and 175 of the handle 170 do not need to be arranged between the two guide portions 165 in the X direction. Only one of the two base end portions 174 and 175 may be positioned between the two guide portions 165 in the X direction, and both of the two base end portions 174 and 175 may be positioned out of the region between the two guide portions 165 in the X direction. The base end portions 174 and 175 of the handle 170 may be provided at a position offset from the two guide portions 165 in the Y direction.

H6. Modified Example 6

In the above embodiments, when the handle 170 is in the second orientation, the handle 170 and the container-side electrical connection unit 140 overlap in the Z direction. However, when the handle 170 is in the second orientation, the handle 170 and the container-side electrical connection unit 140 do not need to overlap in the Z direction. For example, the container-side electrical connection unit 140 may be positioned at a position where it is sandwiched between the coupling portions 172 and 173.

F7. Modified Example 7

In the above fourth and fifth embodiments, the liquid containers 100*e* and 100*f* have the connection member 120, but the connection member 120 may be omitted. The liquid containers 100*e* and 100*f* may be only configured such that a liquid introduction portion into which the liquid introducing portion 51 is inserted is provided at the end portion on the +Y direction side of the bag-shaped member 110.

H8. Modified Example 8

In the above embodiments, the container-side electrical connection unit 140 is provided with the substrate portion 141 having the terminals 142. However, the container-side electrical connection unit 140 does not need to have the substrate portion 141. For example, the container-side electrical connection unit 140 may have a configuration in which the terminals 142 with which the apparatus-side electrical connection unit 52 comes into electrical contact are arranged directly on a wall face of the connection member 120. In the above embodiments, the terminals 142 of the container-side electrical connection unit 140 are arranged to be directed obliquely upward. However, the terminals 142 of the container-side electrical connection unit 140 do not need to be arranged directed obliquely upward. The terminals 142 may be arranged to be orthogonal in the Z direction, and may be arranged orthogonal to the Y direction. In the above embodiments, the substrate arrangement portion 144 for arranging the terminals 142 is provided as a recessed portion sunken in the −Y direction and the +Z direction. However, the substrate arrangement portion 144 does not need to be formed as a recessed portion. The terminals 142 may be provided at a section protruding further than other sections.

H9. Modified Example 9

In the above embodiments, the guide portion 165*a* is constituted by a recessed portion having a substantially semicylindrical shape, and the guide portion 165*b* is constituted by a through hole constituting a space having a substantially columnar shape. However, the guide portion 165 provided in the connection member 120 may have another shape. For example, the guide portion 165 may be formed as a recessed portion sunken in a hemispherical shape. An opening shape in a horizontal cross-section of the guide portion 165 may be a substantially triangular shape or another polygonal shape, and the guide portion 165 may be formed as a slit-like tear extending in the Z direction. The two guide portions 165 do not need to be aligned in the X direction. The two guide portions 165 may be provided at positions offset from each other in the Y direction. It suffices for the two guide portions 165 to be provided so as to be separated from each other in the X direction. The two guide portions 165 may have different sizes or shapes. The guide portions 165 may be omitted.

H10. Modified Example 10

In the above embodiments, the Y direction, which is the direction of movement of the liquid container 100 and the case 61 of the case storage unit 60, coincides with the front-back direction of the liquid ejection apparatus 10. However, the Y direction, which the direction of movement of the liquid container 100 and the case 61 of the case storage unit 60, does not need to coincide with the front-back direction of the liquid ejection apparatus 10. The Y direction, which is the direction of movement of the liquid containers 100 and the case 61 in the case storage unit 60, may be the horizontal direction of the liquid ejection apparatus 10, for example. Accordingly, mounting ports of the liquid container 100 and the case 61 may be provided on the side face on the right side or the left side of the liquid ejection apparatus 10. The Y direction that is the direction of movement of the case 61 does not have to be perpendicular to the gravity direction, and may be a direction obliquely intersecting the gravity direction. In addition, in the above embodiments, the case storage unit 60 is provided at a position of the lowest stage of the liquid ejection apparatus 10. However, the case storage unit 60 may be formed at another height position. The case storage unit 60 may be provided at a central portion in the Z direction.

H11. Modified Example 11

In the above first embodiment, the configuration of the liquid ejection apparatus 10 in which the four liquid containers 100 are mounted is described. In the above second and third embodiments, the configuration of a liquid ejection apparatus in which one liquid container 100*c* and one liquid container 100*d* are mounted is described. The number of the liquid containers 100 that are mounted to the liquid ejection apparatus is not limited to those described in the above embodiments. For example, the liquid ejection apparatus may be configured such that one first liquid container 100*a* or one second liquid container 100*b* of the first embodiment can be mounted, and the liquid ejection apparatus may be configured such that two or more liquid containers 100*c* of the second embodiment or two or more liquid containers 100*d* of the third embodiment can be mounted. In addition, in the above-described first embodiment, two types of liquid containers, namely, the liquid containers 100*a* and 100*b* are mounted to the liquid ejection apparatus 10. However, only one of the liquid containers 100*a* and 100*b* may be mounted to the liquid ejection apparatus 10, and liquid containers of three types or more having different configurations may be mounted.

H12. Modified Example 12

In the above embodiments, the first receiving portion 150*f* and the second receiving portion 150*s* are provided at such positions that at least portions thereof respectively overlap the guide portions 165 when viewed in the Y direction. However, the first receiving portion 150*f* and the second receiving portion 150*s* may be provided at positions offset from the guide portions 165 when viewed in the Y direction. In the above embodiments, the first receiving portion 150*f* and the second receiving portion 150*s* may be omitted.

H13. Modified Example 13

In the above embodiments, the case-side fixing structure 220 has the heart cam groove structure. However, the case-side fixing structure 220 does not need to have the heart cam groove structure. For example, in an engagement state, the case-side fixing structure 220 is only configured to have a step portion with which the protrusion 54*p* of the apparatus-side fixing structure 54 is engaged in the −Y direction. In this case, a configuration is desirably adopted in which the engagement state can be released by moving the apparatus-side fixing structure 54 in the X direction according to a user operation or the like. In the above embodiments, the case-side fixing structure 220 may be omitted.

H14. Modified Example 14

The configuration of the liquid container 100 is not limited to the configurations described in the above embodiments. For example, the bag-shaped member 110 of the liquid container 100 may have a substantially disc-like shape. In addition, in the connection receiving unit 50, the liquid introducing outlet 131 does not need to be positioned at the center in the X direction, the container-side electrical connection unit 140 may be provided at the center in the X direction. The liquid introducing outlet 131 does not need to be provided between a pair of the receiving portions 150*f* and 150*s* in the X direction. Also, the pair of receiving portions 150*f* and 150*s* do not need to be provided at the same height position, and may have substantially the same opening shape and opening size. The container-side electrical connection unit 140 does not need to be formed at a portion recessed on the −Y direction side, and may be formed at a position protruding on the +Y direction side.

H15. Modified Example 15

The configuration of the case 61 in which the liquid container 100 is arranged is not limited to configurations described in the above embodiments. The case 61 does not need to have the configuration of a tray-like shape, and may be constituted by a frame-like member obtained by combining a plurality of columnar members, for example.

H16. Modified Example 16

The connection receiving units 50 to which the liquid container 100 is connected is not limited to the configurations described in the above embodiments. The connection receiving unit 50 does not need to be configured as a single constituent part, and may have a configuration in which the liquid introducing portion 51, the apparatus-side electrical connection unit 52, and the pair of positioning portions 53*f* and 53*s* are independently arranged as different members in a separated manner.

H17. Modified Example 17

The liquid ejection apparatus 10 of the above embodiments is a printer, and the liquid ejection system 11 is an inkjet printing system. However, the liquid ejection apparatus 10 does not need to be a printer, and the liquid ejection system 11 does not need to be a printing system. For example, the liquid ejection apparatus 10 may be configured as a cleaning apparatus for ejecting a liquid detergent. In this case, the liquid ejection system is a cleaning system.

H18. Modified Example 18

The configurations of the handle 170, the guide portions 165 and the guiding portions 208 described in the above sixth embodiment may be applied to the liquid container, the case and the mounting body of another embodiment.

The invention is not limited to the above embodiments, working examples and modified examples, and can be achieved as various configurations without departing from the gist of the invention. For example, the technical features in the embodiments, working examples and modified examples that correspond to the technical features in the modes described in the summary of the invention may be replaced or combined as appropriate in order to solve a part of, or the entire foregoing problem, or to achieve some or all of the above-described effects. The technical features that are not described as essential in the specification, including the technical features that are described as "may be omitted", may be deleted as appropriate.

What is claimed is:

1. A liquid container that is detachable from a case of a liquid ejection apparatus comprising:

a housing provided with a case storage unit therein;

the case that is configured to be inserted into the case storage unit by being moved in a +Y direction;

a liquid introducing portion that is positioned at an end portion on the +Y direction side of the case storage unit; and an apparatus-side electrical connection unit that is positioned at the end portion on the +Y direction side of the case storage unit, wherein:

an axis parallel to a gravity direction is referred to as a Z axis, a same direction along the Z axis as the gravity direction is referred to as a +Z direction, and an opposite direction along the Z axis to the gravity direction is referred to as a −Z direction, an axis orthogonal to the Z axis is referred to as a Y axis, one direction along the Y axis is referred to as the +Y direction, and the other direction along the Y axis is referred to as a −Y direction, and an axis orthogonal to the Z axis and the Y axis is referred to as an X axis, one direction along the X axis is referred to as a +X direction, and the other direction along the X axis is referred to as a −X direction, the liquid container comprises:

a bag-shaped member that is flexible, and comprises a storage portion for storing a liquid therein; and a connection member that is mounted to the bag-shaped member so as to be positioned at the end portion on the +Y direction side in a mounted state in which the liquid container is mounted to the liquid ejection apparatus, the connection member comprises:

a liquid introducing outlet into which the liquid introducing portion is inserted in the −Y direction in the mounted state;

a container-side electrical connection unit to which the apparatus-side electrical connection unit is connected in the −Y direction in the mounted state; and a handle configured to pivot toward the connection member with respect to the X axis in the mounted state, the handle has a grip portion, a coupling portion that is coupled to the grip portion, and a base end portion that pivotably fixes the coupling portion to the connection member, the handle is configured such that in a state where the liquid container is arranged in the case, the handle is provided at a position exposed to the outside of the case, and when the liquid container is being mounted to or removed from the case the handle is in a second orientation in which the handle is pivoted from a first orientation in the mounted state, the case has a bottom face facing the −Z direction and comprises two guiding portions protruding from the bottom face in the −Z direction, in a state where the case is arranged in the case storage unit, the connection member comprises two guide portions into which the two guiding portions are respectively fitted in a state where the liquid container is arranged in the case, and the base end portion is provided between the two guide portions with respect to the X axis in the mounted state.

2. The liquid container according to claim 1, wherein the grip portion is arranged at a position protruding from the connection member toward the bag-shaped member in the first orientation, and is arranged at a position protruding from the connection member in a direction opposite to the bag-shaped member in the second orientation.

3. The liquid container according to claim 2, wherein the first orientation is an orientation in which the handle is arranged along a plane orthogonal to the Z axis in the mounted state.

4. The liquid container according to claim 2, wherein, in the first orientation, the grip portion is held at a position separated from the bag-shaped member.

5. The liquid container according to claim 1, wherein the connection member has an upper face portion facing the −Z direction in the mounted state, the handle has an upper face portion facing the −Z direction in the mounted state, and in the mounted state, the upper face portion of the handle is positioned at the same position as the upper face portion of the connection member with respect to the Z axis or at a position on the +Z direction side relative to the upper face portion of the connection member.

6. The liquid container according to claim 1, wherein the connection member has a restriction portion that comes into contact with the handle in the second orientation, and restricts a pivot range of the handle.

7. The liquid container according to claim 1, wherein the connection member has an upper face portion facing the −Z direction in the mounted state, the two guiding portions have upper end faces positioned at an end in the −Z direction in the mounted state and facing the −Z direction, and in the mounted state, the upper end faces of the two guiding portions and the upper face portion of the connection member are positioned at substantially the same position with respect to the Z axis relative to the bottom face of the case.

8. The liquid container according to claim 1, wherein the two guide portions are each constituted by a through hole passing through the connection member along the Z axis in the mounted state, and in the mounted state, the maximum value of an opening width with respect to the X axis at an end portion on the +Z direction side of each of the two guide portions is larger than the maximum value of an opening width with respect to the X axis at an end portion on the −Z direction side of each of the two guide portions.

9. The liquid container according to claim 1, wherein, in the mounted state, a distance with respect to the Y axis from an end portion on the +Y direction side of the connection member to an end portion on the −Y direction side of the handle in the first orientation is within one third of a distance with respect to the Y axis from the end portion on the +Y direction side of the connection member to an end portion on the −Y direction side of the bag-shaped member.

10. The liquid container according to claim 1, wherein the grip portion extends along the X axis in the mounted state, the coupling portion includes a first coupling portion and a second coupling portion that are respectively coupled with two ends of the grip portion with respect to the X axis in the mounted state, and the base end portion includes a first base end portion that pivotably fixes the first coupling portion to the connection member and a second base end portion that pivotably fixes the second coupling portion to the connection member.

11. The liquid container according to claim 10, wherein a length of the grip portion with respect to the X axis in the mounted state is longer than a distance between the first base end portion and the second base end portion.

12. The liquid container according to claim 1, wherein the handle is held at a position overlapping the container-side electrical connection unit with respect to the Z axis in the mounted state, and separated from the container-side electrical connection unit.

13. The liquid container according to claim 1, wherein, in the mounted state, the handle, the container-side electrical connection unit, and the liquid introducing portion are arranged at positions not overlapping with respect to the Z axis in the mounted state.

14. A liquid container that is detachable from a case of a liquid ejection apparatus comprising:

a housing provided with a case storage unit therein;

the case configured to be inserted into the case storage unit by being moved in a +Y direction; and a liquid introducing portion that is positioned at an end portion on the +Y direction side of the case storage unit, wherein:

an axis parallel to a gravity direction is referred to as a Z axis, a same direction along the Z axis as the gravity direction is referred to as a +Z direction, and an opposite direction along the Z axis to the gravity direction is referred to as a −Z direction, an axis orthogonal to the Z axis is referred to as a Y axis, one direction along the Y axis is referred to as the +Y direction, and the other direction along the Y direction is referred to as a −Y direction, and an axis orthogonal to the Z axis and the Y axis is referred to as an X axis, one direction along the X axis is referred to as a +X direction, and the other direction along the X axis is referred to as a −X direction, the liquid container comprises:

a bag-shaped member that is flexible, and comprises a storage portion for storing a liquid therein;

a liquid introducing outlet into which the liquid introducing portion is inserted in the −Y direction in a mounted state in which the liquid container is mounted to the liquid ejection apparatus; and a sheet member that comprises a pivotable handle, the handle is provided at a position exposed to the outside of the case in a state where the liquid container is arranged in the case, the handle comprises a base end portion that pivotably fixes the handle, the case has a bottom face facing the −Z direction and comprises two guiding portions protruding from the bottom face in the −Z direction, in a state where the case is arranged in the case storage unit, the liquid container comprises two guide portions into which the two guiding portions are respectively fitted in a state where the liquid container is arranged in the case, and the base end portion is provided between the two guide portions with respect to the X axis in the mounted state.

15. A liquid container that is detachable from a case of a apparatus comprising:

a housing provided with a case storage unit therein;

the case that is configured to be inserted into the case storage unit by being moved in a +Y direction;

a liquid introducing portion that is positioned at an end portion on the +Y direction side of the case storage unit; and an apparatus-side electrical connection unit that is positioned at the end portion on the +Y direction side of the case storage unit, wherein:

an axis parallel to a gravity direction is referred to as a Z axis, a same direction along the Z axis as the gravity direction is referred to as a +Z direction, and an opposite direction along the Z axis to the gravity direction is referred to as a −Z direction, an axis orthogonal to the Z axis is referred to as a Y axis, one direction along the Y axis is referred to as the +Y direction, and the other direction along the Y axis is referred to as a −Y direction, and an axis orthogonal to the Z axis and the Y axis is referred to as an X axis, one direction along the X axis is referred to as a +X direction, and the other direction along the X axis is referred to as a −X direction, the liquid container comprises:

a bag-shaped member that is flexible, and comprises a storage portion for storing a liquid therein; and a connection member that is mounted to the bag-shaped member so as to be positioned at the end portion on the +Y direction side in a mounted state in which the liquid container is mounted to the liquid ejection apparatus, the connection member comprises:

a liquid introducing outlet into which the liquid introducing portion is inserted in the −Y direction in the mounted state;

a container-side electrical connection unit to which the apparatus-side electrical connection unit is connected in the −Y direction in the mounted state; and a handle configured to pivot toward the connection member with respect to the X axis in the mounted state, the handle has a grip portion, a coupling portion that is coupled to the grip portion, and a base end portion that pivotably fixes the coupling portion to the connection member, the handle is configured such that in a state where the liquid container is arranged in the case, the handle is provided at a position exposed to the outside of the case, and when the liquid container is being mounted to or removed from the case the handle is in a second orientation in which the handle is pivoted from a first orientation in the mounted state, and the handle is held at a position overlapping the container-side electrical connection unit with respect to the Z axis in the mounted state, and separated from the container-side electrical connection unit.

16. A liquid container that is detachable from a case of a liquid ejection apparatus comprising:

a housing provided with a case storage unit therein;

the case that is configured to be inserted into the case storage unit by being moved in a +Y direction;

a liquid introducing portion that is positioned at an end portion on the +Y direction side of the case storage unit; and an apparatus-side electrical connection unit that is positioned at the end portion on the +Y direction side of the case storage unit, wherein:

an axis parallel to a gravity direction is referred to as a Z axis, a same direction along the Z axis as the gravity direction is referred to as a +Z direction, and an opposite direction along the Z axis to the gravity direction is referred to as a −Z direction, an axis orthogonal to the Z axis is referred to as a Y axis, one direction along the Y axis is referred to as the +Y direction, and the other direction along the Y axis is referred to as a −Y direction, and an axis orthogonal to the Z axis and the Y axis is referred to as an X axis, one direction along the X axis is referred to as a +X direction, and the other direction along the X axis is referred to as a −X direction, the liquid container comprises:

a bag-shaped member that is flexible, and comprises a storage portion for storing a liquid therein; and a connection member that is mounted to the bag-shaped member so as to be positioned at the end portion on the +Y direction side in a mounted state in which the liquid container is mounted to the liquid ejection apparatus, the connection member comprises:

a liquid introducing outlet into which the liquid introducing portion is inserted in the −Y direction in the mounted state;

a container-side electrical connection unit to which the apparatus-side electrical connection unit is connected in the −Y direction in the mounted state; and a handle configured to pivot toward the connection member with respect to the X axis in the mounted state, the handle has a grip portion, a coupling portion that is coupled to the grip portion, and a base end portion that pivotably fixes the coupling portion to the connection member, the handle is configured such that in a state where the liquid container is arranged in the case, the handle is provided at a position exposed to the outside of the case, and when the liquid container is being mounted to or removed from the case the handle is in a second orientation in which the handle is pivoted from a first orientation in the mounted state, and in the mounted state, the handle, the container-side electrical connection unit, and the liquid introducing portion are arranged at positions not overlapping with respect to the Z axis in the mounted state.

* * * * *